US010032621B2

(12) United States Patent
Heath et al.

(10) Patent No.: US 10,032,621 B2
(45) Date of Patent: Jul. 24, 2018

(54) FLAT GAS DISCHARGE TUBE DEVICES AND METHODS

(71) Applicant: Bourns, Inc., Riverside, CA (US)

(72) Inventors: Jan Heath, Temecula, CA (US); Gordon L. Bourns, Riverside, CA (US)

(73) Assignee: Bourns, Inc., Riverside, CA (US)

( * ) Notice: Subject to any disclaimer, the term of this patent is extended or adjusted under 35 U.S.C. 154(b) by 0 days.

(21) Appl. No.: 15/073,537

(22) Filed: Mar. 17, 2016

(65) Prior Publication Data

US 2016/0276146 A1 Sep. 22, 2016

Related U.S. Application Data

(60) Provisional application No. 62/134,533, filed on Mar. 17, 2015.

(51) Int. Cl.
*H01J 61/30* (2006.01)
*H01J 61/36* (2006.01)
(Continued)

(52) U.S. Cl.
CPC ..... *H01J 61/305* (2013.01); *H01J 9/18* (2013.01); *H01J 9/265* (2013.01); *H01J 9/28* (2013.01);
(Continued)

(58) Field of Classification Search
CPC ..... H01J 61/305; H01J 61/361; H01J 29/028; H01J 1/02; H01J 2211/38; H01J 2211/48;
(Continued)

(56) References Cited

U.S. PATENT DOCUMENTS 7,053,536 B1 5/2006 Boman et al.
7,253,559 B2 * 8/2007 Chang ..... C03C 3/072 313/110
(Continued)

FOREIGN PATENT DOCUMENTS

WO WO2000038199 6/2000
WO WO2014130838 8/2014
WO WO2014168589 10/2014

OTHER PUBLICATIONS

International Search Report and Written Opinion of the International Searching Authority for PCT/US2016/022970 dated Aug. 31, 2016.
(Continued)

*Primary Examiner* — Joseph L Williams
*Assistant Examiner* — Jose M Diaz
(74) *Attorney, Agent, or Firm* — Chang & Hale LLP

(57) ABSTRACT

Devices and methods related to flat discharge tubes. In some embodiments, a gas discharge tube (GDT) device can include a first insulator substrate having first and second sides and defining an opening. The GDT device can further include second and third insulator substrates mounted to the first and second sides of the first insulator substrate with first and second seals, respectively, such that inward facing surfaces of the second and third insulator substrates and the opening of the first insulator substrate define a chamber. The GDT device can further include first and second electrodes implemented on the respective inward facing surfaces of the second and third insulator substrates, and first and second terminals implemented on at least one external surface of the GDT device. The GDT device can further include electrical connections implemented between the first and second electrodes and the first and second terminals, respectively.

19 Claims, 40 Drawing Sheets

(51) Int. Cl.

| | |
|---|---|
| ***H01J 61/06*** | (2006.01) |
| ***H01J 9/18*** | (2006.01) |
| ***H01J 9/26*** | (2006.01) |
| ***H01J 9/28*** | (2006.01) |
| ***H01T 4/04*** | (2006.01) |
| ***H01T 1/20*** | (2006.01) |
| ***H01T 4/12*** | (2006.01) |

(52) U.S. Cl.
CPC ..... *H01J 61/06* (2013.01); *H01J 61/361* (2013.01); *H01T 1/20* (2013.01); *H01T 4/04* (2013.01); *H01T 4/12* (2013.01)

(58) Field of Classification Search
CPC ..... H01J 2211/00; H01J 2211/22; H01J 2211/40; H01J 2211/44; H01J 17/495; H01J 11/00; H01J 11/46; H01J 11/38; H01J 11/34; H01J 2217/49207
See application file for complete search history.

(56) References Cited

U.S. PATENT DOCUMENTS

2005/0006987 A1* 1/2005 Masuko ..... H03H 3/08 310/344
2006/0055500 A1 3/2006 Burke et al.
2007/0070647 A1* 3/2007 Ting ..... H01J 61/305 362/600
2009/0278433 A1* 11/2009 Nakashima ..... H01J 9/38 313/284
2015/0145613 A1* 5/2015 Chen ..... H03H 9/17 331/158
2016/0049276 A1* 2/2016 Fu ..... H01J 19/02 313/581
2016/0197594 A1* 7/2016 Hanzawa ..... H01C 7/008 310/348

OTHER PUBLICATIONS

PCT/US2016/022970, WO, Flat Gas Discharge Tube Devices and Methods, filed Mar. 17, 2016.
TBD, CN, Flat Gas Discharge Tube Devices and Methods.
TBD, EP, Flat Gas Discharge Tube Devices and Methods.
TBD, JP, Flat Gas Discharge Tube Devices and Methods, filed Sep. 15, 2017.
TBD, KR, Flat Gas Discharge Tube Devices and Methods.

* cited by examiner

FLAT GAS DISCHARGE TUBE DEVICES AND METHODS

CROSS-REFERENCE TO RELATED APPLICATION(S)

This application claims priority to U.S. Provisional Application No. 62/134,533 filed Mar. 17, 2015, entitled MICRO FLAT GAS DISCHARGE TUBES, the disclosure of which is hereby expressly incorporated by reference herein in its entirety.

BACKGROUND

Field

The present disclosure relates to flat gas discharge tubes.

Description of the Related Art

Many electronic devices and circuits utilize a gas discharge tube (GDT) device having a volume of gas confined between two electrodes. When sufficient potential difference exists between the two electrodes, the gas can ionize to provide a conductive medium to thereby yield a current in the form of an arc.

Based on such an operating principle, a GDT can be configured to provide reliable and effective overvoltage protection for various applications during electrical disturbances. In some applications, a GDT may be preferable over, for example, a semiconductor avalanche diode or thyristor device. Semiconductor devices typically have higher capacitances that are dependent on the voltage applied. This can cause unrecoverable distortion and high insertion and return losses in the protected communication channel. Accordingly, GDTs are frequently used in telecommunications and other applications where protection against electrical disturbances such as overvoltages is desired.

SUMMARY

In some implementations, the present disclosure relates to a gas discharge tube (GDT) device that includes a first insulator substrate having first and second sides and defining an opening. The GDT device further includes second and third insulator substrates mounted to the first and second sides of the first insulator substrate, respectively, such that inward facing surfaces of the second and third insulator substrates and the opening of the first insulator substrate define a chamber. The GDT device further includes first and second electrodes implemented on one or more inward facing surfaces of the chamber. The GDT device further includes first and second terminals implemented on at least one external surface of the GDT device. The GDT device further includes electrical connections implemented between the first and second electrodes and the first and second terminals, respectively.

In some embodiments, the first and second electrodes can be implemented on the inward facing surface of the second insulator substrate. In some embodiments, the first and second electrodes can be implemented on the inward facing surfaces of the second and third insulator substrates, respectively.

In some embodiments, the first insulator substrate can include a ceramic layer. Each of the second and third insulator substrates can include a ceramic layer.

In some embodiments, the GDT device can further include first and second seals configured to facilitate sealing of the chamber. The first seal can be implemented between the second insulator substrate and the first insulator substrate, and the second seal can be implemented between the third insulator substrate and the first insulator substrate. In some embodiments, each of the first and second seals can be an electrically conductive seal, or an electrically non-conductive seal.

In some embodiments, the first and second terminals can be implemented at least on the second insulator substrate. The first and second terminals can also be implemented on the third insulator substrate and electrically connected to their respective first and second terminals on the second insulator substrate.

In some embodiments, the electrical connections can include a first internal via that extends through the second insulator substrate and configured to electrically connect the first electrode to the first terminal. The electrical connections can further include a second internal via that extends through the third insulator substrate and configured to electrically connect the second electrode to a conductor feature on an outward facing surface of the third insulator substrate. The electrical connections can further include a third internal via that extends through the third insulator substrate, the first insulator substrate, and the second insulator substrate, with the third internal via being configured to electrically connect the conductor feature on the outward facing surface of the third insulator substrate and the second terminal. The electrical connections can further include an external conductive feature implemented on a side edge of the GDT device and configured to electrically connect the conductor feature on the outward facing surface of the third insulator substrate and the second terminal. The external conductive feature can include a castellation feature that is at least partially filled and/or plated with electrically conductive material.

In some embodiments, the electrical connections can include a first metalized trace that extends laterally from the first electrode to a first side edge of the GDT device, and a second metalized trace that extends laterally from the second electrode to a second side edge of the GDT device. The first side edge and the second side edge can be opposing edges. The electrical connections can further include a first external conductive feature implemented on the first side edge and configured to electrically connect the first metalized trace to the first terminal, and a second external conductive feature implemented on the second side edge and configured to electrically connect the second metalized trace to the second terminal. Each of the first and second external conductive features can include a castellation feature that is at least partially filled and/or plated with electrically conductive material.

In some embodiments, the first terminal can be implemented on the second insulator substrate, and the second terminal can be implemented on the third insulator substrate. The electrical connections can include a first metalized trace that extends laterally from the first electrode to a location at or near a side edge of the second insulator substrate, and a second metalized trace that extends laterally from the second electrode to a location at or near a side edge of the third insulator substrate. The side edge of the second insulator substrate and the side edge of the third insulator substrate can be opposing edges. The electrical connections can further include a first external conductive feature implemented on the side edge of the second insulator substrate and configured to electrically connect the first metalized trace to the first terminal, and a second external conductive feature implemented on the side edge of the third insulator substrate and configured to electrically connect the second metalized trace to the second terminal. Each of the first and second external conductive features can include a castellation feature that is at least partially filled and/or plated with electrically conductive material.

In some embodiments, the electrical connections can further include a first internal conductive via implemented through the second insulator substrate and configured to electrically connect the first metalized trace to the first terminal, and a second internal conductive via implemented through the third insulator substrate and configured to electrically connect the second metalized trace to the second terminal.

In some embodiments, the opening can have a cylindrical shape. In some embodiments, the first insulator substrate can further define at least one additional opening, and the second and third insulator substrates can include respective additional first and second electrodes for each of the at least one additional opening so as to define a plurality of chambers arranged in an array. In some embodiments, at least some of the plurality of chambers can be electrically interconnected.

In some embodiments, the GDT device can further include another GDT device stacked with the GDT device so as to yield first and second stacked chambers. In some embodiments, at least some of the stacked chambers can be electrically interconnected. In some embodiments, each of the first and second stacked chambers can be substantially sealed. In some embodiments, the first and second stacked chambers can be in communication through a hole.

In some embodiments, first and last electrodes associated with the stacked chambers can be electrically connected to first and second terminals, respectively. In some embodiments, center electrodes between the first and last electrodes can be electrically connected to a third terminal.

In some embodiments, the GDT device can further include a third electrode and a third terminal electrically connected to the third electrode.

In some implementations, the present disclosure relates to a method for fabricating a gas discharge tube (GDT) device. The method includes providing or forming a first insulator substrate having first and second sides and defining an opening. The method further includes mounting second and third insulator substrates to the first and second sides of the first insulator substrate, respectively, such that inward facing surfaces of the second and third insulator substrates and the opening of the first insulator substrate define a chamber. Each of the second and third insulator substrates includes an electrode implemented on a surface facing the chamber. The method further includes forming first and second terminals on at least one external surface of the second and third insulator substrates. The method further includes electrically connecting the first and second electrodes and the first and second terminals, respectively.

In some implementations, the present disclosure relates to a method for fabricating gas discharge tube (GDT) devices. The method includes providing or forming a first insulator plate having first and second sides and an array of openings. The method further includes providing or forming second and third insulator, with each including an array of electrodes implemented on a surface, and a conductor feature electrically connected to each electrode. The method further includes mounting the second and third insulator plates to the first and second sides of the first insulator plate, respectively, such that the arrays of electrodes on the second and third insulator plates face each other through the array of openings to thereby define an array of chambers.

In some embodiments, the method can further include forming first and second terminals for each pair of the first and second electrodes on at least one surface of the second and third insulator plates. The method can further include electrically connecting each pair of the first and second electrodes and the first and second terminals, respectively.

In some embodiments, each of the second and third insulator plates can further include an array of seals implemented on the surface such that the corresponding chamber becomes a substantially sealed chamber. In some embodiments, each of the first, second and third insulator plates can include a ceramic plate.

In some embodiments, the conductor feature can include a first internal via that extends through the second insulator plate, and a second internal via that extends through the third insulator plate. The first and second terminals can be formed on the second insulator plate. The first internal via can provide an electrical connection between the corresponding first electrode and the corresponding first terminal. The second internal via can provide an electrical connection between the corresponding second electrode and a conductor feature on the third insulator plate.

In some embodiments, the electrically connecting can further include forming an electrical path between each conductor feature and the corresponding second terminal. The electrical path between each conductor feature and the corresponding second terminal can include a conductive via through the third, first and second insulator plates. The electrical path between each conductor feature and the corresponding second terminal can include a portion of a conductive castellation via.

In some embodiments, the method can further include singulating the array of chambers into a plurality of individual GDT devices.

In some embodiments, the conductor feature can include a first metalized trace that extends laterally to electrically connect the first electrode to a first side edge of a corresponding unit on the second insulator plate, and a second metalized trace that extends laterally to electrically connect the second electrode to a second side edge of a corresponding unit on the third insulator plate. The first side edge of the second insulator plate can include a conductive castellation that electrically connects the first metalized trace and the first terminal, and the second side edge of the third insulator plate can include a conductive castellation that electrically connects the second metalized trace and the second terminal. In some embodiments, the method can further include singulating the array of chambers into a plurality of individual GDT devices. The singulating can result in the castellations along the first side edge of the second insulator plate and the second side edge of the third insulator plate being exposed.

In some embodiments, the first and second terminals can be implemented on the second insulator plate. In some embodiments, the first and second terminals can be implemented on both of the second and third insulator plates.

In some embodiments, the castellation filled and/or plated with conductive material along the first side edge of the second insulator plate can extend through the corresponding side edges of the first insulator plate and the third insulator plate, and the castellation filled and/or plated with conductive material along the second side edge of the third insulator plate can extend through the corresponding side edges of the first insulator plate and the second insulator plate.

In some embodiments, the first terminal can be formed on the second insulator plate, and the second terminal can be formed on the third insulator plate.

In some embodiments, the singulating can include singulating the array of chambers such that each individual GDT device includes one chamber. In some embodiments, the singulating can include singulating the array of chambers such that each individual GDT device includes a plurality of chambers. In some embodiments, the method can further include electrically interconnecting at least some of the plurality of chambers.

In some embodiments, the method can further include stacking another GDT device with the GDT device so as to yield first and second stacked chambers. The method can further include electrically interconnecting at least some of the stacked chambers. In some embodiments, each of the first and second stacked chambers can be substantially sealed. In some embodiments, the first and second stacked chambers can be in communication through a hole.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF SOME EMBODIMENTS

The headings provided herein, if any, are for convenience only and do not necessarily affect the scope or meaning of the claimed invention.

Overview:

Described herein are examples of devices and methods related to flat gas discharge tubes (GDTs) having one or more electrodes formed on substrate(s) such as insulator substrate(s). Additional details concerning flat GDTs can be found in U.S. Publication No. 2014/0239804 titled DEVICES AND METHODS RELATED TO FLAT GAS DISCHARGE TUBES which is expressly incorporated by reference in its entirety, and its disclosure is to be considered part of the specification of the present application.

Figure 1:
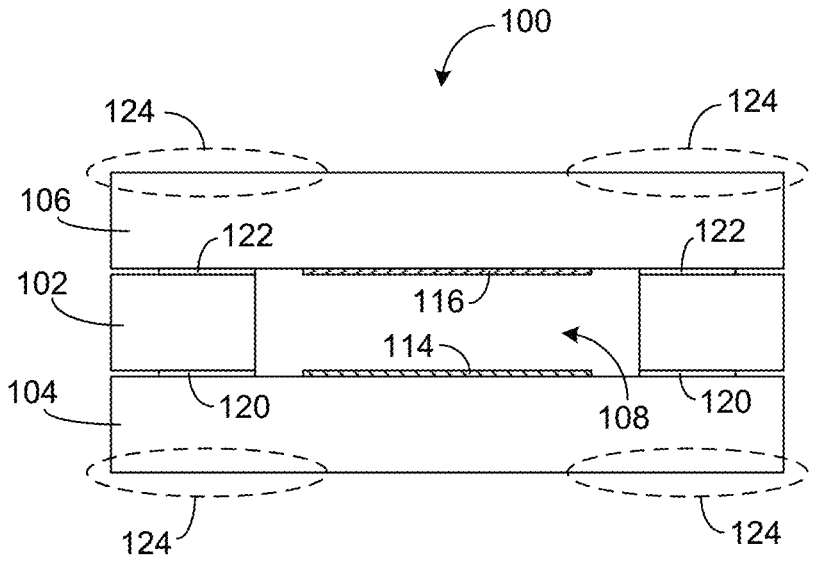
FIG. 1 shows a side sectional view of a flat gas discharge tube (GDT) having one or more features as described herein.

FIG. 1 shows a side sectional view of a flat GDT 100 having one or more features as described herein. The flat GDT 100 can include a first insulator substrate 102 that defines an opening 108. In some embodiments, such a first insulator substrate can include, for example, ceramic. The first insulator substrate 102 is shown to include a first side (e.g., a lower side as depicted in FIG. 1) and a second side (e.g., an upper side as depicted in FIG. 1).

FIG. 1 further shows a second insulator substrate 104 implemented on the first side of the first insulator substrate 102, and a third insulator substrate 106 implemented on the second side of the first insulator substrate 102. In some embodiments, either or both of the second and third insulator substrates 104, 106 can include, for example, ceramic. Although various examples are described herein with such first, second and third insulator substrates, it will be understood that one or more features of the present disclosure can also be implemented utilizing more or less than three insulator substrates. For example, a flat GDT can include an insulator substrate having an opening therethrough, and an upper or a lower insulator substrate having an electrode as described herein. In such a configuration, the other electrode can be mounted on the opposing side as the insulator substrate-based electrode. In another example, a flat GDT can include two insulator substrates having a chamber defined by one or both insulator substrates, and with each insulator substrate having an electrode as described herein. Although various examples are described herein based upon use of pre-fired ceramic substrates, it will be understood that one or more features of the present disclosure can also be implemented utilizing, for example, co-fired ceramic substrates and related manufacturing processes, or low temperature co-fired ceramic (LTCC) substrates and related manufacturing processes.

In the example of FIG. 1, the second insulator substrate 104 can be mounted to the lower side of the first insulator substrate 102 with a seal 120. Similarly, the third insulator substrate 106 can be mounted to the upper side of the first insulator substrate 102 with a seal 122. Each of the seals 120, 122 can be an electrical conductor or an electrical insulator. The electrically conducting seal can be formed by, for example, braze/solder material such as copper-silver (CuSil) material. The electrically non-conductive seal can be formed by, for example, glass/glue non-conductive adhesive material. In some embodiments, the seal can be formed on a surface of the corresponding insulator substrate (104 or 106) and/or the corresponding surface of the first insulator substrate 102 prior to joining of the corresponding substrates. In some embodiments, all three insulator substrates can be joined at the same time utilizing, for example, a brazing or sealing oven. In embodiments utilizing co-fired ceramic substrates or low-temperature ceramic (LTCC) substrates, seals between insulator substrates can be achieved with, for example, direct bonding of adjacent substrates during a firing process.

In the example of FIG. 1, an electrode 114 is shown to be implemented on the second insulator substrate 104. Similarly, an electrode 116 is shown to be implemented on the third insulator substrate 106. Accordingly, a substantially sealed chamber can be formed by the opening 108 and the second and third insulator substrates 104, 106 with their respective first and second electrodes.

In the example of FIG. 1, the first and second electrodes 114, 116 can be electrically connected to two or more terminals that are generally depicted as 124. Various examples of how such electrical connections can be implemented between the electrodes 114, 116 and some or all of the terminals 124 are described herein in greater detail.

Examples of Seals:

In the example flat GDT 100 of FIG. 1, as well as in other more specific examples described herein, the seals 120, 122 can be electrically conductive seals, electrically non-conductive seals, or any combination thereof. Examples related to such electrically conductive and electrically non-conductive seals are described herein in greater detail. In embodiments utilizing co-fired ceramic substrates or low-temperature ceramic (LTCC) substrates, seals between insulator substrates can be achieved with, for example, direct bonding of adjacent substrates during a firing process.

Figure 2:
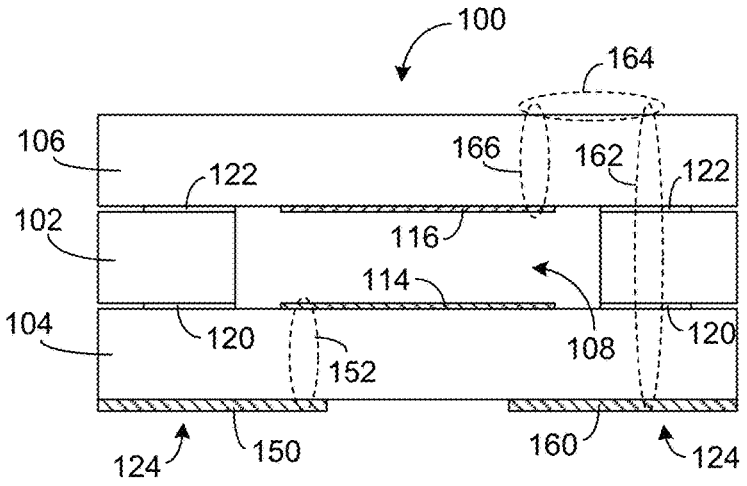
FIG. 2 shows an example GDT where each of two electrodes can be electrically connected to its corresponding terminal through one or more internal through-substrate connections such as conductive vias.
Figure 3:
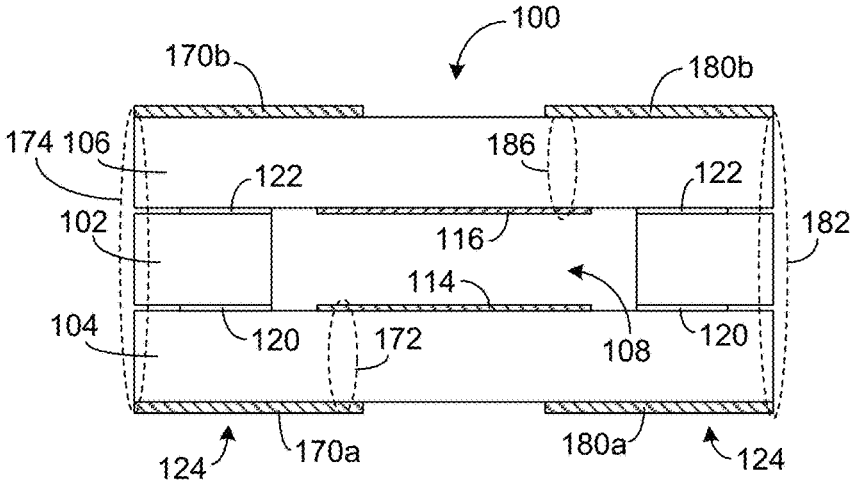
FIG. 3 shows an example GDT where electrical connections between the electrodes and their respective terminals can include one or more conductive vias and one or more external conductive features along respective edges of the flat GDT.
Figure 4:
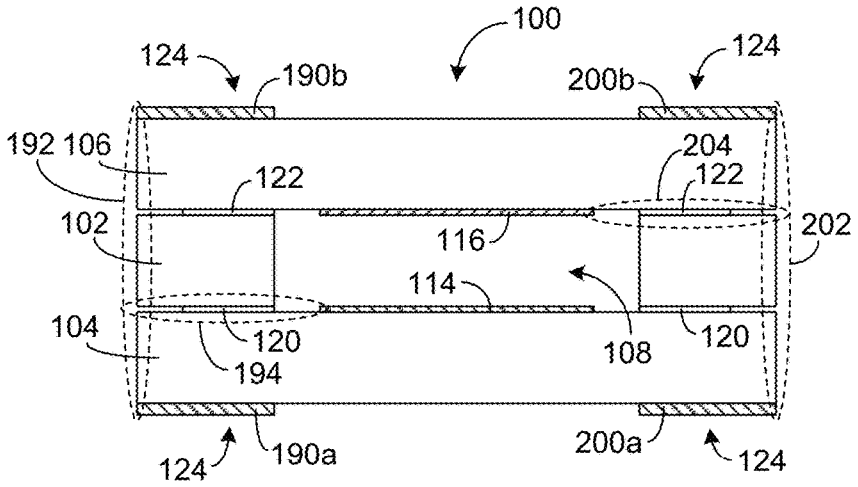
FIG. 4 shows an example GDT where each of two electrodes can be electrically connected to its corresponding terminal through connector traces formed on insulator substrates and through one or more external conductive features along respective edges of the flat GDT.

Examples of Connections Between Electrodes and Terminals:

FIGS. 2-4 show more examples of how the electrodes 114, 116 can be electrically connected to their respective terminals. FIG. 2 shows an example where each of the electrodes 114, 116 can be electrically connected to its corresponding terminal through one or more internal through-substrate connections such as conductive vias. FIG. 3 shows an example where the electrical connections between the electrodes 114, 116 and their respective terminals can include one or more conductive vias and one or more external conductive features along respective edges of the flat GDT 100. FIG. 4 shows an example where each of the electrodes 114, 116 can be electrically connected to its corresponding terminal through connector traces formed on the insulator substrates 104, 106 and through one or more external conductive features along respective edges of the flat GDT 100. For the purpose of description, it will be understood that such traces can be described as being a connector, a conductor, a metallized layer, or any combination thereof so as to provide an electrical path.

Referring to FIG. 2, a flat GDT 100 is shown to include a first insulator substrate 102, a second insulator substrate 104, a third insulator substrate 106, seals 120, 122, and electrodes 114, 116 that can be similar to the example of FIG. 1 so as to form a sealed chamber facilitated by an opening 108 of the first insulator substrate 102. The seals 120, 122 can be electrically conductive or electrically non-conductive.

In the example of FIG. 2, terminals 150, 160 are shown to be implemented on the underside of the flat GDT 100 so as to facilitate, for example, surface mounting applications. The electrode 114 on the second insulator substrate 104 is shown to be electrically connected to the terminal 150 through a through-substrate connection such as a via 152. The electrode 116 on the third insulator substrate 106 is shown to be electrically connected to the terminal 160 through a through-substrate connection such as a via 166, a connector trace 164 on the surface of the third insulator substrate 106, and a connection such as a via 162 that extends through the third insulator substrate 106, the first insulator substrate 102, and the second insulator substrate 104. In some embodiments, some or all of the through-substrate connections 152, 166, 162 can be conductive vias. Examples of how such conductive vias can be formed are described in greater detail in U.S. Publication No. 2014/0239804.

Referring to FIG. 3, a flat GDT 100 is shown to include a first insulator substrate 102, a second insulator substrate 104, a third insulator substrate 106, seals 120, 122, and electrodes 114, 116 that can be similar to the example of FIG. 1 so as to form a sealed chamber facilitated by an opening 108 of the first insulator substrate 102. The seals 120, 122 can be electrically conductive or electrically non-conductive.

In the example of FIG. 3, terminals 170, 180 are shown to be implemented on both of the underside (with terminals 170*a*, 180*a*) and upper side (with terminals 170*b*, 180*b*) of the flat GDT 100 so as to facilitate, for example, surface mounting applications in either upright or inverted orientation. The electrode 114 on the second insulator substrate 104 is shown to be electrically connected to the terminal 170 through a through-substrate connection such as a via 172. The electrode 116 on the third insulator substrate 106 is shown to be electrically connected to the terminal 180 through a through-substrate connection such as a via 186, a connector trace 184 on the surface of the third insulator substrate 106, and an external conductive feature such as a castellation 182 on the corresponding edge of the flat GDT 100.

In some embodiments, an external conductive feature such as a castellation 174 which is electrically connected to the terminal 170 may or may not be implemented. For example, if the flat GDT 100 is designed to be surface mounted through the underside with the terminals 170, 180 as shown, the external conductive feature 174 may not be needed or desired. In another example, terminals can be implemented on the upper side (when viewed as shown in FIG. 3). To achieve such a configuration, a terminal which is electrically connected to the external conductive feature 174 (and hence to the electrode 114) can be formed on the upper left side of the flat GDT 100 of FIG. 3. For the other terminal on the upper side, the connector trace 184 can be configured as a terminal, thereby providing electrical connection to the electrode 116.

In some embodiments, some or all of the external conductive features 182, 174 can include, for example, filled and/or plated castellation features such as vias or portions thereof. Examples of how such castellation features can be formed are described in greater detail in U.S. Publication No. 2014/0239804.

Referring to FIG. 4, a flat GDT 100 is shown to include a first insulator substrate 102, a second insulator substrate 104, a third insulator substrate 106, seals 120, 122, and electrodes 114, 116 that can be similar to the example of FIG. 1 so as to form a sealed chamber facilitated by an opening 108 of the first insulator substrate 102. The seals 120, 122 can be electrically conductive or electrically non-conductive.

In the example of FIG. 4, terminals are shown to be implemented on both of the underside and the upper side of the flat GDT 100 so as to facilitate, for example, surface mounting on either side of the flat GDT 100. More particularly, terminals 190*a*, 200*a* are implemented on the underside of the flat GDT 100, and terminals 190*b*, 200*b* are implemented on the upper side of the flat GDT 100. Although the flat GDT 100 of FIG. 4 is described in such a configuration, it will be understood that one or more features of the present disclosure can also be implemented with terminals on one side only.

In the example of FIG. 4, the electrode 114 on the second insulator substrate 104 is shown to be electrically connected to the terminals 190*a*, 190*b* through a lateral connection such as a conductive trace 194 and an external conductive feature such as a castellation 192 on the corresponding edge of the flat GDT 100. Similarly, the electrode 116 on the third insulator substrate 106 is shown to be electrically connected to the terminals 200*a*, 200*b* through a lateral connection such as a conductive trace 204 and an external conductive feature such as a castellation 202 on the corresponding edge of the flat GDT 100.

In some embodiments, some or all of the external conductive features 192, 202 can include, for example, filled and/or plated castellation features such as vias or portions thereof. Examples of how such castellation features can be formed are described in greater detail in U.S. Publication No. 2014/0239804.

More Specific Examples of Flat GDTs:

FIGS. 5-8 show more specific examples of the configurations described above in reference to FIGS. 2-4. For a given electrodes-to-terminals configuration, seals can be electrically conductive or electrically non-conductive.

In the various examples of FIGS. 5-8, first insulator substrates 102 and their respective openings 108, second insulator substrates 104 and third insulator substrates 106 can be generally similar as described in reference to FIGS. 1-4. Similarly, electrically conductive seals and/or electrically non-conductive seals in the various examples of FIGS. 5-8 can be generally similar as described in reference to FIGS. 1-4. In some specific examples, such seals can be configured appropriately to accommodate corresponding designs; and such variations are described herein in greater detail.

Figure 5A:
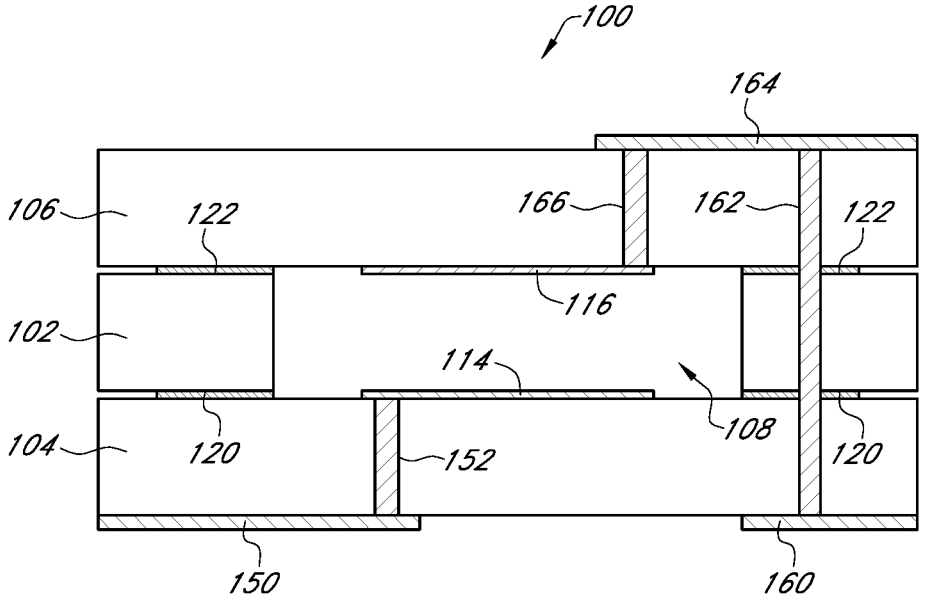
FIG. 5A shows a side sectional view of a flat GDT that can be a more specific example of the flat GDT of FIG. 2.
Figure 5B:
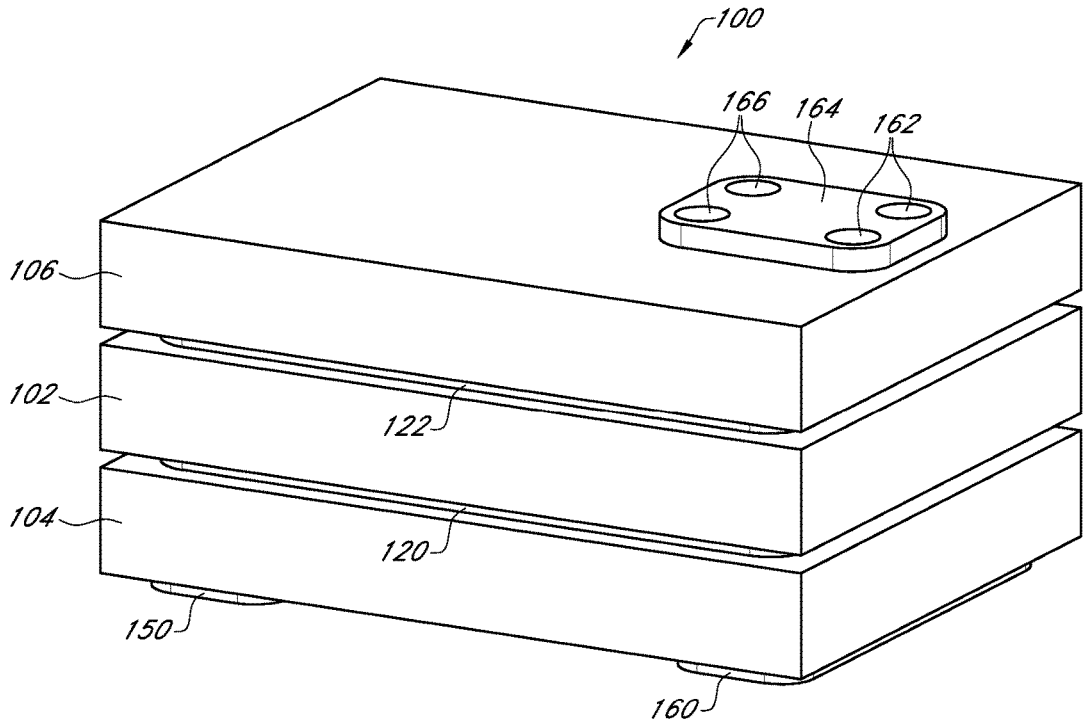
FIG. 5B shows an upper perspective view of the flat GDT of FIG. 5A.
Figure 5C:
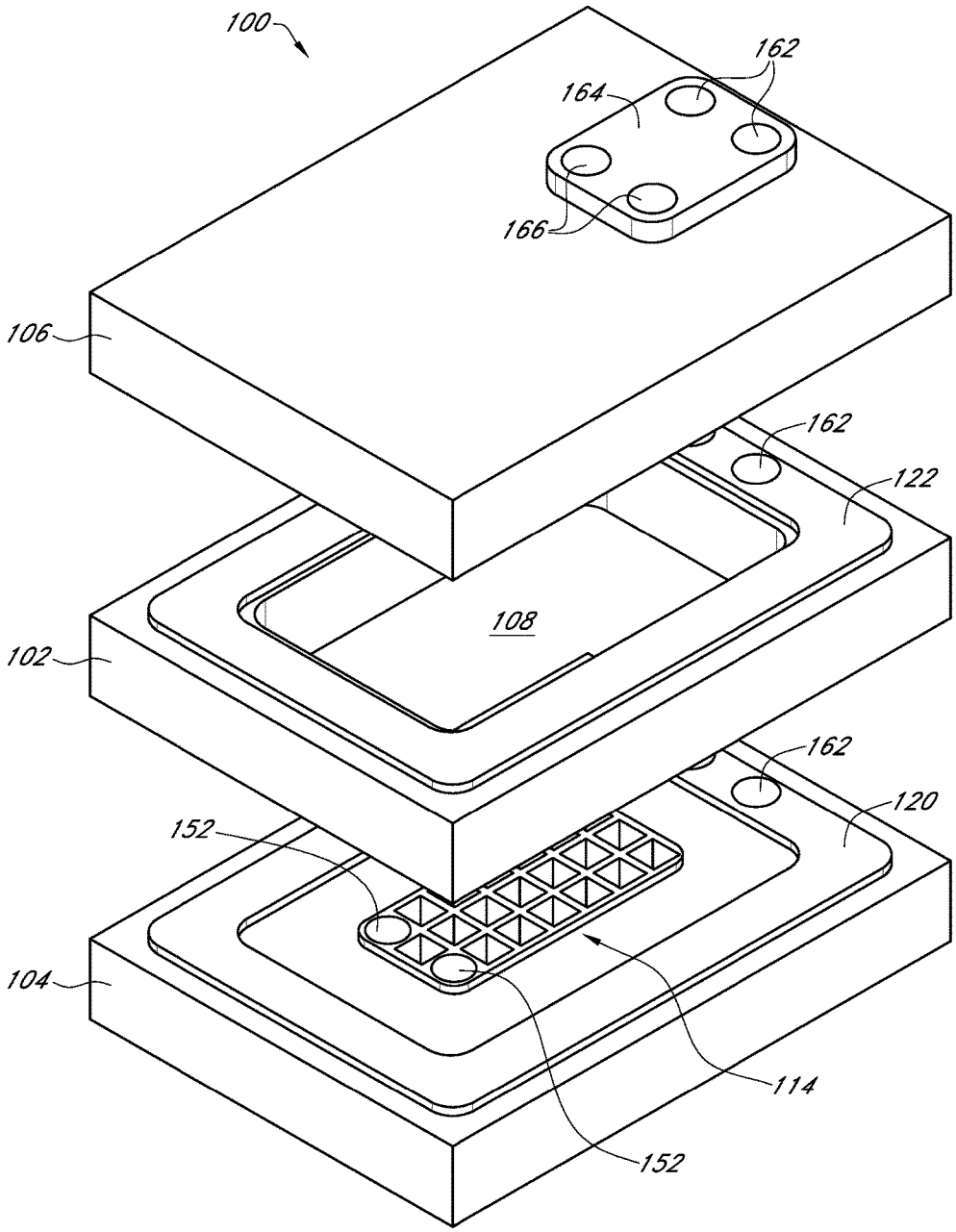
FIG. 5C shows an unassembled upper perspective view of the flat GDT of FIG. 5A.
Figure 5D:
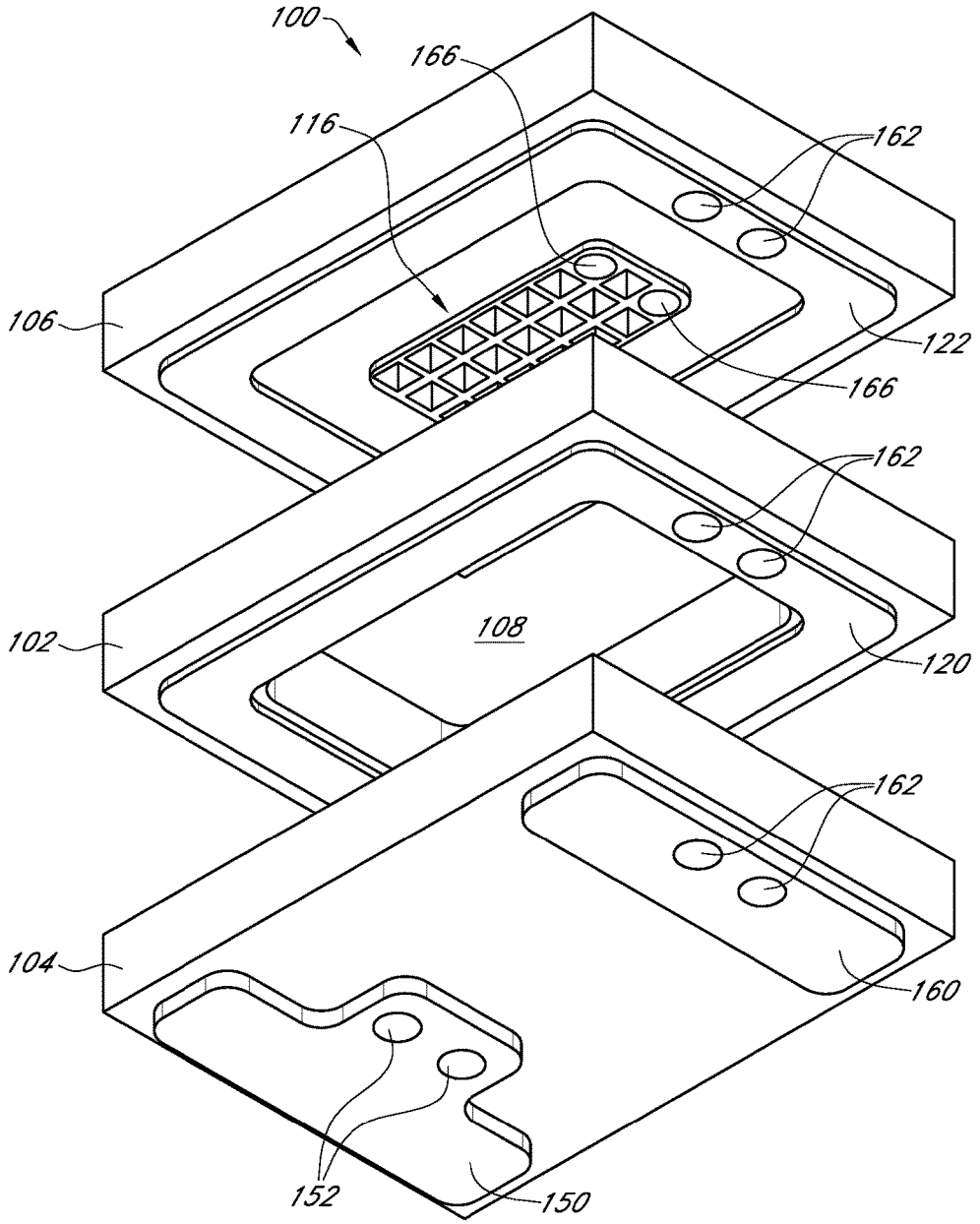
FIG. 5D shows an unassembled lower perspective view of the flat GDT of FIG. 5A.

Examples Related to Flat GDTs with Internal Conductive Vias:

FIGS. 5A-5D show various views of an example flat GDT 100 having a plurality of internal through-substrate vias for providing electrical connections between electrodes and terminals. FIG. 5A shows a side sectional view, FIG. 5B shows an upper perspective view, FIG. 5C shows an unassembled upper perspective view, and FIG. 5D shows an unassembled lower perspective view. In the example of FIGS. 5A-5D, seals can be electrically conducting or electrically non-conductive as described herein. Such a flat GDT 100 of FIGS. 5A-5D can be a more specific example of the flat GDT 100 described herein in reference to FIG. 2.

In the example of FIGS. 5A-5D, through-substrate connections (152, 166, 162 in FIG. 2) are depicted as electrically conductive through-substrate vias 152, 166, 162. More particularly, the via 152 is shown to be formed through the second insulator substrate 104 so as to electrically connect the electrode 114 to the terminal 150. The via 166 is shown to be formed through the third insulator substrate 106 so as to electrically connect the electrode 116 to a connector trace 164 on the upper side of the third insulator substrate 106. The via 162 is shown to be formed through the third insulator substrate 106, the first insulator substrate 102, and the second insulator substrate 104 so as to electrically connect the connector trace 164 (and hence the electrode 116) to the terminal 160.

Referring to FIGS. 5B and 5C, two example vias 166 are shown to be electrically connected to the connector trace 164. Similarly, two example vias 162 are shown to be electrically connected to the connector trace 164. It will be understood that other numbers of vias (e.g., less than two or greater than two) can be utilized.

Also referring to FIGS. 5B and 5C, the connector trace 164 can be a metalized layer configured to provide an adequate thermal path in order to remove thermal energy from electrode 116 inside the package generated during the on-state of the device. Similarly, the terminal 150 can be configured to act as a heat-sink and remove heat from electrode 114.

Also referring to FIGS. 5B and 5C, the connector trace 164 can be a metalized layer dimensioned to provide electrical connection between the vias 166 and the vias 162. Such a metalized layer can be formed on the upper surface of the third insulator substrate 106 utilizing a number of techniques, including, for example, printing of thick film, plating or other deposition and patterning such as etching.

In the example of FIGS. 5A-5D, the flat GDT 100 is shown to include a seal 120 between the first and second insulator substrates 102, 104, and a seal 122 between the first and third insulator substrates 102, 106. Such seals can be electrically conductive seals, electrically non-conductive seals, or any combination thereof.

Referring to FIGS. 5C and 5D, the two vias 162 are shown to extend through the seals 120, 122. Accordingly, if the seals 120, 122 are electrically conductive, the electrode 116 and the corresponding terminal 160 are electrically connected to the electrically conductive seals 120, 122. In such a configuration, either or both of the electrodes 114, 116 can be dimensioned appropriately so as to provide sufficient electrical insulation gap between the two electrodes. If the seals 120, 122 are electrically non-conductive, or if the two vias 162 are surrounded by areas of insulation and thus not electrically connected to the electrically conductive seals 120, 122, areas of either or both of the electrodes 114, 116 can be increased while maintaining sufficient electrical insulation distance between the two electrodes.

As shown in FIGS. 5A and 5D, the electrode 116 can be formed on the underside of the third insulator substrate 106. Similarly, and as shown in FIGS. 5A and 5C, the electrode 114 can be formed on the upper side of the second insulator substrate 104. In some embodiments, each of such electrodes (114, 116) can be a simple metal layer, or can include features such as a waffle pattern. In some embodiments, an emissive coating can be printed on the electrodes. In some embodiments, pre-ionization lines and/or patterns can be formed on one or more of the insulator substrates to control breakdown parameters. Examples related to one or more of such features are described in greater detail in U.S. Publication No. 2014/0239804.

Figure 6A:
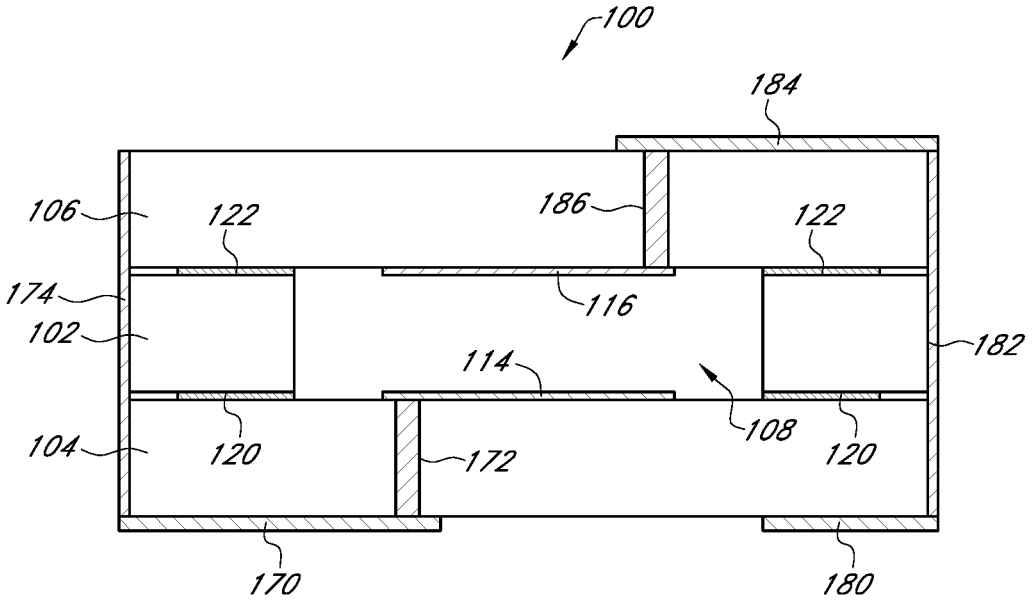
FIG. 6A shows a side sectional view of a flat GDT that can be a more specific example of the flat GDT of FIG. 3.
Figure 6B:
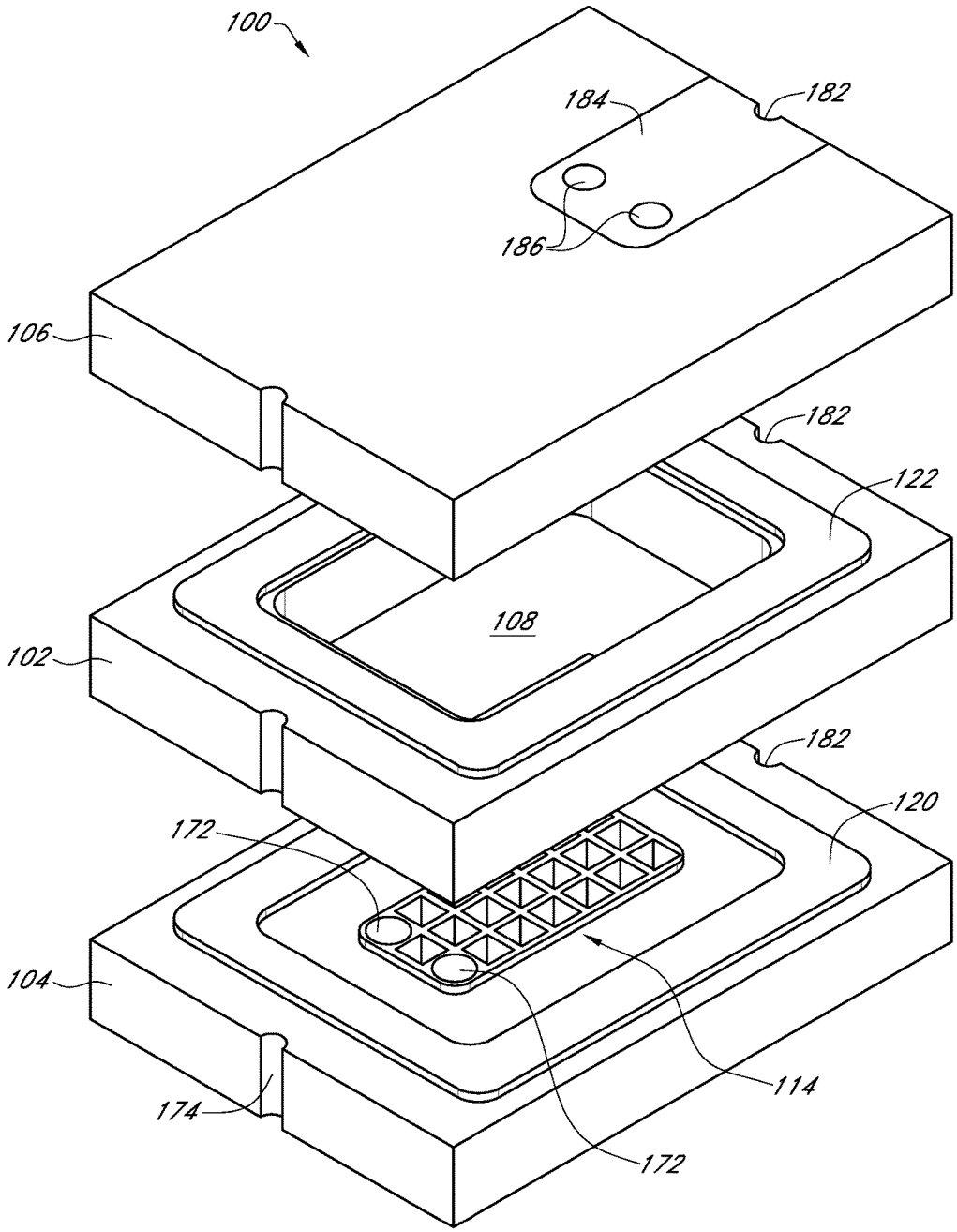
FIG. 6B shows an unassembled upper perspective view of the flat GDT of FIG. 6A.
Figure 6C:
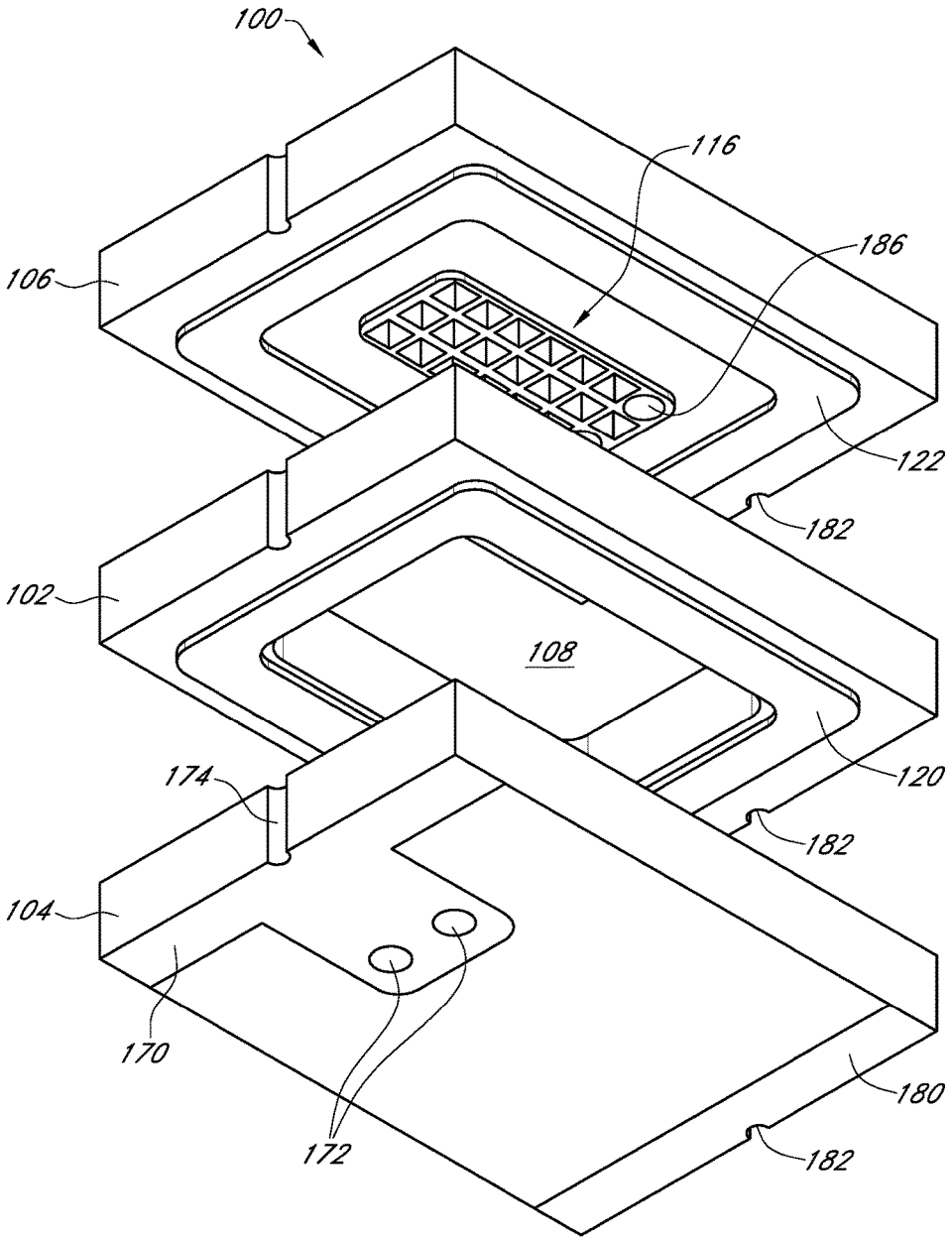
FIG. 6C shows an unassembled lower perspective view of the flat GDT of FIG. 6A.

Examples Related to Flat GDTs with Internal Vias and External Connections:

FIGS. 6A-6C show various views of an example flat GDT 100 having both internal through-substrate vias and external conductive features for providing electrical connections between electrodes and terminals. FIG. 6A shows a side sectional view, FIG. 6B shows an unassembled upper perspective view, and FIG. 6C shows an unassembled lower perspective view. In the example of FIGS. 6A-6C, seals can be electrically conducting or electrically non-conductive as described herein. Such a flat GDT 100 of FIGS. 6A-6C can be a more specific example of the flat GDT 100 described herein in reference to FIG. 3.

In the example of FIGS. 6A-6C, through-substrate connections (172, 186 in FIG. 3) are depicted as electrically conductive through-substrate vias 172, 186, and external conductive features (174, 182 in FIG. 3) can be metalized castellations 174, 182. More particularly, the via 172 is shown to be formed through the second insulator substrate 104 so as to electrically connect the electrode 114 to the terminal 170. The castellation 174 can be included on a side edge of the flat GDT 100 so as to be electrically connected to the terminal 170. The via 186 is shown to be formed through the third insulator substrate 106 so as to electrically connect the electrode 116 to a connector trace 184 on the upper side of the third insulator substrate 106. The castellation 182 is shown to be included on a side edge of the flat GDT 100 so as to electrically connect the connector trace 184 (and hence the electrode 116) to the terminal 180.

Referring to FIGS. 6B and 6C, two example vias 186 are shown to provide an electrical connection between the electrode 116 and the connector trace 184. It will be understood that other numbers of vias (e.g., less than two or greater than two) can be utilized. The connector trace 184 can be a metalized layer dimensioned to provide electrical connection between the vias 186 and the side castellation 182. In some embodiments, the connector trace 184 can be formed utilizing a number of techniques, including, for example, printing of thick film, plating or other deposition and patterning such as etching.

In the example of FIGS. 6A-6C, the flat GDT 100 is shown to include a seal 120 between the first and second insulator substrates 102, 104, and a seal 122 between the first and third insulator substrates 102, 106. Such seals can be electrically conductive seals, electrically non-conductive seals, or any combination thereof.

As shown in FIGS. 6A and 6B, the electrode 114 can be formed on the second insulator substrate 104. Similarly, and as shown in FIGS. 6A and 6C, the electrode 116 can be formed on the third insulator substrate 106. In some embodiments, each of such electrodes (114, 116) can be a simple metal layer, or can include features such as a waffle pattern. In some embodiments, an emissive coating can be printed on the electrodes. In some embodiments, pre-ionization lines and/or patterns can be formed on one or more of the insulator substrates to control breakdown parameters. Examples related to one or more of such features are described in greater detail in U.S. Publication No. 2014/0239804.

Figure 7A:
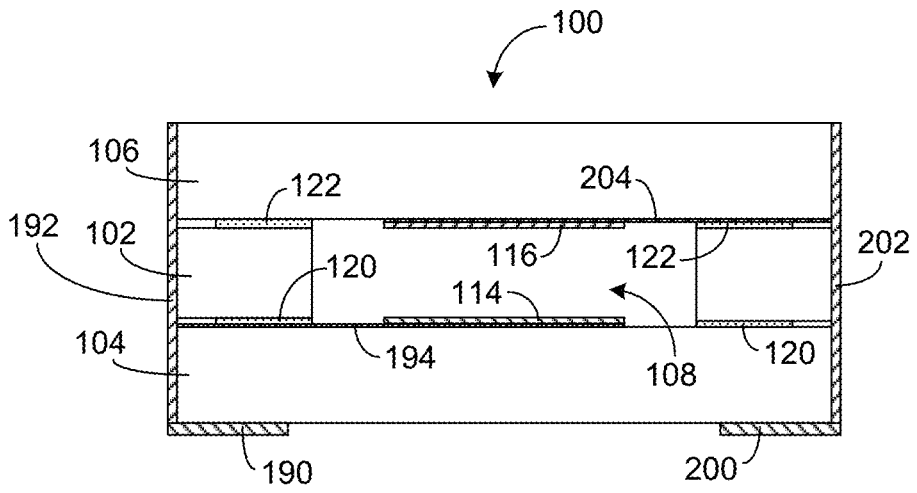
FIG. 7A shows a side sectional view of a flat GDT that can be a more specific example of the flat GDT of FIG. 4.
Figure 7B:
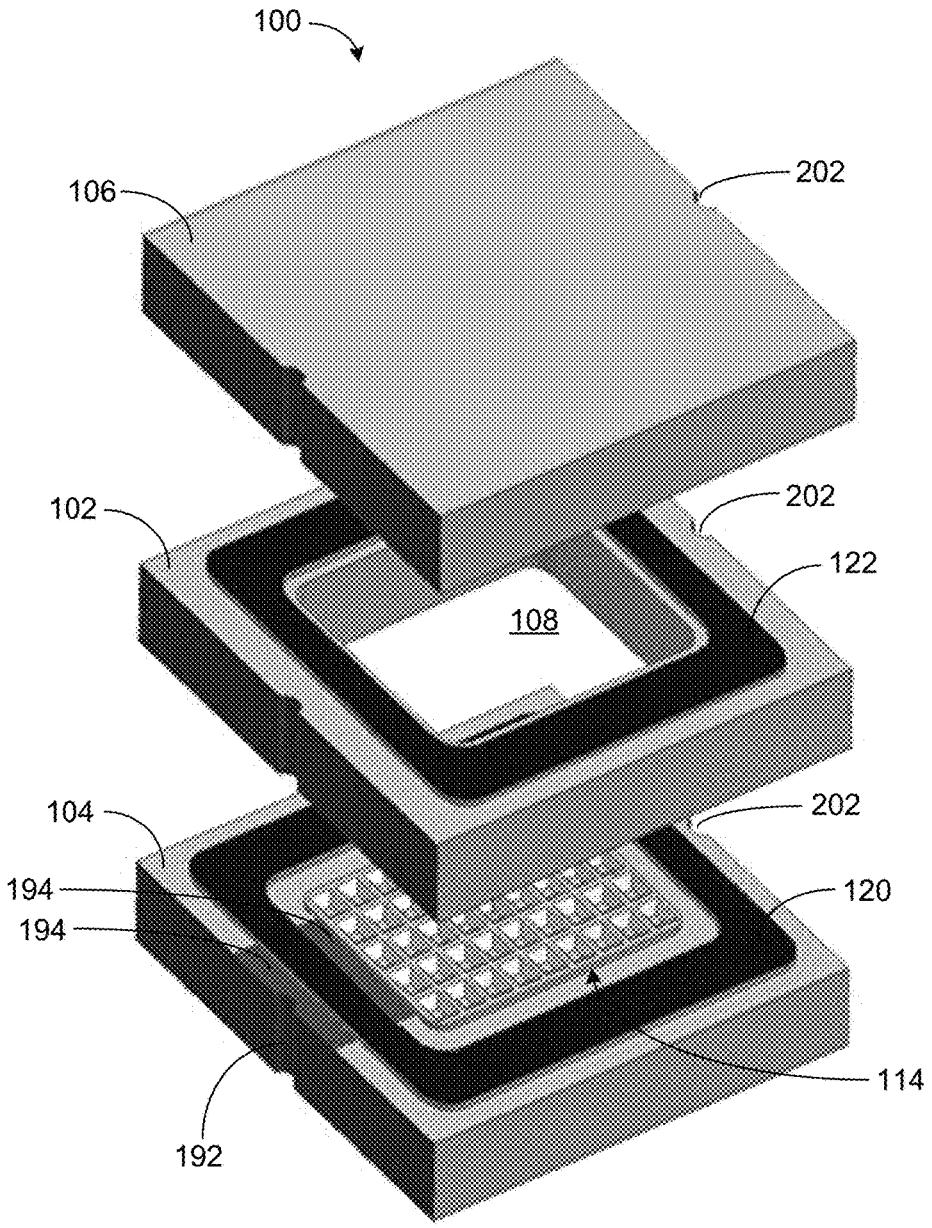
FIG. 7B shows an unassembled upper perspective view of the flat GDT of FIG. 7A.
Figure 7C:
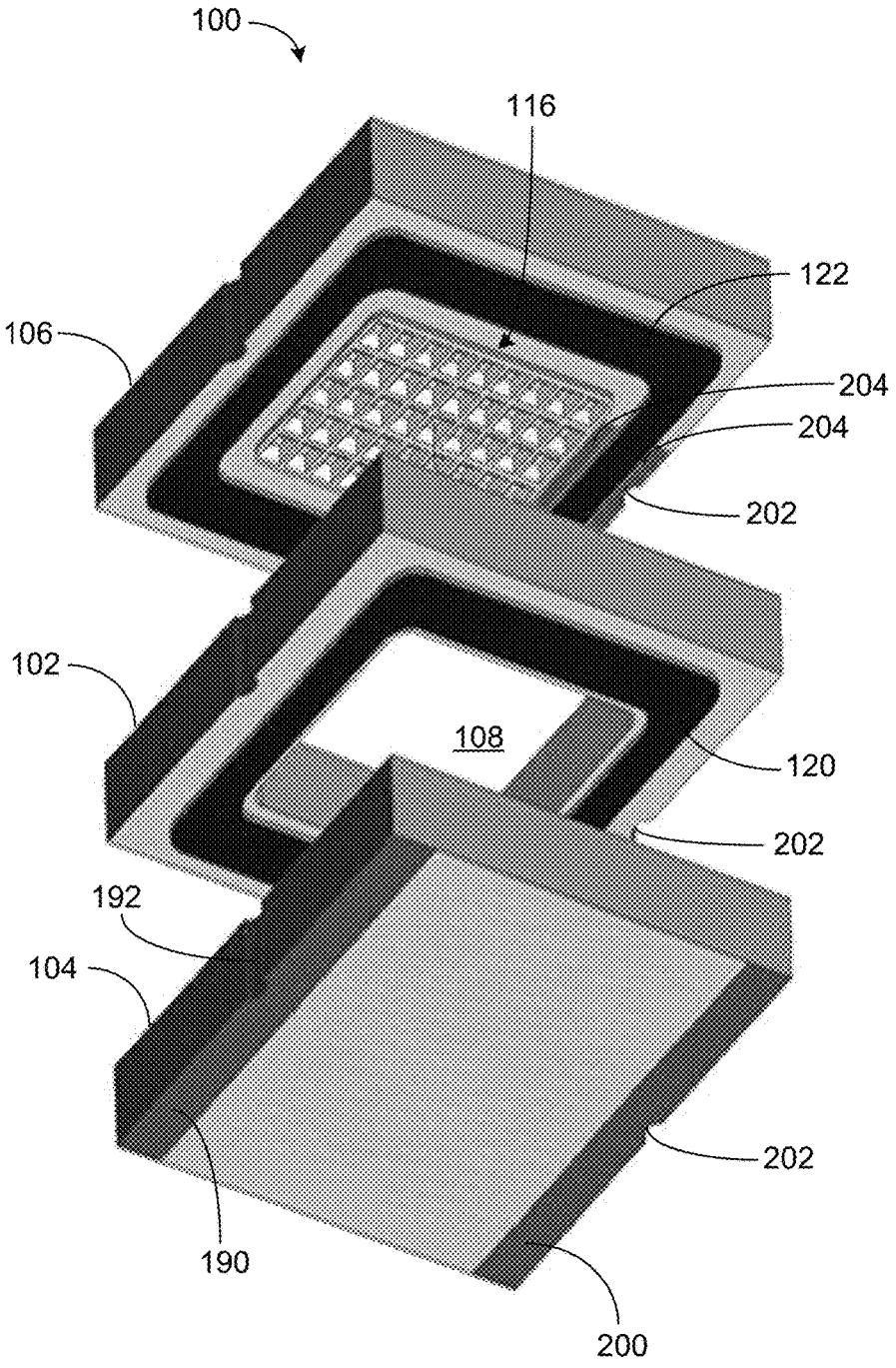
FIG. 7C shows an unassembled lower perspective view of the flat GDT of FIG. 7A.
Figure 8A:
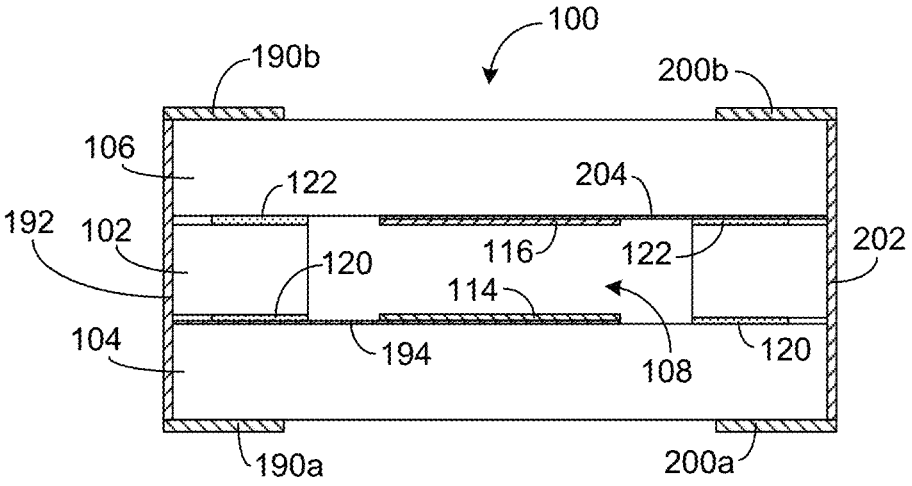
FIG. 8A shows a side sectional view of a flat GDT that can be another more specific example of the flat GDT of FIG. 4.
Figure 8B:
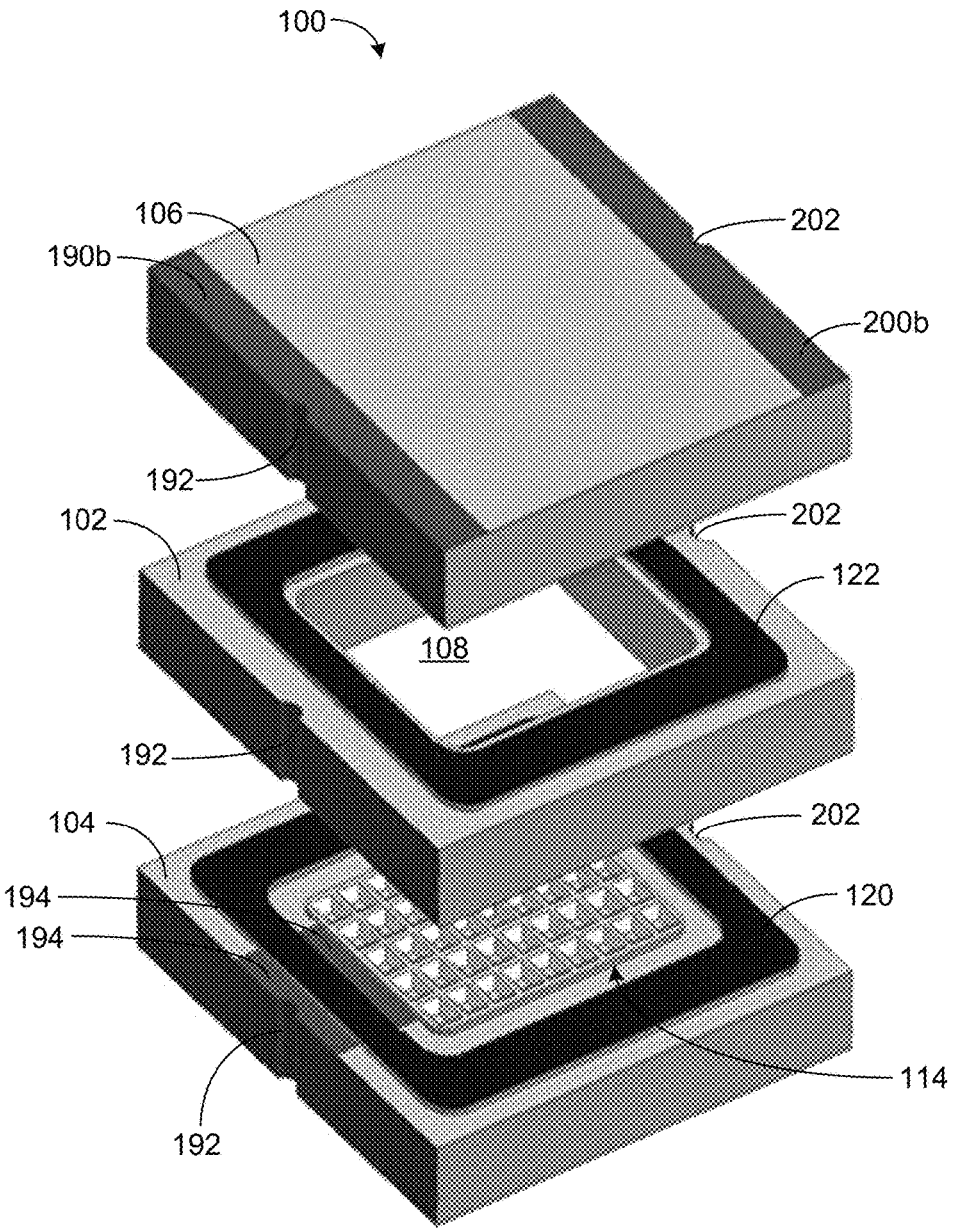
FIG. 8B shows an unassembled upper perspective view of the flat GDT of FIG. 8A.
Figure 8C:
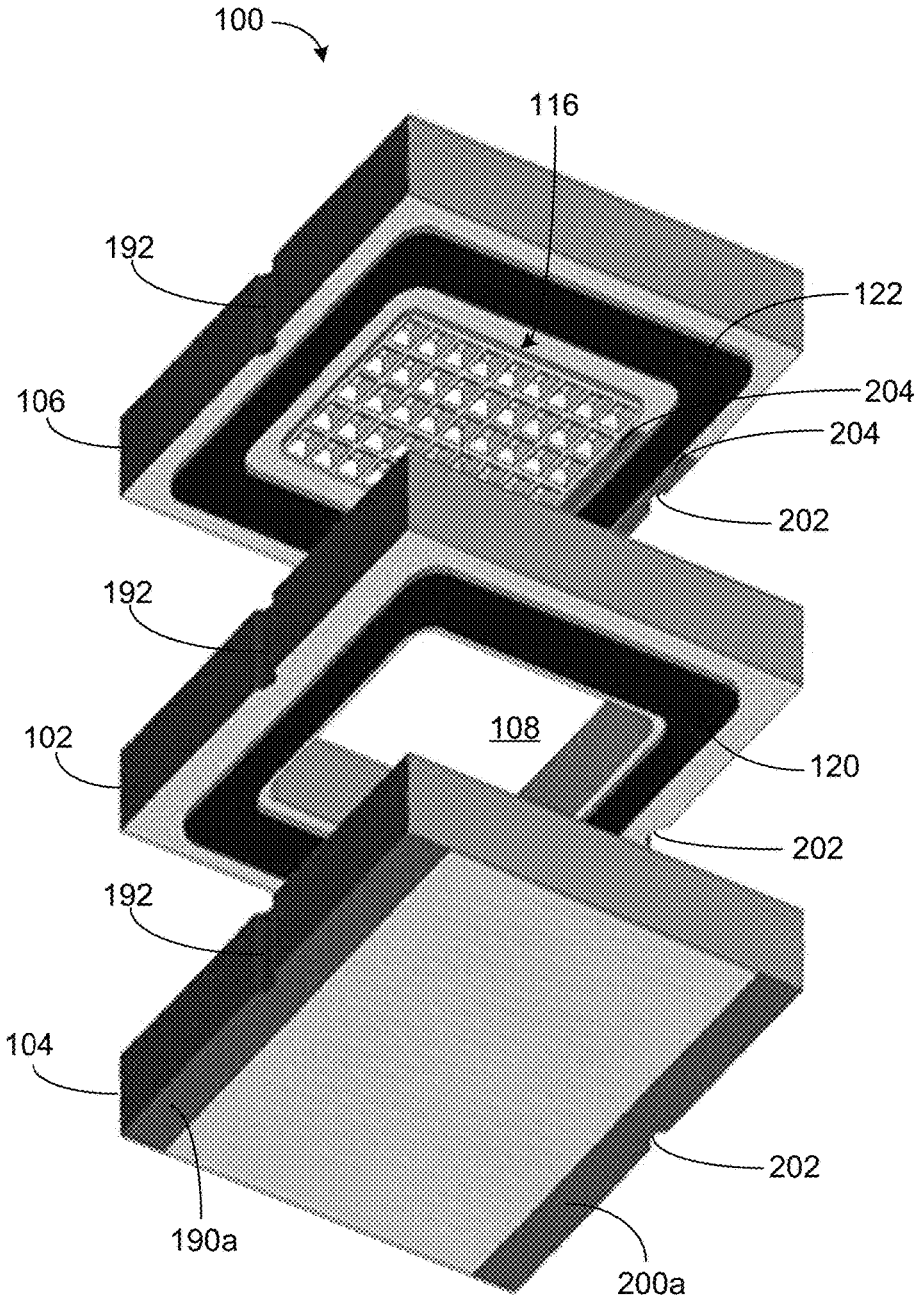
FIG. 8C shows an unassembled lower perspective view of the flat GDT of FIG. 8A.

Examples Related to Via-Less Flat GDTs:

FIGS. 7 and 8 show examples of flat GDTs in which electrical connections between electrodes and their respective terminals can be made without use of internal conductive vias. FIGS. 7A-7C show an example in which two terminals can be implemented on one side of a flat GDT. FIGS. 8A-8C show an example in which two terminals can be implemented on each of both sides of a flat GDT.

FIGS. 7A-7C show various views of an example flat GDT 100 having metalized traces for providing electrical connections between electrodes and external conductive features such as castellation vias which are in turn electrically connected to their respective terminals. FIG. 7A shows a side sectional view, FIG. 7B shows an unassembled upper perspective view, and FIG. 7C shows an unassembled lower perspective view. In the example of FIGS. 7A-7C, seals 120, 122 can be electrically conducting or electrically non-conductive as described herein. Such a flat GDT 100 of FIGS. 7A-7C can be a more specific example of the flat GDT 100 described herein in reference to FIG. 4.

In the example of FIGS. 7A-7C, lateral connections (194, 204 in FIG. 4) are depicted as metalized traces 194, 204. More particularly, the metalized trace 194 is shown to be implemented on the second insulator substrate 104 so as to electrically connect the electrode 114 to a castellation via 192 formed on the corresponding side of the flat GDT 100. The castellation via 192 is shown to be electrically connected to a terminal 190, such that the electrode 114 is electrically connected to the terminal 190. Similarly, the metalized trace 204 is shown to be implemented on the third insulator substrate 106 so as to electrically connect the electrode 116 to a castellation via 202 formed on the corresponding side of the flat GDT 100. The castellation via 202 is shown to be electrically connected to a terminal 200, such that the electrode 116 is electrically connected to the terminal 200.

In some embodiments, and referring to FIGS. 7A and 7B, the metalized trace 194 can be formed on the second insulator substrate 104. Some or all of the electrode 114 can be formed over a portion of the metallized trace 194, such that the metallized trace 194 provides an electrical connection between the electrode 114 and the castellation via 192. Similarly, a portion of the seal 120 can be formed over a portion of the metallized trace 194. If the seal 120 is electrically conductive, it can provide sealing functionality while being in electrical contact with the electrode 114 through the metallized trace 194, provided that the seal 120 is not in electrical contact with the castellation via 202. If the seal 120 is electrically non-conductive, it can provide sealing functionality without being in electrical contact with the electrode 114. In some embodiments, the metalized trace 194 can be formed with, for example, thick film molly manganese or thick film tungsten, plated with nickel or braze/solder material (e.g., copper-silver (CuSil) material) utilizing, for example, printing techniques.

Similarly, and referring to FIGS. 7A and 7C, the metalized trace 204 can be formed on the third insulator substrate 106. Some or all of the electrode 116 can be formed over a portion of the metallized trace 204, such that the metallized trace 204 provides an electrical connection between the electrode 116 and the castellation via 202. Similarly, a portion of the seal 122 can be formed over a portion of the metallized trace 204, provided that the seal 122 is not in electrical contact with the castellation via 192. If the seal 122 is electrically conductive, it can provide sealing functionality while being in electrical contact with the electrode 116 through the metallized trace 204. If the seal 122 is electrically non-conductive, it can provide sealing functionality without being in electrical contact with the electrode 116. In some embodiments, the metalized trace 204 can be formed with, for example, thick film molly manganese or thick film tungsten, plated with nickel or braze/solder material (e.g., copper-silver (CuSil) material) utilizing, for example, printing techniques.

In the example of FIGS. 7A-7C, the metalized trace (194 or 204) and its corresponding seal (120 or 122) are described as being formed as separate layers. It will be understood that in some embodiments, if the seals 120, 122 are electrically conductive, the metalized trace (194 or 204) and its corresponding conductive seal (120 or 122) can be patterned and formed together as a single conductive layer. It will also be understood that in some embodiments, if the seals 120, 122 are electrically conductive, the metalized trace (194 or 204) may be separated by an insulator layer such as glass, metal oxide or polymer such that the metalized trace does not make electrical contact with the corresponding conductive seal (120 or 122). With electrical isolation of the metalized trace (194 or 204) from the corresponding seal (120 or 122), some or all of the design benefits of using electrically non-conductive seals may be achieved as described herein.

In the example of FIGS. 7A-7C, each of the electrodes 114, 116 can be implemented as a simple metal layer, or can include features such as a waffle pattern. In some embodiments, an emissive coating can be printed on the electrodes. In some embodiments, pre-ionization lines and/or patterns can be formed on one or more of the insulator substrates to control breakdown parameters. Examples related to one or more of such features are described in greater detail in U.S. Publication No. 2014/0239804.

In the example of FIGS. 7A-7C, the flat GDT 100 has the terminals 190, 200 implemented on one side. Accordingly, such a flat GDT can be mounted with that side on, for example, a circuit board. In some applications, it may be desirable to be able to mount a flat GDT on either side.

FIGS. 8A-8C show an example of a flat GDT that are internally similar to the example of FIGS. 7A-7C, but have terminals on both of the upper and lower surfaces of the flat GDTs.

FIGS. 8A-8C show various views of an example flat GDT 100 that is internally similar to the example of FIGS. 7A-7C, but has terminals on both of the upper and lower surfaces of the flat GDT 100. FIG. 8A shows a side sectional view, FIG. 8B shows an unassembled upper perspective view, and FIG. 8C shows an unassembled lower perspective view. In the example of FIGS. 8A-8C, seals 120, 122 can be electrically conducting or electrically non-conductive as described herein. Such a flat GDT 100 of FIGS. 8A-8C can be a more specific example of the flat GDT 100 described herein in reference to FIG. 4.

In the example of FIGS. 8A-8C, the castellation via 192 (which is electrically connected to the electrode 114 through the metalized trace 194) is shown to be electrically connected to each of lower terminal 190*a* and upper terminal 190*b*. Similarly, the castellation via 202 (which is electrically connected to the electrode 116 through the metalized trace 204) is shown to be electrically connected to each of lower terminal 200*a* and upper terminal 200*b*. Accordingly, the flat GDT 100 can be mounted utilizing the lower terminals 190*a*, 200*a* or the upper terminals 190*b*, 200*b*.

In the examples of FIGS. 7 and 8, the metalized traces that extend laterally from their respective electrodes to the respective castellation vias can allow electrical connections to be made to the respective terminals without use of internal through-substrate vias. Accordingly, a given electrode can be implemented without a conductive via, thereby allowing maximized or larger dimensions of either or both electrodes for a given isolation path. Such an absence of conductive vias can allow the electrodes to be implemented with more flexibility (e.g., larger-area electrodes).

Figure 31:
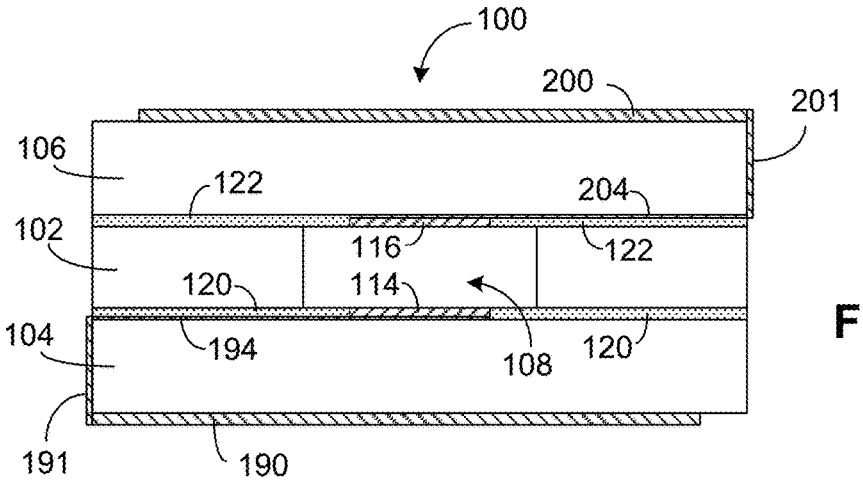
FIG. 31 shows a side sectional view of another example flat GDT one or more features as described herein.

Additional Examples of Flat GDTs:

FIGS. 31-33 show examples of flat GDTs in which electrical connections between electrodes and their respective terminals can be made with use of external conductive features such as conductive castellations, or with use of internal conductive vias. In the examples of FIGS. 31-33, one terminal can be implemented on each of both sides of a flat GDT.

FIGS. 31 and 33A-33C show various views of an example flat GDT 100 having metalized traces for providing electrical connections between electrodes and external conductive features such as castellation vias which are in turn electrically connected to their respective terminals. FIG. 31 shows a side sectional view of the flat GDT 100 having a first insulator substrate having a first side (e.g., a lower side as depicted in FIG. 31) and a second side (e.g., an upper side as depicted in FIG. 31). The example flat GDT 100 is shown to further include a second insulator substrate 104 implemented on the first side of the first insulator substrate 102, and a third insulator substrate 106 implemented on the second side of the first insulator substrate 102. In some embodiments, each of the first, second and third insulator substrates 102, 104, 106 can include, for example, ceramic such as alumina ceramic. Such alumina ceramic can provide one or more properties such as excellent electrical insulation, desirable mechanical properties, desirable thermal properties (e.g., high melting point), and desirable corrosion resistance.

Figure 32A:
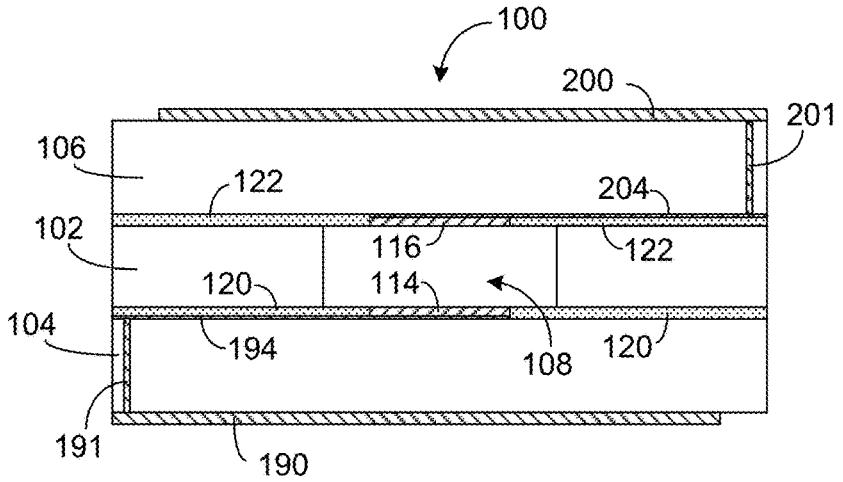
FIG. 32A shows an example flat GDT that is similar to the example GDT of FIG. 31.

FIG. 32A shows an example flat GDT 100 that is similar to the example GDT 100 of FIG. 31. However, the flat GDT 100 of FIG. 32A is shown to include internal conductive vias 191, 201 that provide electrical connections between the respective electrodes (114, 116, through lateral connections 194, 204) and terminals (190, 200). Accordingly, it will be understood that unassembled views of FIGS. 33B and 33C can be modified appropriately to include such internal conductive vias and remove the external conductive features such as castellation vias.

In the example of FIG. 32A, lateral connections 194, 204 such as conductive traces are utilized to electrically connect the respective electrodes 114, 116 to the conductive vias 191, 201. In some embodiments, electrical connections between the electrodes and the conductive vias can be made directly.

Figure 32B:
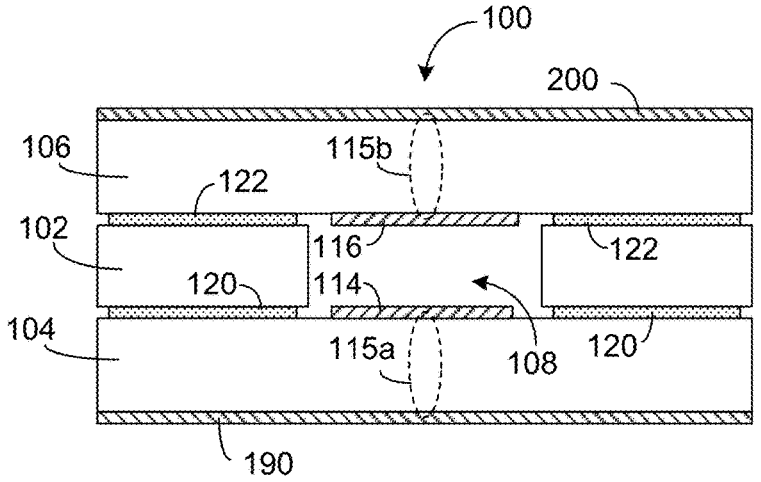
FIG. 32B shows another example flat GDT that is similar to the example GDT of FIG. 31.

For example, FIG. 32B shows a GDT 100 that is similar to the example GDT 100 of FIG. 32A. However, the flat GDT 100 of FIG. 32B is shown to include internal electrical connections 115*a*, 115*b* that can provide direct electrical connections between the respective electrodes 114, 116 and terminals 190, 200. Such internal electrical connections (115*a*, 115*b*) can be, for example conductive vias. In some embodiments, the example configuration of FIG. 32B can be particularly useful when a stack configuration is desired, in which a plurality of chambers are arranged in a stack. Examples related to such a stack configuration are described herein in greater detail.

In some applications, use of such internal conductive vias can allow the metallized through-insulator connections to be left substantially complete and not divided during a singulation process. Such substantially complete internal conductive vias can allow maintenance of electrical conductivity between the electrodes and their respective terminals.

It will also be understood that in some embodiments, a flat GDT having one or more features as described in reference to FIGS. 31-33 can include one or more external conductive features such as castellation vias, and one or more internal conductive vias.

Figure 33A:
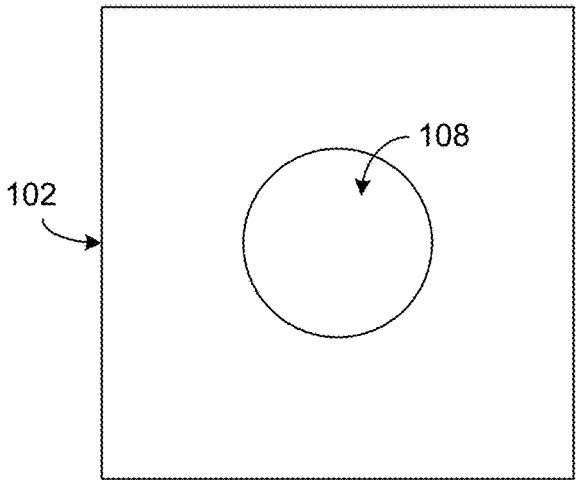
FIG. 33A shows an unassembled plan view of a first insulator substrate that can be utilized for the flat GDT of FIG. 31.
Figure 33B:
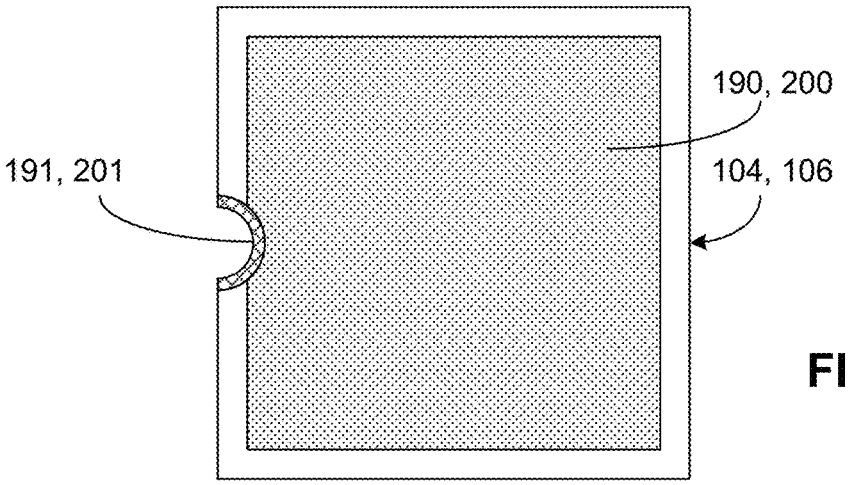
FIG. 33B shows an unassembled plan view of a terminal side of an insulator substrate that can be utilized as a second insulator substrate and/or a third insulator substrate of the flat GDT of FIG. 31.
Figure 33C:
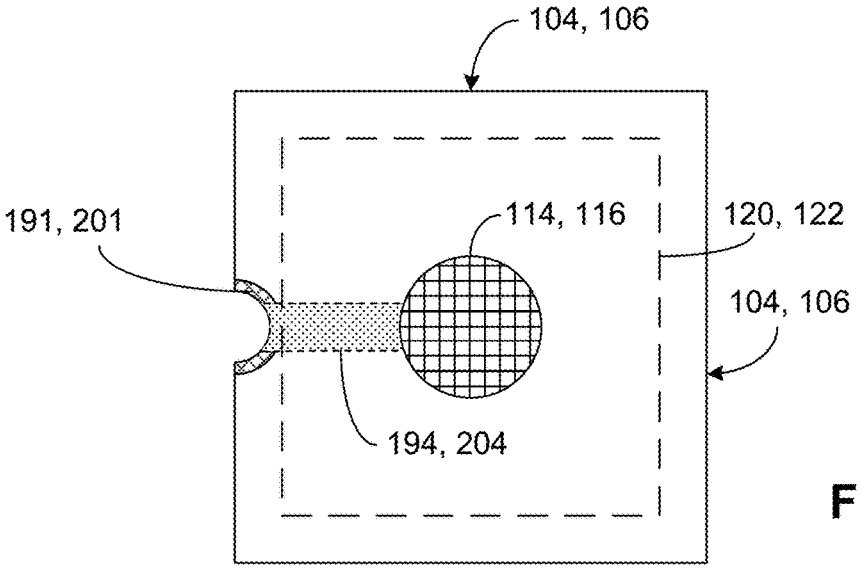
FIG. 33C shows an unassembled plan view of an electrode side of the insulator substrate of FIG. 33B.

FIG. 33A shows an unassembled plan view of the first insulator substrate 102, and FIGS. 33B and 33C show unassembled plan views of a terminal side (FIG. 33B) and an electrode side (FIG. 33C) of an insulator substrate (104, 106) that can be utilized as the second insulator substrate 104 and/or the third insulator substrate 106 of the example flat GDT of FIG. 31. As described herein, appropriate modifications can be made to the example of FIGS. 33B and 33C to yield an example flat GDT of FIG. 32 in which internal conductive vias (191, 201) are utilized instead of the external conductive castellations (191, 201) of FIG. 31.

Referring to FIGS. 31 and 33A-33C, the first insulator substrate 102 can include an opening 108 dimensioned to allow formation of a sealed volume with first and second electrodes 114, 116 implemented on opposing sides of the sealed volume. The first electrode 114 is shown to be electrically connected to a first terminal 190 on the first side of the flat GDT 100 through a lateral connection (e.g., a metalized trace) 194 and an external connection (e.g., a conductive castellation) 191 of FIG. 31 or an internal connection (e.g., a conductive via) 191 of FIG. 32. Similarly, the second electrode 116 is shown to be electrically connected to a second terminal 200 on the second side of the flat GDT 100 through a lateral connection (e.g., a metalized trace) 204 and an external connection (e.g., a conductive castellation) 201 of FIG. 31 or an internal connection (e.g., a conductive via) 201 of FIG. 32.

Referring to FIGS. 31-33, a seal 120 can be implemented between the first insulator substrate 102 and the second insulator substrate 104. Similarly, a seal 122 can be implemented between the first insulator substrate 102 and the third insulator substrate 106. In some embodiments, the seals 120, 122 can be electrically conducting or electrically non-conductive as described herein.

In the example of FIGS. 31-33, the first insulator substrate 102 can be generally symmetric with respect to the second and third insulator substrates 104, 106. Further, each of the second and third insulator substrates 104, 106 can be implemented with a common insulator substrate having an electrode, a lateral conductive trace, a seal, and a conductive castellation. Examples of how flat GDTs can be fabricated utilizing such a common insulator substrate are described in reference to FIGS. 34-38.

In the example of FIGS. 31-33, the lateral connections are depicted as metalized traces 194, 204. More particularly, the metalized trace 194 is shown to be implemented on the second insulator substrate 104 so as to electrically connect the first electrode 114 to the conductive castellation 191 formed on the corresponding side of the flat GDT 100 of FIG. 31 or the conductive via 191 of the flat GDT of FIG. 32. The conductive castellation 191 is shown to be electrically connected to the first terminal 190, such that the first electrode 114 is electrically connected to the first terminal 190 on the first side of the flat GDT 100.

Similarly, the metalized trace 204 is shown to be implemented on the third insulator substrate 106 so as to electrically connect the second electrode 116 to the conductive castellation 201 formed on the corresponding side of the flat GDT 100 of FIG. 31 or the conductive via 201 of the flat GDT of FIG. 32. The conductive castellation 201 is shown to be electrically connected to the second terminal 200, such that the second electrode 116 is electrically connected to the second terminal 200 on the second side of the flat GDT 100.

In some embodiments, and referring to FIGS. 31-33, the metalized trace 194 can be formed on the second insulator substrate 104. Some or all of the first electrode 114 can be formed over a portion of the metallized trace 194, such that the metallized trace 194 provides an electrical connection between the first electrode 114 and the conductive castellation 191 of FIG. 31 or the conductive via 191 of FIG. 32. In some embodiments, the seal 120 can be formed over the metallized trace 194. If the seal 120 is electrically non-conductive, it can provide sealing functionality without being electrically connected with the first electrode 114.

Similarly, the metalized trace 204 can be formed on the third insulator substrate 106. Some or all of the second electrode 116 can be formed over a portion of the metallized trace 204, such that the metallized trace 204 provides an electrical connection between the second electrode 116 and the conductive castellation 201 of FIG. 31 or the conductive via 201 of FIG. 32. In some embodiments, the seal 122 can be formed over the metallized trace 204. If the seal 122 is electrically non-conductive, it can provide sealing functionality without being electrically connected with the second electrode 116.

In the example of FIGS. 31-33, each of the electrodes 114, 116 can be implemented as a simple metal layer, or can include features such as a waffle pattern. In some embodiments, an emissive coating can be printed on the electrodes. In some embodiments, pre-ionization lines and/or patterns can be formed on one or more of the insulator substrates and/or surfaces associated with the sealed volume 108 to control breakdown parameters.

In the example of FIGS. 31-33, the flat GDT 100 has the terminals 190, 200 implemented on opposing sides of the flat GDT 100. Accordingly, such a flat GDT can be utilized in series with an electrical component and provide a relatively large solderable terminal. For example, a flat metal oxide varistor (MOV) can be implemented as a flat device, and a flat GDT 100 having one or more features as described in reference to FIGS. 31-33 can be soldered onto each of either or both sides of such a flat MOV device to yield one or more large solderable terminal provided by the flat GDT(s) 100.

Examples of Fabrication Processes:

FIGS. 9-29 and 34-38 show examples of processes that can be utilized to fabricate the various flat GDTs described herein in reference to FIGS. 1-8, and 31-33. In the process examples described herein, some or substantially all of various steps can be implemented on insulator plates having an array of units corresponding to insulator substrates. Such units can be separated so as to yield a plurality of individual units which can be in substantially final form or be processed further. Each of such completed form of individual units can then become a flat GDT having one or more features as described herein.

Figure 9A:
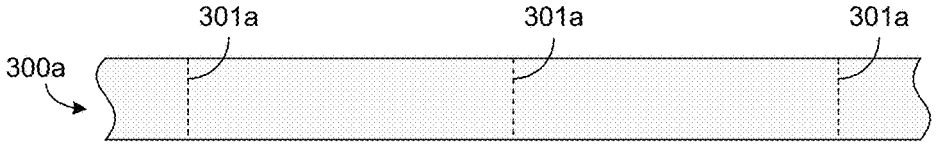
FIGS. 9A and 9B show an example of how a first insulator plate can be processed to be utilized for the examples of FIGS. 2 and 5.
Figure 9B:
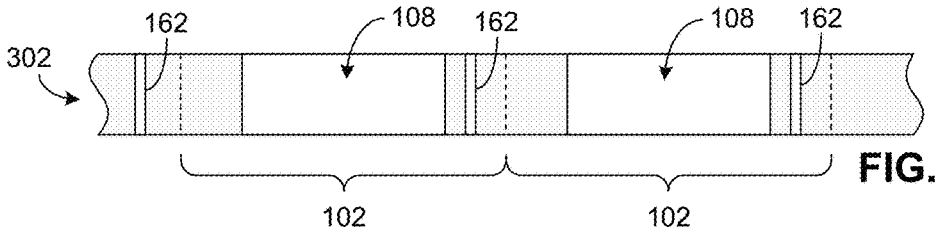

FIGS. 9A and 9B show an example of how a first insulator plate 300*a*, having an array of individual units generally defined by boundaries 301*a*, can be processed to form an array of chamber holes 108 and an array of through-substrate vias 162, so as to yield a partially processed first insulator plate 302. When singulated into individual units, each unit can be utilized as the first insulator substrate 102 described herein in reference to FIGS. 2 and 5.

In the example of FIGS. 9A and 9B, the chamber holes 108 and the through-substrate vias 162 can be formed utilizing, for example, a laser and/or other hole-formation techniques.

Figure 10A:
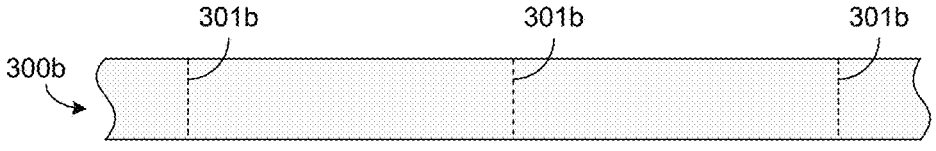
FIGS. 10A and 10B show an example of how a second insulator plate can be processed to be utilized for the examples of FIGS. 2 and 5.
Figure 10B:
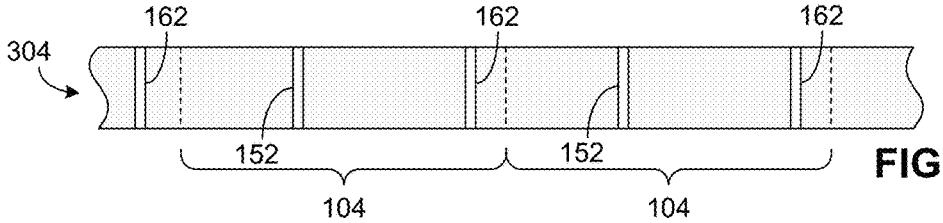

FIGS. 10A and 10B show an example of how a second insulator plate 300*b*, having an array of individual units generally defined by boundaries 301*b*, can be processed to form an array of through-substrate vias 152 and an array of through-substrate vias 162, so as to yield a partially processed second insulator plate 304. When singulated into individual units, each unit can be utilized as the second insulator substrate 104 described herein in reference to FIGS. 2 and 5.

In the example of FIGS. 10A and 10B, the through-substrate vias 152 and the through-substrate vias 162 can be formed utilizing, for example, a laser and/or other hole-formation techniques.

Figure 11A:
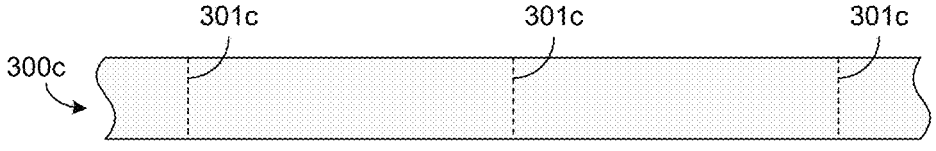
FIGS. 11A and 11B show an example of how a third insulator plate can be processed to be utilized for the examples of FIGS. 2 and 5.
Figure 11B:
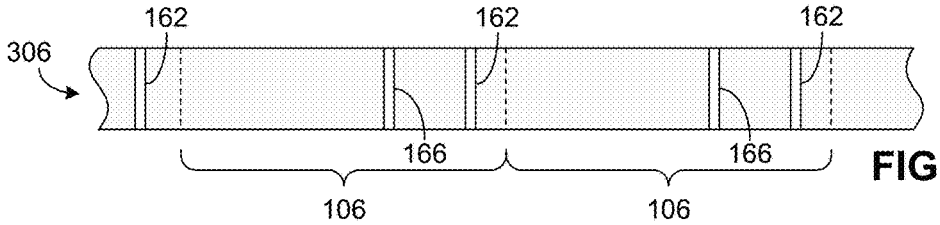

FIGS. 11A and 11B show an example of how a third insulator plate 300*c*, having an array of individual units generally defined by boundaries 301*c*, can be processed to form an array of through-substrate vias 166 an array of through-substrate vias 162, so as to yield a partially processed third insulator plate 306. When singulated into individual units, each unit can be utilized as the third insulator substrate 106 described herein in reference to FIGS. 2 and 5.

In the example of FIGS. 11A and 11B, the through-substrate vias 166 and the through-substrate vias 162 can be formed utilizing, for example, a laser and/or other hole-formation techniques.

Figure 12A:
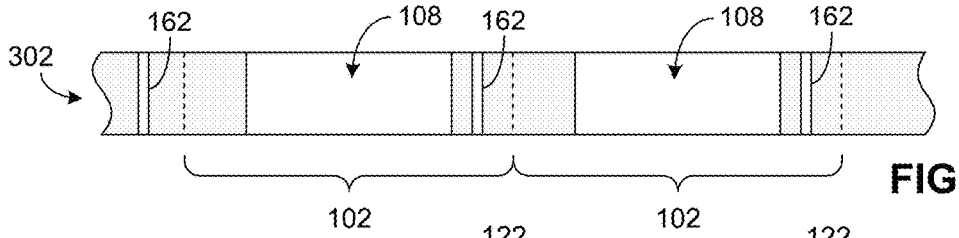
FIGS. 12A and 12B show an example of how the first insulator plate of FIG. 9B can be further processed.
Figure 12B:
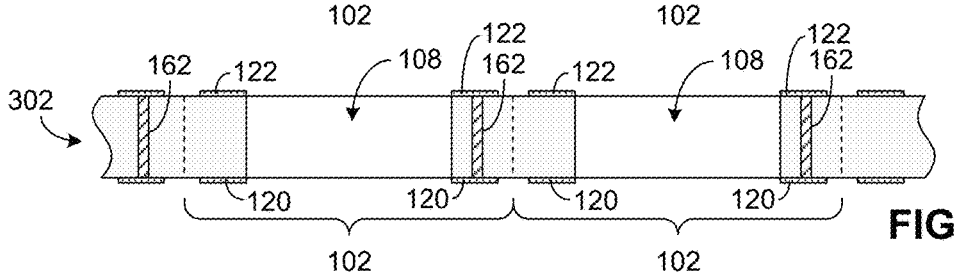

FIG. 12A shows the partially processed first insulator plate 302 of FIG. 9B. FIG. 12B shows that such an insulator plate can be further processed to fill the vias 162 with conductive material, and to form seal rings 120, 122 on both sides of the partially processed first insulator plate 302. For example, the vias 162 can be filled with conductive metal utilizing vacuum to draw the conductive metal into the vias 162. The seal rings 120, 122 can be formed by, for example, printing. Upon formation of the foregoing filled vias and seal rings, the assembly can be dried and fired prior to further processing.

As described herein, the seal rings 120, 122 can be electrically conductive or electrically non-conductive. If the seal rings 120, 122 are conductive, such rings can facilitate electrical connections of the conductive vias 162 with their corresponding vias in the second and third insulator plates 304, 306. If the seal rings 120, 122 are non-conductive (e.g., an insulator such as glass or epoxy), appropriate sized openings can be formed in the seal rings 120, 122 (e.g., circular openings formed during a printing process) to allow formation of electrical connections between the conductive vias of different insulator plates. For example, such opening in the seal rings 120, 122 can be selectively filled and/or plated with conductive material (e.g., solder, braze or conductive epoxy) (e.g., copper-silver (CuSil) material). Such conductive material in the openings in the seal rings 120, 122 can melt, fuse or cure during a sealing process to yield an electrical connection between two end-to-end adjacent filled conductive vias. In some embodiments, one or more drying and firing processes can be performed during and/or after the foregoing formations of the filled vias and the seal rings. Such drying and firing process(es) can be performed prior to further processing of the insulator plate 302.

Figure 13A:
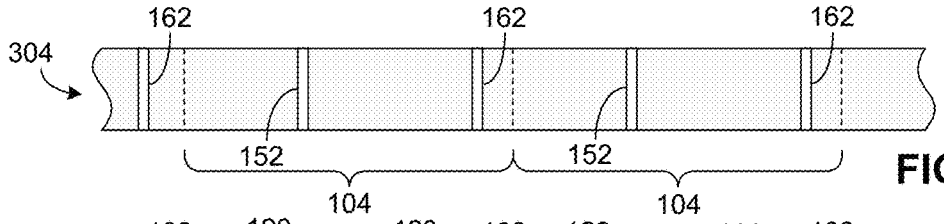
FIGS. 13A and 13B show an example of how the second insulator plate of FIG. 10B can be further processed.
Figure 13B:
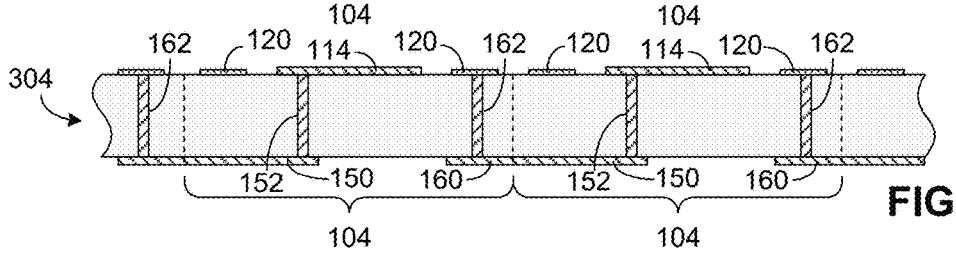

FIG. 13A shows the partially processed second insulator plate 304 of FIG. 10B. FIG. 13B shows that such an insulator plate can be further processed to fill the vias 152 and the vias 162 with conductive material, and to form seal rings 120 on the upper side of the partially processed second insulator plate 304. For example, the vias 152, 162 can be filled with conductive metal utilizing vacuum to draw the conductive metal into the vias 152, 162. The seal rings 120 can be formed by, for example, printing.

In the example of FIG. 13B, formation of the seal rings 120 and the vias 162 can be implemented as described in reference to FIG. 12B to accommodate electrically conductive and electrically non-conductive seal rings.

In the example of FIG. 13B, electrodes 114 can be formed on the upper side of the partially processed second insulator plate 304, and terminals 150, 160 can be formed on the lower side of the partially processed second insulator plate 304. Since both of the electrode 114 and the terminal 150 (for a given unit) are both conductive, they can be formed directly over the filled conductive vias 152. In the example shown, a single conductive layer is shown to be formed for terminals 150, 160 of neighboring units, such that when singulated, each becomes a terminal of the corresponding individual unit. It will be understood that such neighboring terminals can also be patterned and formed separately.

In some embodiments, one or more drying and firing processes can be performed during and/or after the foregoing formations of the filled vias, the seal rings, the electrodes, and the terminals. Such drying and firing process(es) can be performed prior to further processing of the insulator plate 304.

Figure 14A:
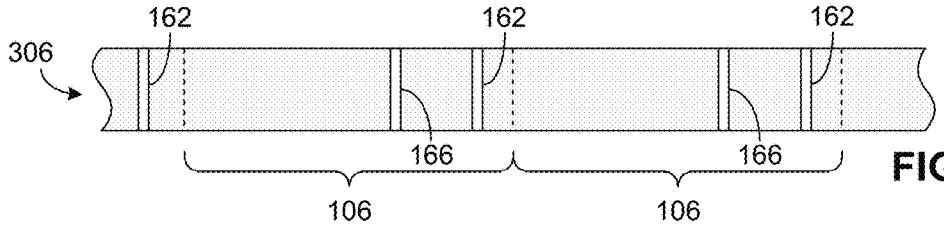
FIGS. 14A and 14B show an example of how the third insulator plate of FIG. 11B can be further processed.
Figure 14B:
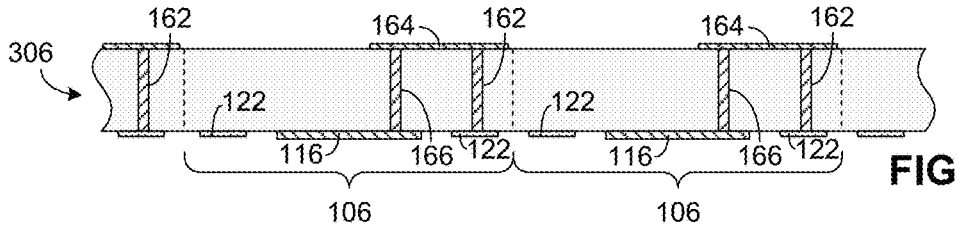

FIG. 14A shows the partially processed third insulator plate 306 of FIG. 11B. FIG. 14B shows that such an insulator plate can be further processed to fill the vias 166 and the vias 162 with conductive material, and to form seal rings 122 on the lower side of the partially processed third insulator plate 306. For example, the vias 166, 162 can be filled with conductive metal utilizing vacuum to draw the conductive metal into the vias 166, 162. The seal rings 122 can be formed by, for example, printing.

In the example of FIG. 14B, formation of the seal rings 120 and the vias 162 can be implemented as described in reference to FIG. 12B to accommodate electrically conductive and electrically non-conductive seal rings.

In the example of FIG. 14B, electrodes 116 can be formed on the lower side of the partially processed third insulator plate 306, and connector traces 164 can be formed on the upper side of the partially processed third insulator plate 306. Since both of the electrode 116 and the connector trace 164 (for a given unit) are both conductive, they can be formed directly over the filled conductive vias 166. Similarly, the connector trace 164 can be formed directly over the filled conductive via 162.

In some embodiments, one or more drying and firing processes can be performed during and/or after the foregoing formations of the filled vias, the seal rings, the electrodes, and the connector traces. Such drying and firing process(es) can be performed prior to further processing of the insulator plate 306.

In some embodiments, the insulator plates 302, 304, 306 can then be plated to cover the metalized areas. Such plating can include, for example, nickel and optionally selective copper.

Figure 15A:
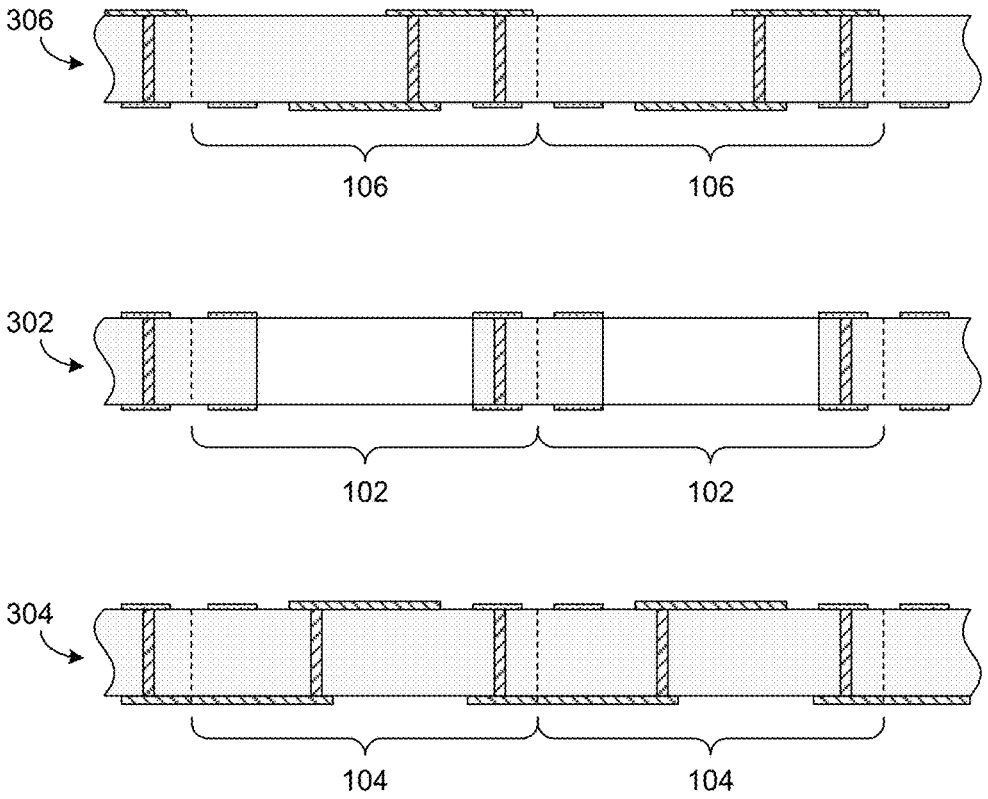
FIGS. 15A-15D show examples of how processed insulator plates can be stacked and further processed to yield a plurality of individual flat GDTs.

FIGS. 15A-15D show examples of how the processed insulator plates 302, 304, 306 of FIGS. 12B, 13B, 14B, respectively, can be stacked and further processed to yield a plurality of individual flat GDTs having one or more features as described herein. In FIG. 15A, a stack can be formed by positioning the first insulator plate 302 over the second insulator plate 304, and then the third insulator plate 306 over the first insulator plate 302. In some embodiments, a stacking apparatus can be utilized to ensure sufficient accuracy in alignment of the individual units of the three insulator plates. Such alignment can include, for example, alignment of the vias 162 that will provide electrical connections through all three insulator plates.

Figure 15B:
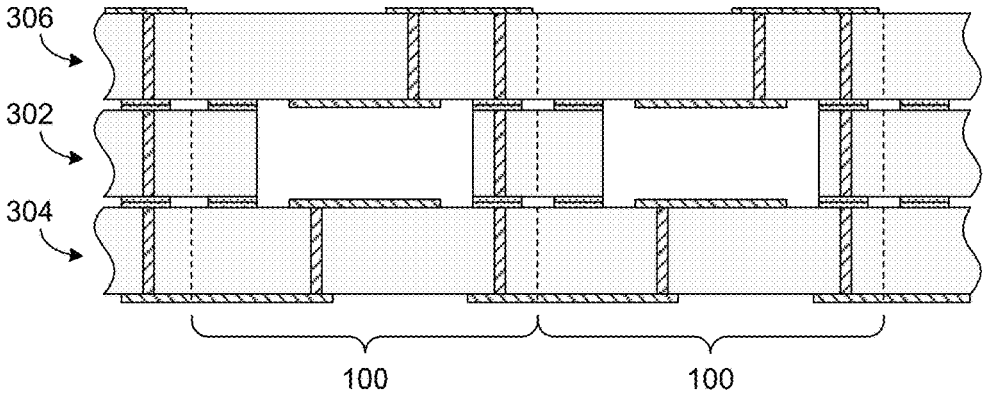

FIG. 15B shows the three insulator layers 304, 302, 306 stacked and aligned so as to define an array of what will become individual flat GDTs 100. Such a stacked assembly can be cured so as to form an array of flat GDTs 100, with each having a sealed chamber filled with desired gas. For example, the stacked assembly can be placed in a furnace, and air can be replaced with a desired gas mixture. Then, temperature can be raised to a point where the seal ring layers between the insulator plates melt or cure to thereby substantially seal the respective chambers filled with the desired gas mixture.

Figure 15C:
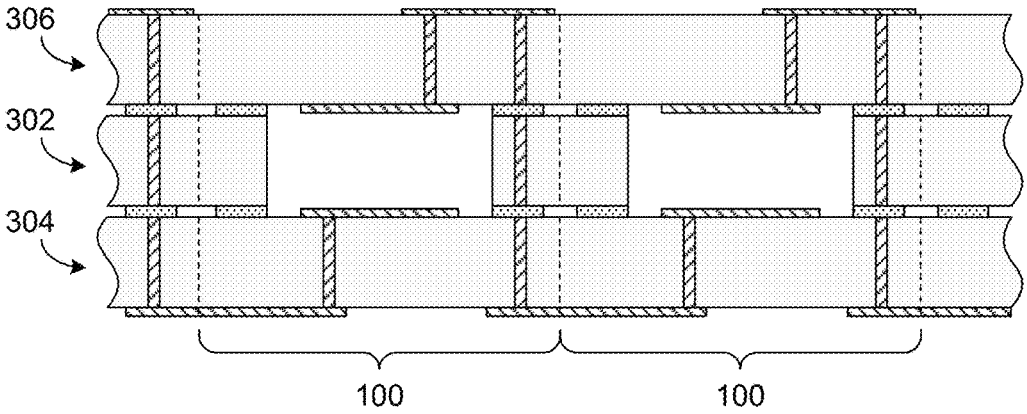

FIG. 15C shows an example of such an assembly of insulator plates where the chambers are substantially sealed by the seal rings between a pair of insulator plates. In some embodiments, the sealed assembly of insulator plates can be removed from the furnace, and have plating formed on, for example, exposed terminals and metal features (e.g., connector trace 164 and any exposed vias). Such plating can include, for example, tin or other solderable material. In some embodiments, the sealed assembly of insulator plates can optionally be conditioned and tested to meet a desired performance level while in an array of devices.

Figure 15D:
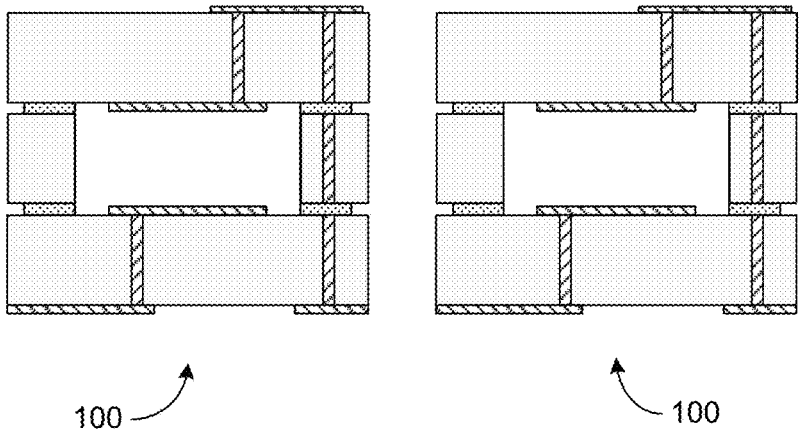

FIG. 15D shows an example where the assembly of insulator plates resulting from the processing step(s) of FIG. 15C can be singulated to yield a plurality of individual flat GDTs 100. Such singulation can be achieved by, for example, cutting, sawing, etc. In some embodiments, two or more flat GDTs 100 can be left in mechanical and optionally, in electrical connection, creating arrayed GDT devices.

In some embodiments, each of the singulated flat GDTs 100 can optionally be plated with, for example, tin or other solderable material, and then if not already done, conditioned and tested to meet a desired performance level. Such completed product can then be either packaged or implemented in another apparatus such as a circuit board.

Figure 16A:
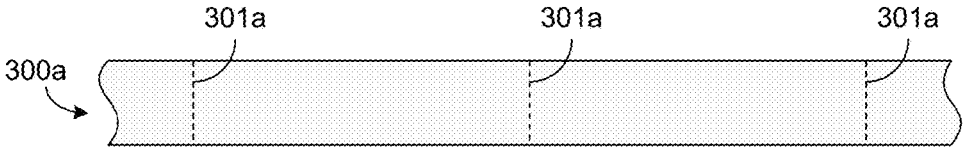
FIGS. 16A and 16B show an example of how a first insulator plate can be processed to be utilized for the examples of FIGS. 3 and 6.
Figure 16B:
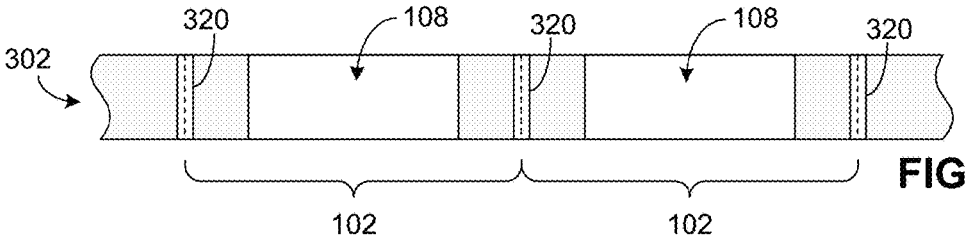

FIGS. 16A and 16B show an example of how a first insulator plate 300*a*, having an array of individual units generally defined by boundaries 301*a*, can be processed to form an array of chamber holes 108 and an array of castellation vias 320, so as to yield a partially process first insulator plate 302. When singulated into individual units, each unit can be utilized as the first insulator substrate 102 described herein in reference to FIGS. 3 and 6.

In the example of FIGS. 16A and 16B, the chamber holes 108 and the castellation vias 320 can be formed utilizing, for example, a laser and/or other hole-formation techniques.

Figure 17A:
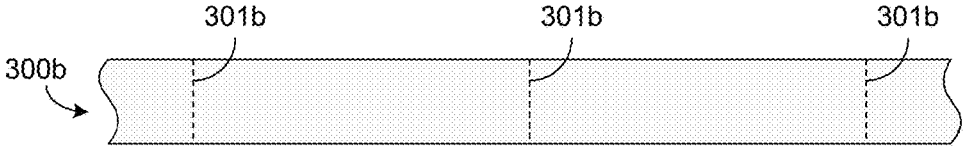
FIGS. 17A and 17B show an example of how a second insulator plate can be processed to be utilized for the examples of FIGS. 3 and 6.
Figure 17B:
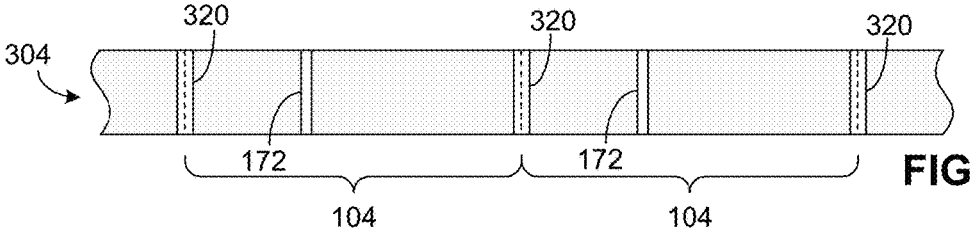

FIGS. 17A and 17B show an example of how a second insulator plate 300*b*, having an array of individual units generally defined by boundaries 301*b*, can be processed to form an array of through-substrate vias 172 and an array of castellation vias 320, so as to yield a partially process second insulator plate 304. When singulated into individual units, each unit can be utilized as the second insulator substrate 104 described herein in reference to FIGS. 3 and 6.

In the example of FIGS. 17A and 17B, the through-substrate vias 172 and the castellation vias 320 can be formed utilizing, for example, a laser and/or other hole-formation techniques.

Figure 18A:
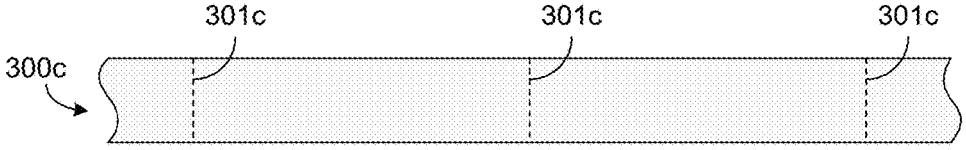
FIGS. 18A and 18B show an example of how a third insulator plate can be processed to be utilized for the examples of FIGS. 3 and 6.
Figure 18B:
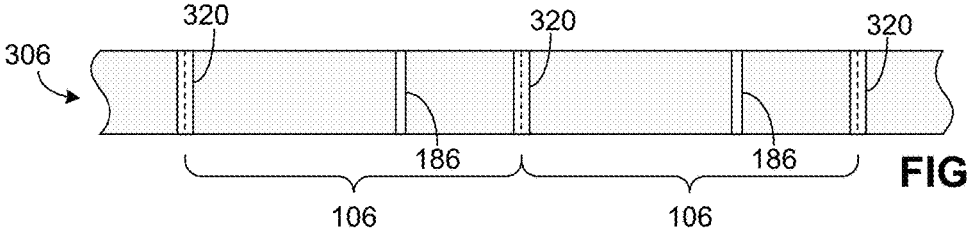

FIGS. 18A and 18B show an example of how a third insulator plate 300*c*, having an array of individual units generally defined by boundaries 301*c*, can be processed to form an array of through-substrate vias 186 and an array of castellation vias 320, so as to yield a partially process third insulator plate 306. When singulated into individual units, each unit can be utilized as the third insulator substrate 106 described herein in reference to FIGS. 3 and 6.

In the example of FIGS. 18A and 18B, the through-substrate vias 186 and the castellation vias 320 can be formed utilizing, for example, a laser and/or other hole-formation techniques.

Figure 19A:
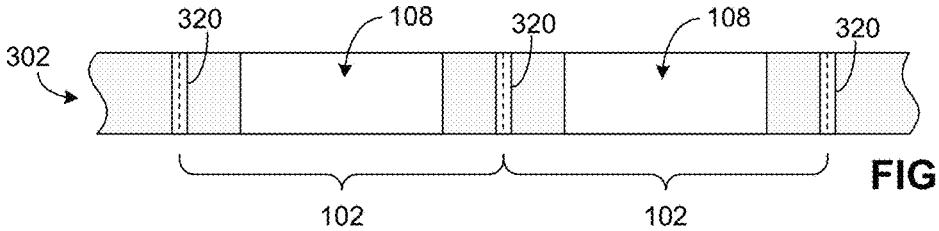
FIGS. 19A and 19B show an example of how the first insulator plate of FIG. 16B can be further processed.
Figure 19B:
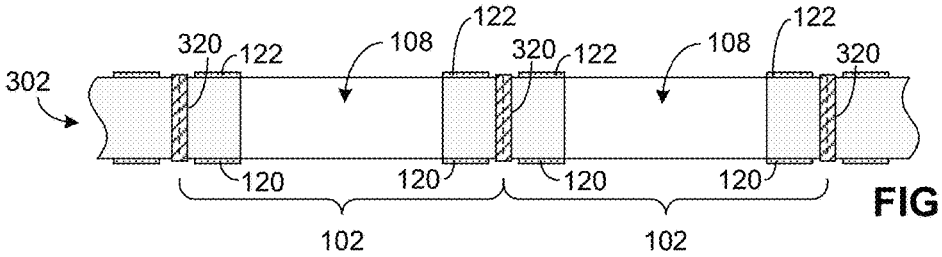

FIG. 19A shows the partially processed first insulator plate 302 of FIG. 16B. FIG. 19B shows that such an insulator plate can be further processed to fill the castellation vias 320 with conductive material, and to form seal rings 120, 122 on both sides of the partially processed first insulator plate 302. For example, the castellation vias 320 can be filled with conductive metal utilizing vacuum to draw the conductive metal into the vias 320. In some embodiments, such filled castellation vias can extend beyond the surface levels, or additional conductive material can be introduced at the ends of such vias, to allow joining with corresponding castellation vias when stacked with another insulator plate. The seal rings 120, 122 can be formed by, for example, printing. As described herein, the seal rings 120, 122 can be electrically conductive or electrically non-conductive. Upon formation of the foregoing filled vias and seal rings, the assembly can be dried and fired prior to further processing.

Figure 20A:
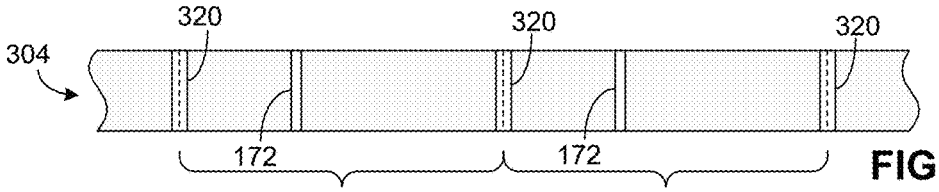
FIGS. 20A and 20B show an example of how the second insulator plate of FIG. 17B can be further processed.
Figure 20B:
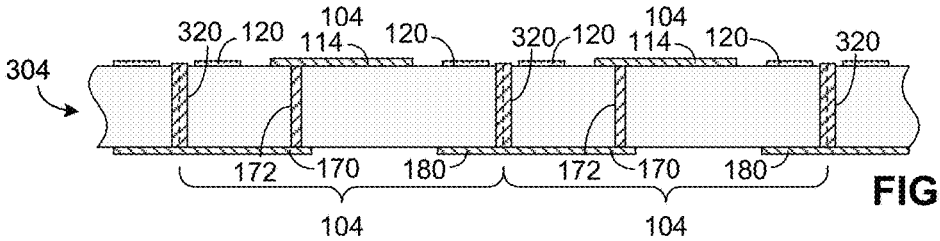

FIG. 20A shows the partially processed second insulator plate 304 of FIG. 17B. FIG. 20B shows that such an insulator plate can be further processed to fill the vias 172 and the castellation vias 320 with conductive material, and to form seal rings 120 on the upper side of the partially processed second insulator plate 304. For example, the vias 172, 320 can be filled with conductive metal utilizing vacuum to draw the conductive metal into the vias 172, 320. In some embodiments, such filled castellation vias can extend beyond the surface levels, or additional conductive material can be introduced at the ends of such vias, to allow joining with corresponding castellation vias when stacked with another insulator plate. The seal rings 120 can be formed by, for example, printing. As described herein, the seal rings 120 can be electrically conductive or electrically non-conductive.

In the example of FIG. 20B, electrodes 114 can be formed on the upper side of the partially processed second insulator plate 304, and terminals 170, 180 can be formed on the lower side of the partially processed second insulator plate 304. Since both of the electrode 114 and the terminal 170 (for a given unit) are both conductive, they can be formed directly over respective ends of the filled conductive vias 172. In the example shown, a single conductive layer is shown to be formed for terminals 170, 180 of neighboring units, such that when singulated, each becomes a terminal of the corresponding individual unit. It will be understood that such neighboring terminals can also be patterned and formed separately.

In some embodiments, one or more drying and firing processes can be performed during and/or after the foregoing formations of the filled vias, the seal rings, the electrodes, and the terminals. Such drying and firing process(es) can be performed prior to further processing of the insulator plate 304.

Figure 21A:
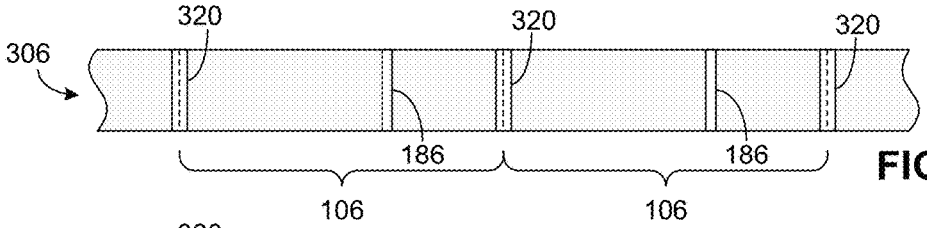
FIGS. 21A and 21B show an example of how the third insulator plate of FIG. 18B can be further processed.
Figure 21B:
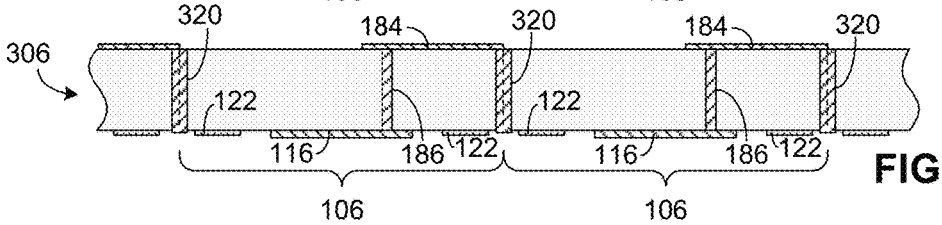

FIG. 21A shows the partially processed third insulator plate 306 of FIG. 18B. FIG. 21B shows that such an insulator plate can be further processed to fill the vias 186 and the castellation vias 320 with conductive material, and to form seal rings 122 on the lower side of the partially processed third insulator plate 306. For example, the vias 186, 320 can be filled with conductive metal utilizing vacuum to draw the conductive metal into the vias 186, 320. In some embodiments, such filled castellation vias can extend beyond the surface levels, or additional conductive material can be introduced at the ends of such vias, to allow joining with corresponding castellation vias when stacked with another insulator plate. The seal rings 122 can be formed by, for example, printing. As described herein, the seal rings 122 can be electrically conductive or electrically non-conductive.

In the example of FIG. 21B, electrodes 116 can be formed on the lower side of the partially processed third insulator plate 306, and connector traces 184 can be formed on the upper side of the partially processed third insulator plate 306. Since both of the electrode 116 and the connector trace 164 (for a given unit) are both conductive, they can be formed directly over respective ends of the filled conductive vias 186. Similarly, the connector trace 164 can be formed directly over the filled castellation via 320.

In some embodiments, one or more drying and firing processes can be performed during and/or after the foregoing formations of the filled vias, the seal rings, the electrodes, and the connector traces. Such drying and firing process(es) can be performed prior to further processing of the insulator plate 306.

In some embodiments, the insulator plates 302, 304, 306 can then be plated to cover the metalized areas. Such plating can include, for example, nickel and optionally selective copper.

Figure 22A:
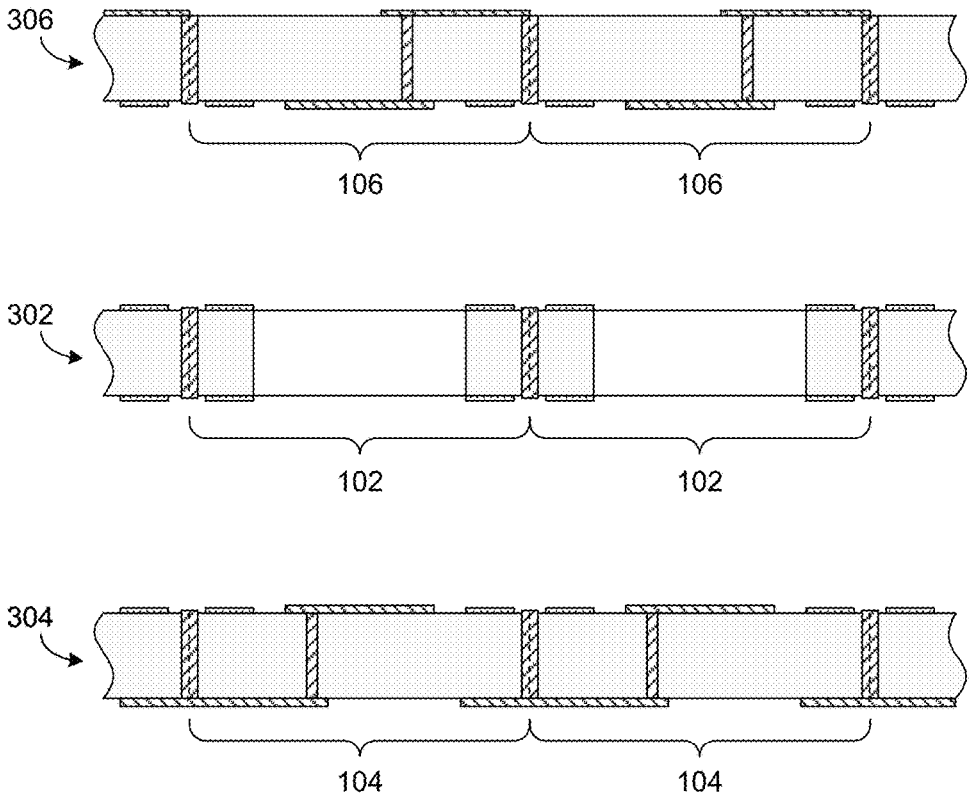
FIGS. 22A-22D show examples of how processed insulator plates can be stacked and further processed to yield a plurality of individual flat GDTs.

FIGS. 22A-22D show examples of how the processed insulator plates 302, 304, 306 of FIGS. 19B, 20B, 21B, respectively, can be stacked and further processed to yield a plurality of individual flat GDTs having one or more features as described herein. In FIG. 22A, a stack can be formed by positioning the first insulator plate 302 over the second insulator plate 304, and then the third insulator plate 306 over the first insulator plate 302. In some embodiments, a stacking apparatus can be utilized to ensure sufficient accuracy in alignment of the individual units of the three insulator plates. Such alignment can include, for example, alignment of the castellation vias 320 that will provide external electrical connections.

Figure 22B:
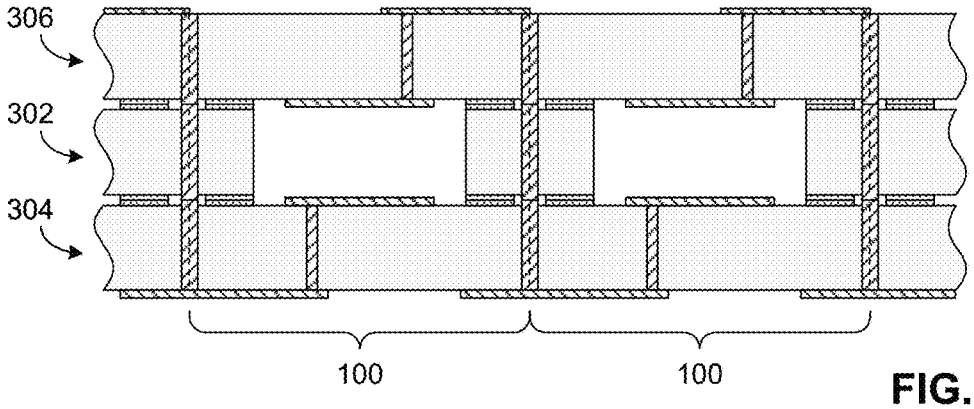

FIG. 22B shows the three insulator layers 304, 302, 306 stacked and aligned so as to define an array of what will become individual flat GDTs 100. Such a stacked assembly can be cured so as to form an array of flat GDTs 100, with each having a sealed chamber filled with desired gas. For example, the stacked assembly can be placed in a furnace, and air can be replaced with a desired gas mixture. Then, temperature can be raised to a point where the seal ring layers between the insulator plates melt or cure to thereby substantially seal the respective chambers filled with the desired gas mixture.

Figure 22C:
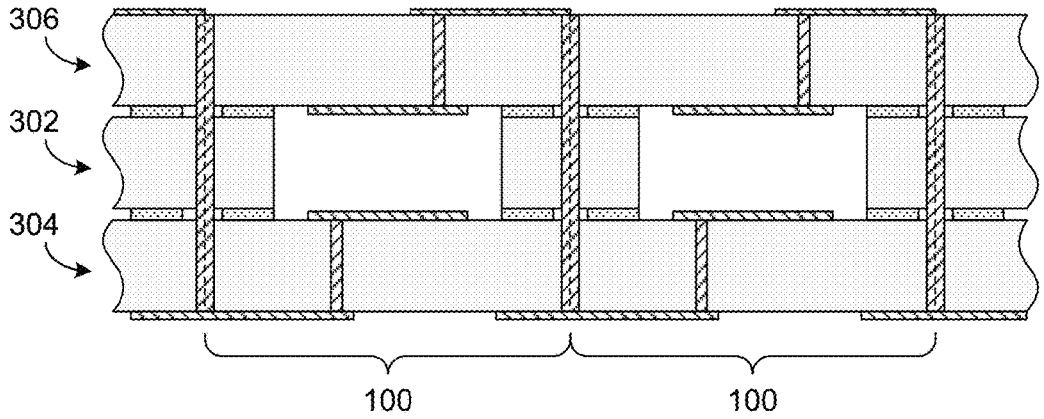

FIG. 22C shows an example of such an assembly of insulator plates where the chambers are substantially sealed by the seal rings between a pair of insulator plates. In some embodiments, the sealed assembly of insulator plates can be removed from the furnace, and have plating formed on, for example, exposed terminals and metal features (e.g., connector trace 164 and any exposed vias). Such plating can include, for example, tin or other solderable material. In some embodiments, the sealed assembly of insulator plates can optionally be conditioned and tested to meet a desired performance level while in an array of devices.

Figure 22D:
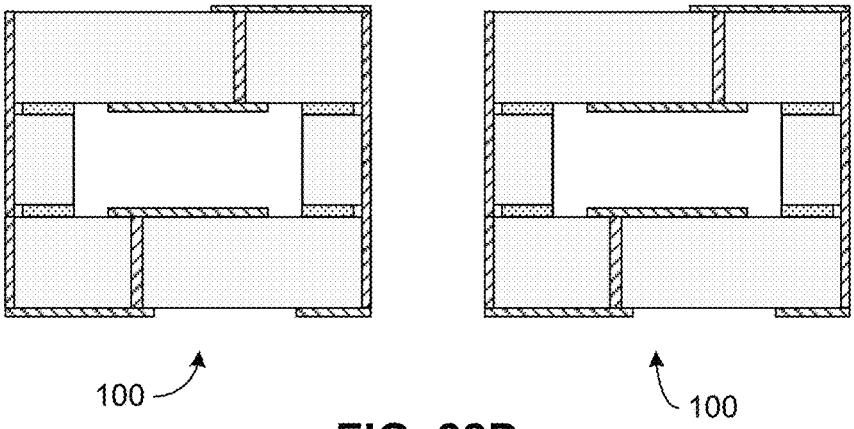

FIG. 22D shows an example where the assembly of insulator plates resulting from the processing step(s) of FIG. 22C can be singulated to yield a plurality of individual flat GDTs 100. Such singulation can be achieved by, for example, cutting, sawing, etc. In some embodiments, two or more flat GDTs 100 can be left in mechanical and optionally, in electrical connection, creating arrayed GDT devices.

When the individual flat GDTs 100 are singulated, the castellation vias 320 between a pair of neighboring units become approximately halved vias to thereby become castellations 174, 182 described in reference to FIGS. 3 and 6. Exposed surfaces of such castellations can be plated with, for example, nickel and tin.

In some embodiments, each of the singulated flat GDTs 100 can optionally be plated with, for example, tin or other solderable material and then, if not already done, conditioned and tested to meet a desired performance level. Such completed product can then be either packaged or implemented in another apparatus such as a circuit board.

Figure 23A:
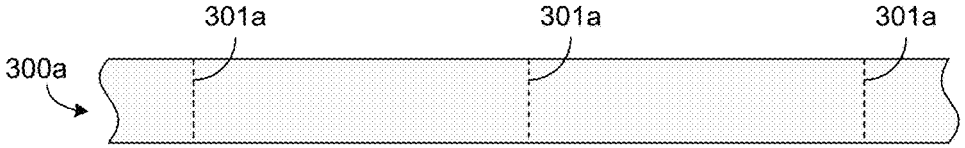
FIGS. 23A and 23B show an example of how a first insulator plate can be processed to be utilized for the examples of FIGS. 4, 7 and 8.
Figure 23B:
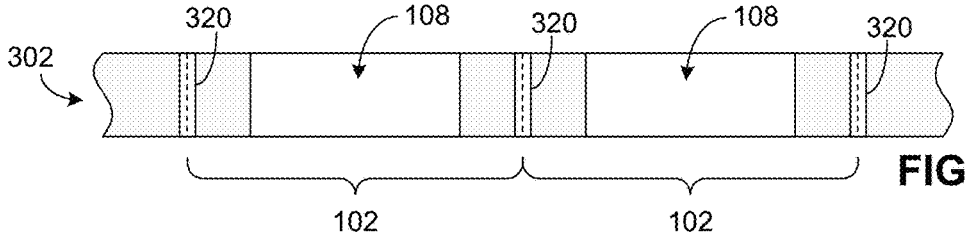

FIGS. 23A and 23B show an example of how a first insulator plate 300*a*, having an array of individual units generally defined by boundaries 301*a*, can be processed to form an array of chamber holes 108 and an array of castellation vias 320, so as to yield a partially process first insulator plate 302. When singulated into individual units, each unit can be utilized as the first insulator substrate 102 described herein in reference to FIGS. 4, 7 and 8.

In the example of FIGS. 23A and 23B, the chamber holes 108 and the castellation vias 320 can be formed utilizing, for example, a laser and/or other hole-formation techniques.

Figure 24A:
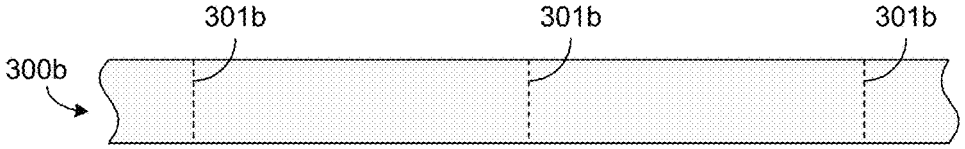
FIGS. 24A and 24B show an example of how a second insulator plate can be processed to be utilized for the examples of FIGS. 4, 7 and 8.
Figure 24B:
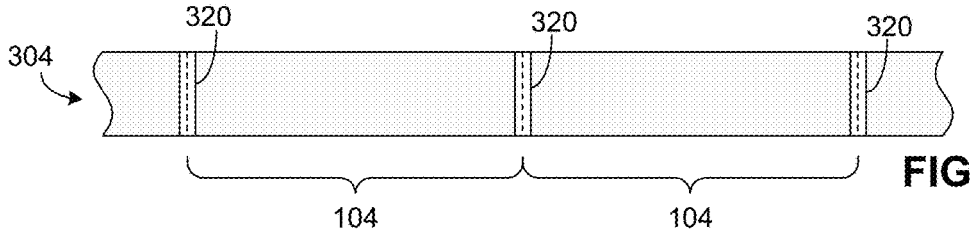

FIGS. 24A and 24B show an example of how a second insulator plate 300*b*, having an array of individual units generally defined by boundaries 301*b*, can be processed to form an array of castellation vias 320, so as to yield a partially process second insulator plate 304. When singulated into individual units, each unit can be utilized as the second insulator substrate 104 described herein in reference to FIGS. 4, 7 and 8.

In the example of FIGS. 24A and 24B, the castellation vias 320 can be formed utilizing, for example, a laser and/or other hole-formation techniques.

Figure 25A:
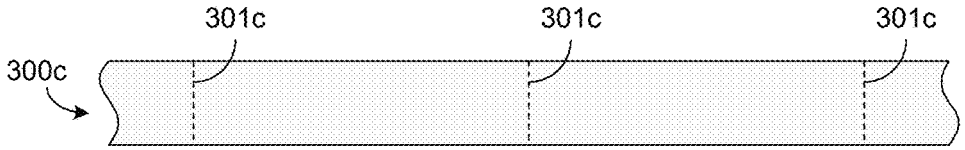
FIGS. 25A and 25B show an example of how a third insulator plate can be processed to be utilized for the examples of FIGS. 4, 7 and 8.
Figure 25B:
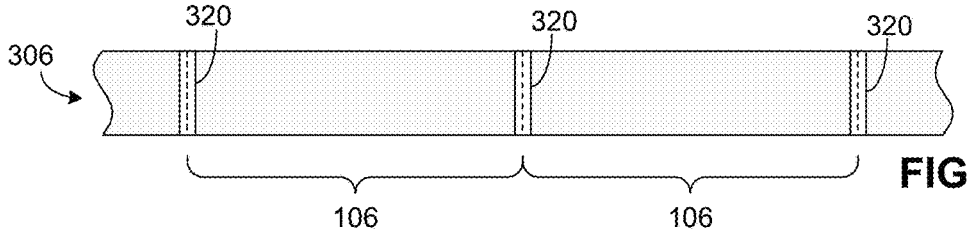

FIGS. 25A and 25B show an example of how a third insulator plate 300*c*, having an array of individual units generally defined by boundaries 301*c*, can be processed to form an array of castellation vias 320, so as to yield a partially process third insulator plate 306. When singulated into individual units, each unit can be utilized as the third insulator substrate 106 described herein in reference to FIGS. 4, 7 and 8.

In the example of FIGS. 25A and 25B, the castellation vias 320 can be formed utilizing, for example, a laser and/or other hole-formation techniques.

Figure 26A:
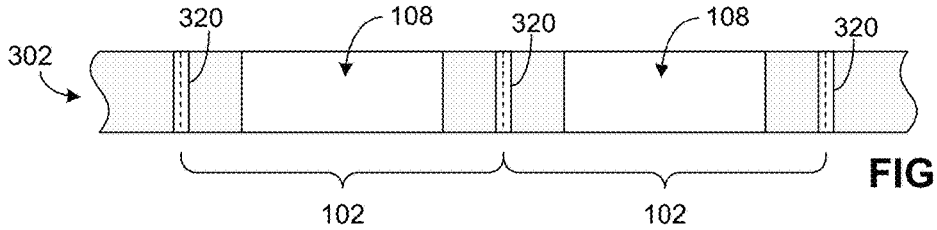
FIGS. 26A and 26B show an example of how the first insulator plate of FIG. 23B can be further processed.
Figure 26B:
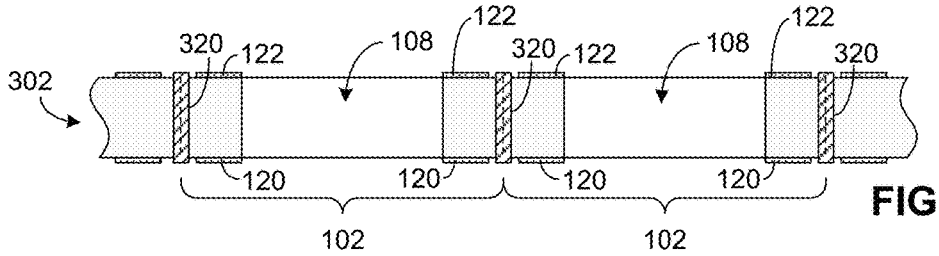

FIG. 26A shows the partially processed first insulator plate 302 of FIG. 23B. FIG. 26B shows that such an insulator plate can be further processed to fill the castellation vias 320 with conductive material, and to form seal rings 120, 122 on both sides of the partially processed first insulator plate 302. For example, the castellation vias 320 can be filled with conductive metal utilizing vacuum to draw the conductive metal into the vias 320. In some embodiments, such filled castellation vias can extend beyond the surface levels, or additional conductive material can be introduced at the ends of such vias, to allow joining with corresponding castellation vias when stacked with another insulator plate. The seal rings 120, 122 can be formed by, for example, printing. As described herein, the seal rings 120, 122 can be electrically conductive or electrically non-conductive. Upon formation of the foregoing filled vias and seal rings, the assembly can be dried and fired prior to further processing.

Figure 27A:
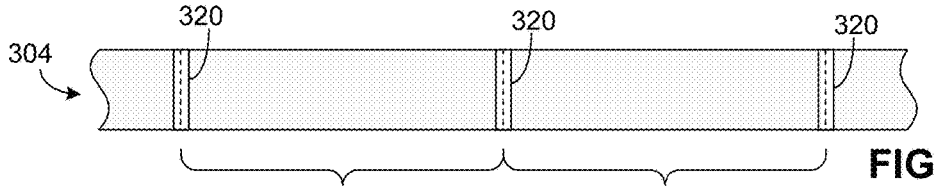
FIGS. 27A and 27B show an example of how the second insulator plate of FIG. 24B can be further processed.
Figure 27B:
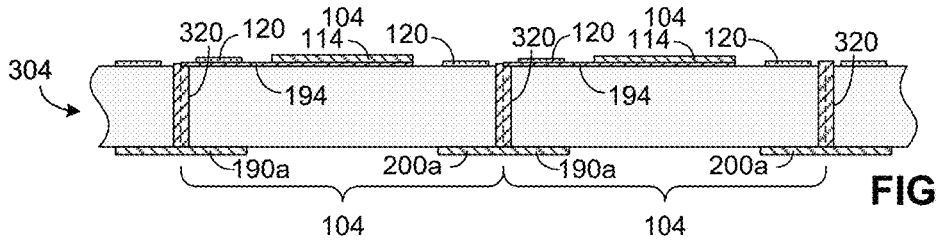

FIG. 27A shows the partially processed second insulator plate 304 of FIG. 24B. FIG. 27B shows that such an insulator plate can be further processed to fill the castellation vias 320 with conductive material, and to form conductive traces 194 on the upper side of the partially processed second insulator plate 304. Seal rings 120 can also be formed on the upper side of the partially processed second insulator plate 304. A portion of each seal ring 120 can cover a corresponding portion of the conductive trace 194.

The castellation vias 320 can be filled with conductive metal utilizing vacuum to draw the conductive metal into the vias 320. In some embodiments, such filled castellation vias can extend beyond the surface levels, or additional conductive material can be introduced at the ends of such vias, to allow joining with corresponding castellation vias when stacked with another insulator plate. The conductive traces 194 and the seal rings 120 can be formed by, for example, printing. As described herein, the seal rings 120 can be electrically conductive or electrically non-conductive.

In the example of FIG. 27B, electrodes 114 can be formed on the upper side of the partially processed second insulator plate 304, and terminals 190*a*, 200*a* can be formed on the lower side of the partially processed second insulator plate 304. In the example shown, a single conductive layer is shown to be formed for terminals 190*a*, 200*a* of neighboring units, such that when singulated, each becomes a terminal of the corresponding individual unit. It will be understood that such neighboring terminals can also be patterned and formed separately.

In the example of FIG. 27B, each electrode 114 can be formed so as to at least partially cover the corresponding conductive trace 194. Accordingly, the electrode 114 can be electrically connected to the corresponding castellation via 320 as described herein.

In some embodiments, one or more drying and firing processes can be performed during and/or after the foregoing formations of the filled vias, the conductive traces, the seal rings, the electrodes, and the terminals. Such drying and firing process(es) can be performed prior to further processing of the insulator plate 304.

Figure 28A:
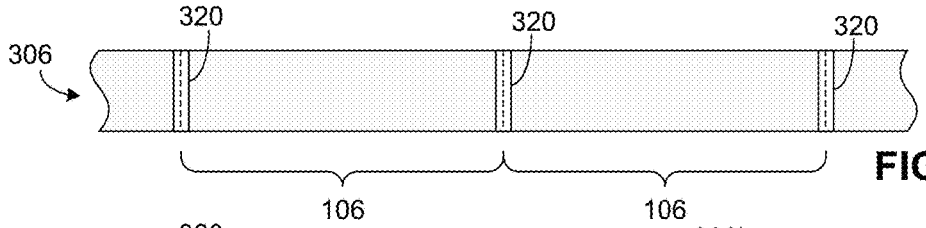
FIGS. 28A and 28B show an example of how the third insulator plate of FIG. 25B can be further processed.
Figure 28B:
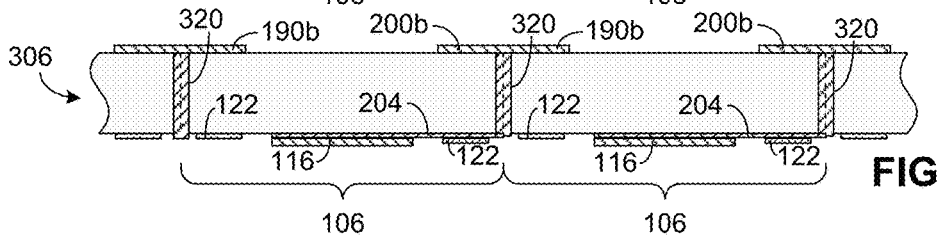

FIG. 28A shows the partially processed third insulator plate 306 of FIG. 25B. FIG. 28B shows that such an insulator plate can be further processed to fill the castellation vias 320 with conductive material, and to form conductive traces 204 on the lower side of the partially processed third insulator plate 306. Seal rings 122 can also be formed on the lower side of the partially processed third insulator plate 306. A portion of each seal ring 122 can cover a corresponding portion of the conductive trace 204.

Castellation vias 320 can be filled with conductive metal utilizing vacuum to draw the conductive metal into the vias 320. In some embodiments, such filled castellation vias can extend beyond the surface levels, or additional conductive material can be introduced at the ends of such vias, to allow joining with corresponding castellation vias when stacked with another insulator plate. The conductive traces 204 and the seal rings 122 can be formed by, for example, printing. As described herein, the seal rings 122 can be electrically conductive or electrically non-conductive.

In the example of FIG. 28B, electrodes 116 can be formed on the lower side of the partially processed third insulator plate 306, and terminals 190*b*, 200*b* can be formed on the upper side of the partially processed third insulator plate 306. In the example shown, a single conductive layer is shown to be formed for terminals 190*b*, 200*b* of neighboring units, such that when singulated, each becomes a terminal of the corresponding individual unit. It will be understood that such neighboring terminals can also be patterned and formed separately.

In the example of FIG. 28B, each electrode 116 can be formed so as to at least partially cover the corresponding conductive trace 204. Accordingly, the electrode 116 can be electrically connected to the corresponding castellation via 320 as described herein.

In some embodiments, one or more drying and firing processes can be performed during and/or after the foregoing formations of the filled vias, the conductive traces, the seal rings, the electrodes, and the terminals. Such drying and firing process(es) can be performed prior to further processing of the insulator plate 306.

In some embodiments, the insulator plates 302, 304, 306 can then be plated to cover the metalized areas. Such plating can include, for example, nickel and optionally selective copper.

In the example of FIGS. 28A and 28B, the upper terminals 109*b*, 200*b* can be included to yield the example configuration of FIGS. 8A-8C, in which a flat GDT 100 can be mounted through either side. Such upper terminals (109*b*, 200*b*) can be omitted in the example of FIGS. 28A and 28B to yield the example configuration of FIGS. 7A-7C, in which a flat GDT 100 has terminals on one side only.

Figure 29A:
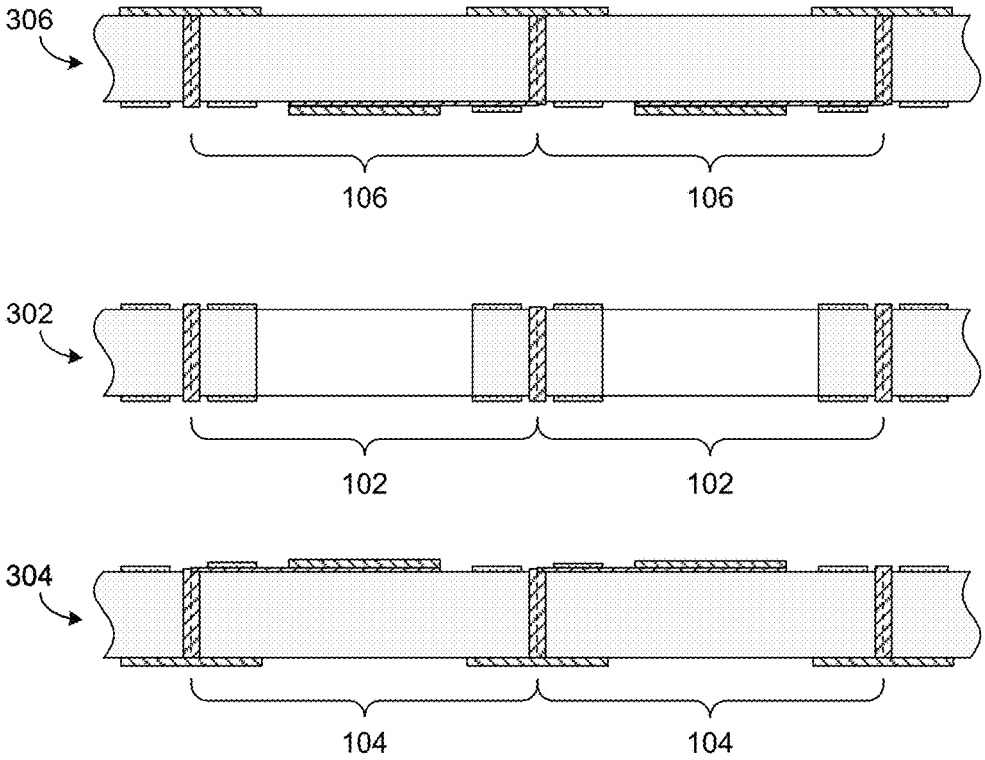
FIGS. 29A-29D show examples of how processed insulator plates can be stacked and further processed to yield a plurality of individual flat GDTs.

FIGS. 29A-29D show examples of how the processed insulator plates 302, 304, 306 of FIGS. 26B, 27B, 28B, respectively, can be stacked and further processed to yield a plurality of individual flat GDTs having one or more features as described herein. In FIG. 29A, a stack can be formed by positioning the first insulator plate 302 over the second insulator plate 304, and then the third insulator plate 306 over the first insulator plate 302. In some embodiments, a stacking apparatus can be utilized to ensure sufficient accuracy in alignment of the individual units of the three insulator plates. Such alignment can include, for example, alignment of the castellation vias 320 that will provide external electrical connections.

Figure 29B:
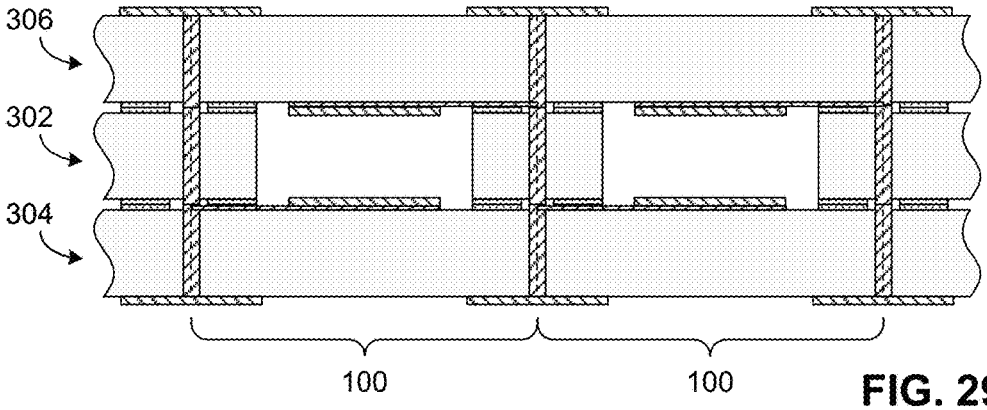

FIG. 29B shows the three insulator layers 304, 302, 306 stacked and aligned so as to define an array of what will become individual flat GDTs 100. Such a stacked assembly can be cured so as to form an array of flat GDTs 100, with each having a sealed chamber filled with desired gas. For example, the stacked assembly can be placed in a furnace, and air can be replaced with a desired gas mixture. Then, temperature can be raised to a point where the seal ring layers between the insulator plates melt or cure to thereby substantially seal the respective chambers filled with the desired gas mixture.

Figure 29C:
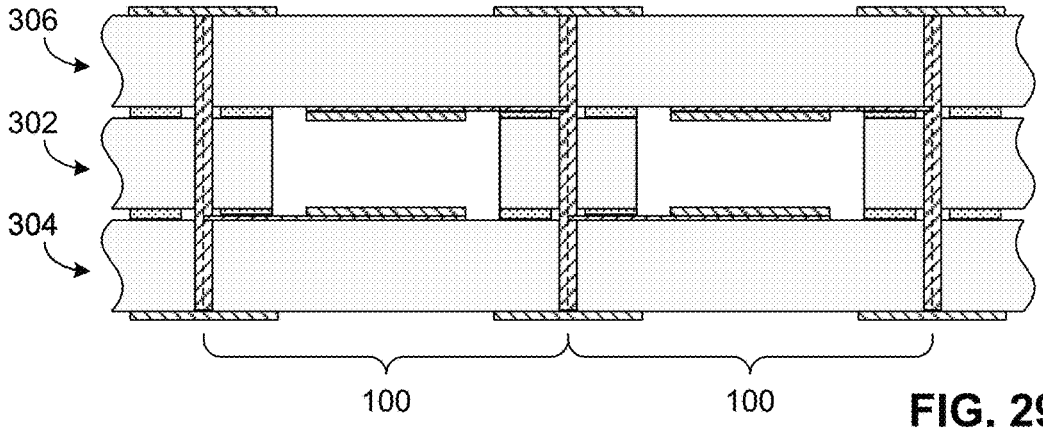

FIG. 29C shows an example of such an assembly of insulator plates where the chambers are substantially sealed by the seal rings between a pair of insulator plates. In some embodiments, the sealed assembly of insulator plates can be removed from the furnace, and have plating formed on, for example, exposed terminals and metal features (e.g., any exposed vias). Such plating can include, for example, tin or other solderable material. In some embodiments, the sealed assembly of insulator plates can optionally be conditioned and tested to meet a desired performance level while in an array of devices.

Figure 29D:
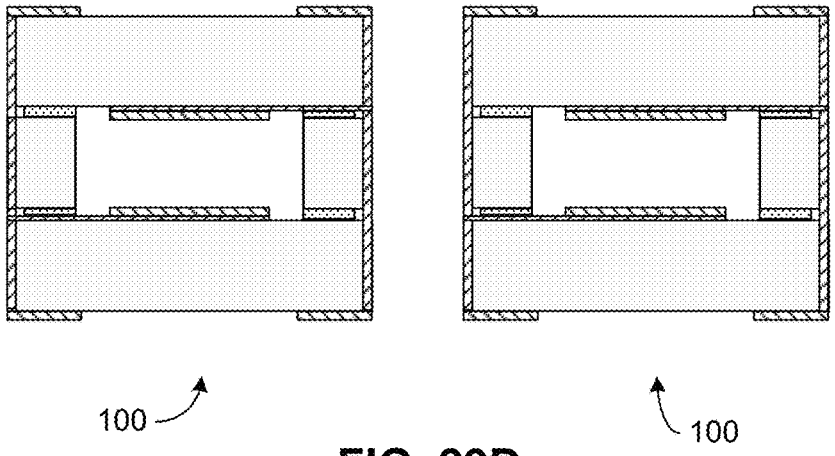

FIG. 29D shows an example where the assembly of insulator plates resulting from the processing step(s) of FIG. 29C can be singulated to yield a plurality of individual flat GDTs 100. Such singulation can be achieved by, for example, cutting, sawing, etc. In some embodiments, two or more flat GDTs 100 can be left in mechanical and optionally, in electrical connection, creating arrayed GDT devices.

When the individual flat GDTs 100 are singulated, the castellation vias 320 between a pair of neighboring units become approximately halved vias to thereby become castellations 192, 202 described in reference to FIGS. 4, 7 and 8. Exposed surfaces of such castellations can be plated with, for example, nickel and tin.

In some embodiments, each of the singulated flat GDTs 100 can optionally be plated with, for example, tin or other solderable material and then, if not already done, conditioned and tested to meet a desired performance level. Such completed product can then be either packaged or implemented in another apparatus such as a circuit board.

Figure 34A:
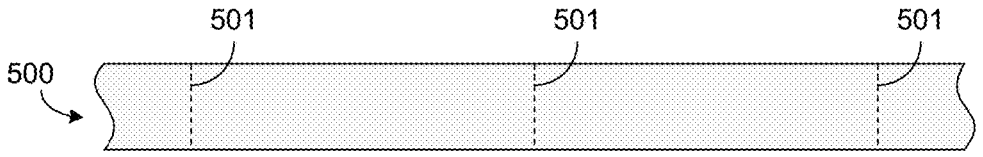
FIGS. 34A and 34B show an example of how a first insulator plate can be processed to be utilized for the examples of FIGS. 4 and 31-33.
Figure 34B:
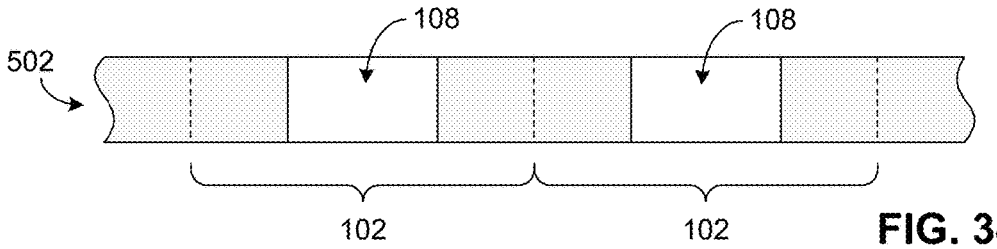

FIGS. 34A and 34B show an example of how a first insulator plate 500, having an array of individual units generally defined by boundaries 501, can be processed to form an array of chamber holes 108, so as to yield a partially processed first insulator plate 502. When singulated into individual units, each unit can be utilized as the first insulator substrate 102 described herein in reference to FIGS. 4 and 31-33.

In the example of FIGS. 34A and 34B, the first insulator plate 500 can be a ceramic plate such as an alumina ceramic plate. However, it will be understood that first insulator plate 500 can be formed from one or more other electrically insulating materials. In the example of FIGS. 34A and 34B, the chamber holes 108 can be formed utilizing, for example, a laser and/or other hole-formation techniques.

FIGS. 35A-35E show an example of how an insulator plate can be configured as a second insulator plate and/or a third insulator plate to yield a plurality of second insulator substrates (104) and a plurality of third insulator substrates (106) described herein in reference to FIGS. 4 and 31-33. Such an array of individual units, generally defined by boundaries (505 in FIG. 35A), can be processed to yield a partially processed insulator plate 520. When singulated into individual units, each unit can be utilized as the second insulator substrate 104 and/or the third insulator substrate 106 described herein in reference to FIGS. 4 and 31-33.

Referring to FIGS. 35A, 31, 33B and 33C, an insulator plate indicated as 504 can be formed or provided. As described herein, such an insulator plate can be configured to allow processing of an array of individual units generally defined by boundaries 505.

Figure 35A:
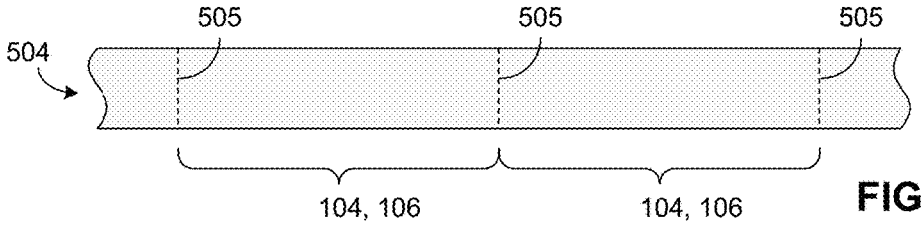
FIGS. 35A-35E show an example of how an insulator plate can be processed to be utilized a second insulator plate and/or a third insulator plate for the examples of FIGS. 4 and 31-33.

Referring to FIGS. 35B, 31, 33B and 33C, conductive castellations features 508 can be formed on selected locations of the insulator plate 504 of FIG. 35A, so as to yield an assembly 506. In some embodiments, a given conductive castellation 508 can be formed at a boundary (505 in FIG. 35A). As described herein, when processed further, each individual unit of the assembly 506 can be utilized as a second insulator substrate 104 and/or a third insulator substrate 106 of a flat GDT. Thus, when utilized as a second insulator substrate 104, approximately half of the conductive castellation feature 508 can be a conductive castellation 191 (e.g., FIGS. 31, 33B and 33C). When utilized as a third insulator substrate 106, approximately half of the conductive castellation feature 508 can be a conductive castellation 201 (e.g., FIGS. 31, 33B and 33C).

In some embodiments, the conductive castellation features 508 can be formed as described herein, including, for example, laser and/or other hole-formation techniques followed by metal filling or plating techniques. It will be understood that other techniques can also be utilized to form the conductive castellation features.

Figure 35B:
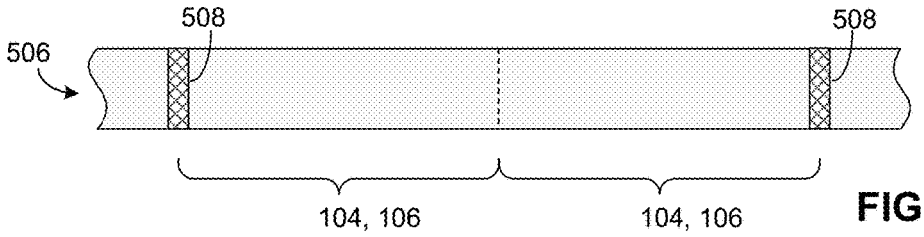

It is noted that to obtain the second and third insulator substrates 104, 106 of the flat GDT of FIG. 32, the example process step of FIG. 35B can be modified so as to form one or more internal conductive vias within the boundaries of each unit of the insulator plate 504. Such conductive via(s) can be implemented instead of, or in addition to, the conductive castellation features 508. It will be understood that some or all of other process steps in the example of FIGS. 35A-35E can be modified appropriately to accommodate such a configuration having internal conductive vias.

Figure 35C:
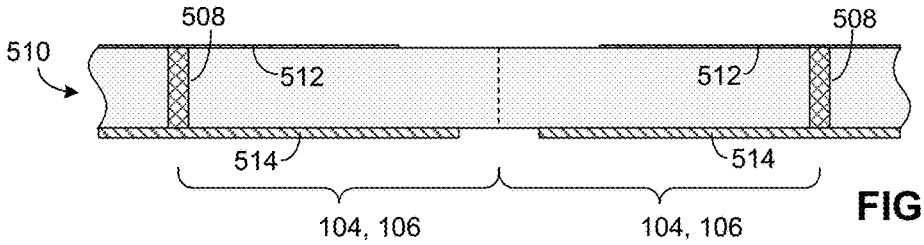

Referring to FIGS. 35C, 31 and 33C, conductive traces 512 can be formed on selected locations of the insulator plate assembly 506 of FIG. 35B, so as to yield an assembly 510. In some embodiments, a given conductive trace 512 can be formed so as to be on both sides of a given boundary 500. In some embodiments, such a conductive trace can be in electrical contact with a corresponding conductive castellation feature 508, and extend into both of two neighboring units about the conductive castellation feature 508. When processed further, each individual unit of the assembly 510 can be utilized as a second insulator substrate 104 and/or a third insulator substrate 106 of a flat GDT. Thus, when utilized as a second insulator substrate 104, the conductive trace 512 can be a conductive trace 194 (e.g., FIGS. 31 and 33C). When utilized as a third insulator substrate 106, the conductive trace 512 can be a conductive trace 204 (e.g., FIGS. 31 and 33C).

In some embodiments, the conductive traces 512 can be formed with, for example, thick film molly manganese or thick film tungsten, plated with copper or nickel or braze/solder material (e.g., copper-silver (CuSil) material) utilizing, for example, printing, firing and plating techniques. It will be understood that other techniques can also be utilized to form the conductive traces.

Still referring to FIGS. 35C, 31 and 33C, terminals 514 can be formed on selected locations of the insulator plate assembly 510. In some embodiments, a given terminal 514 can be formed so as to be on both sides of a given boundary 500. In some embodiments, such a terminal can be in electrical contact with a corresponding conductive castellation feature 508, and extend into both of two neighboring units about the conductive castellation feature 508. When processed further, each individual unit of the assembly 510 can be utilized as a second insulator substrate 104 and/or a third insulator substrate 106 of a flat GDT. Thus, when utilized as a second insulator substrate 104, the terminal 514 can be a terminal 190 (e.g., FIGS. 31 and 33B). When utilized as a third insulator substrate 106, the terminal 514 can be a terminal 200 (e.g., FIGS. 31 and 33B).

In some embodiments, the terminals 514 can be formed with, for example, printing and firing of a thick film of conductor material such as molybdenum-manganese or thick film tungsten, followed by a copper layer plated over the fired thick film conductor material, a nickel layer plated over the copper layer, and a tin or gold layer plated over the nickel layer. It will be understood that other techniques can also be utilized to form the terminals.

Figure 35D:
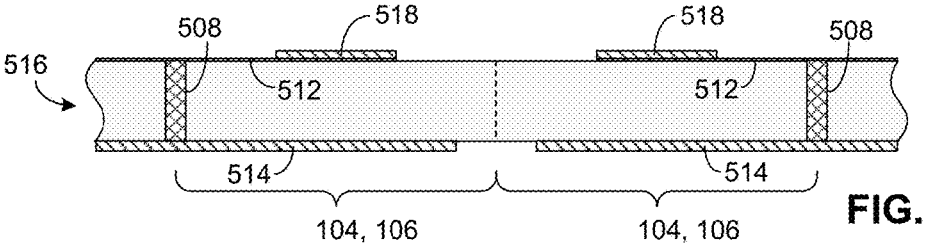

Referring to FIGS. 35D, 31 and 33C, electrodes 518 can be formed on selected locations of the insulator plate assembly 510 of FIG. 35C, so as to yield an assembly 516. In some embodiments, a given electrode 518 can be formed over the corresponding conductive trace 512. As described herein, when processed further, each individual unit of the assembly 516 can be utilized as a second insulator substrate 104 and/or a third insulator substrate 106 of a flat GDT. Thus, when utilized as a second insulator substrate 104, the electrode 518 can be an electrode 114 (e.g., FIGS. 31 and 33C). When utilized as a third insulator substrate 106, the electrode 518 can be an electrode 116 (e.g., FIGS. 31 and 33C).

In some embodiments, the electrodes 518 can be formed and configured as described herein. For example, each electrode 518 can be a simple metal layer, or can include features such as a waffle pattern. In some embodiments, an emissive coating can be printed on the electrodes. In some embodiments, pre-ionization lines and/or patterns can be formed on one or more of the insulator substrates to control breakdown parameters.

Figure 35E:
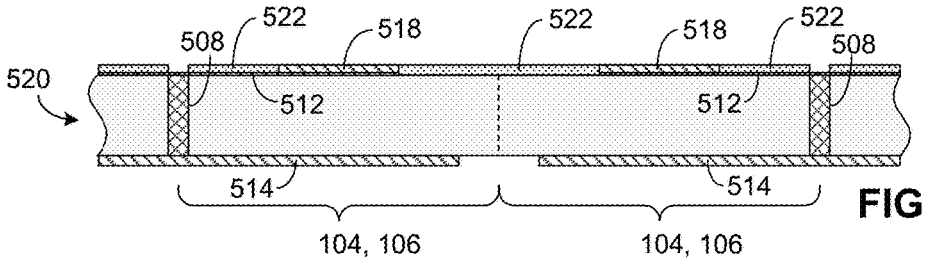

Referring to FIGS. 35E, 31 and 33C, a seal 522 can be formed on selected locations of the insulator plate assembly 516 of FIG. 35D, so as to yield an assembly 520. In some embodiments, the seal 522 can substantially cover the conductive traces 512, and be patterned to expose the electrodes 518. As described herein, when processed further, each individual unit of the assembly 520 can be utilized as a second insulator substrate 104 and/or a third insulator substrate 106 of a flat GDT. Thus, when utilized as a second insulator substrate 104, the seal 522 can be a seal 120 (e.g., FIGS. 31 and 33C). When utilized as a third insulator substrate 106, the seal 522 can be a seal 122 (e.g., FIGS. 31 and 33C).

In some embodiments, the seal 522 can be formed as described herein, including, for example, as a glass formed by a glazing technique. It will be understood that other techniques can also be utilized to form the seal.

Figure 36:
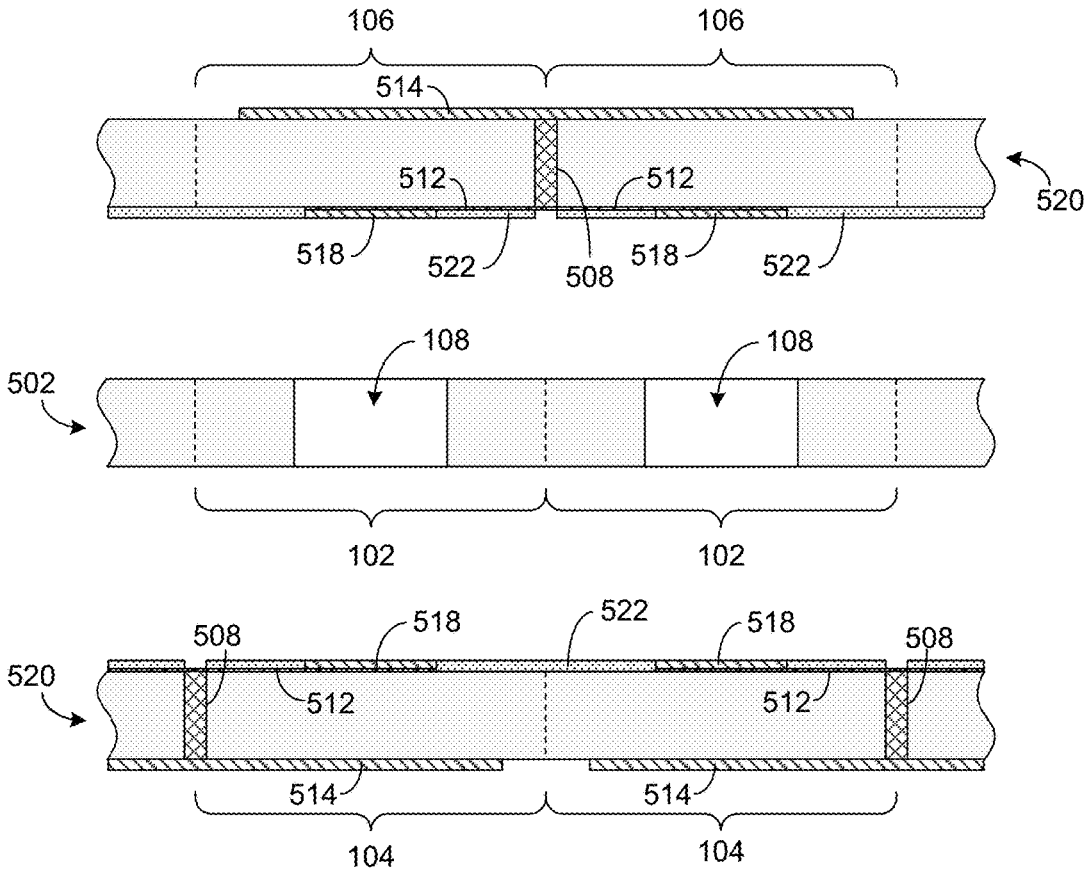
FIG. 36 shows an example processing step where a stack can be formed with a first insulator plate of FIG. 34B and two insulator plates of FIG. 35E.
Figure 37:
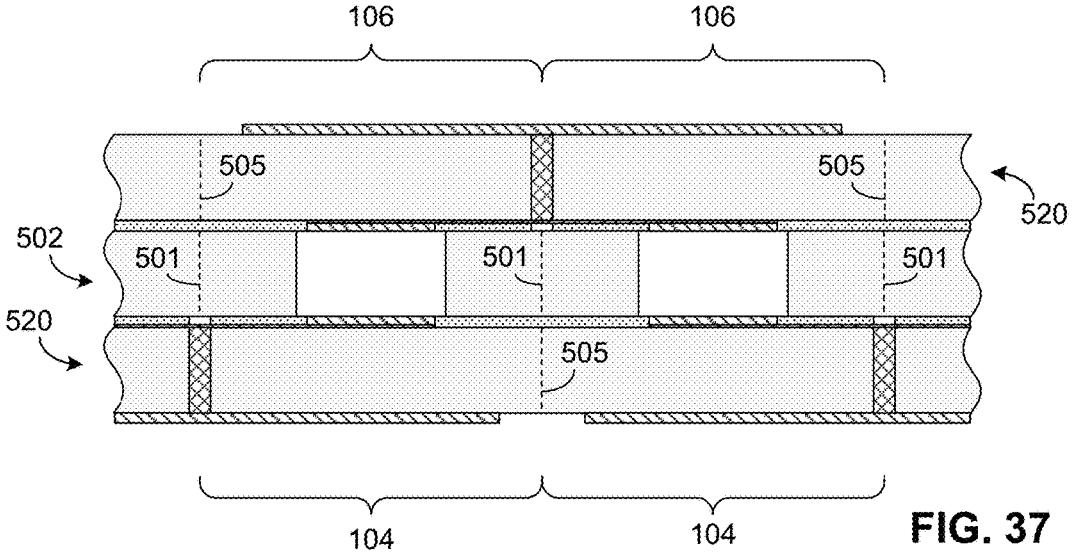
FIG. 37 shows the three insulator layers of FIG. 36 in a stacked configuration.
Figure 38:
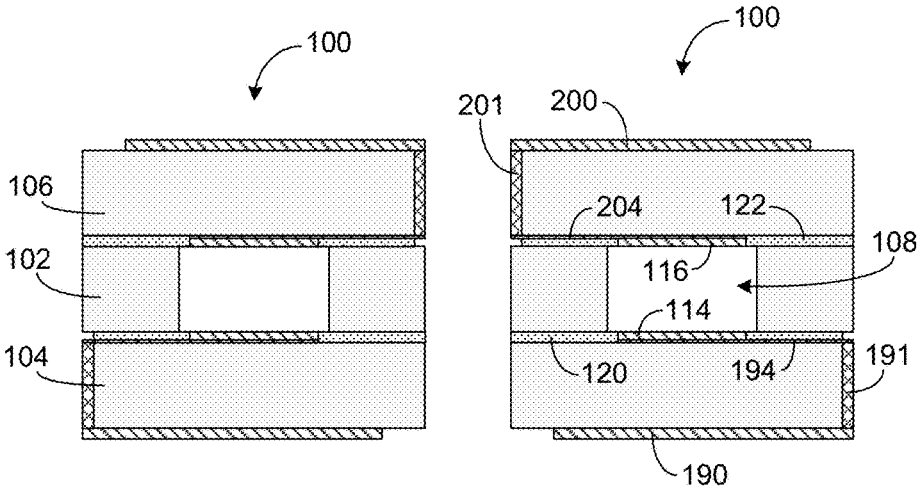
FIG. 38 shows an example where the assembly of insulator plates of FIG. 37 can be singulated to yield a plurality of individual flat GDTs.

FIGS. 36-38 show examples of how the processed insulator plates 502 and 520 of FIGS. 34B and 35E, respectively, can be stacked and further processed to yield a plurality of individual flat GDTs having one or more features as described herein. In FIG. 36, a stack can be formed by positioning a first insulator plate 502 of FIG. 34B over an insulator plate 520 of FIG. 35E being utilized as a second insulator plate, and then positioning an insulator plate 520, also of FIG. 35E, being utilized as a third insulator plate, over the first insulator plate 502. In some embodiments, a stacking apparatus can be utilized to ensure sufficient accuracy in alignment of the individual units of the three insulator plates.

In some embodiments, the foregoing stacking of the various plates can be performed by a lamination process in an environment having a desired gas such as neon or argon. Thus, upon completion of the lamination process, the desired gas can be trapped within a substantially hermetic chamber formed by each volume 108 (e.g., FIG. 31).

FIG. 37 shows the three insulator layers 520, 502, 520 stacked and laminated so as to define an array of what will become individual flat GDTs 100. Such a stacked assembly can be cured so as to form an array of flat GDTs 100, with each having a sealed chamber filled with desired gas. In such a lamination process, the stacked assembly can be placed in a furnace, and air can be replaced with a desired gas mixture (e.g., a mixture having neon and/or argon). Then, temperature can be raised to a point where the seal between the insulator plates melt or cure to thereby substantially seal the respective chambers filled with the desired gas mixture.

FIG. 38 shows an example where the assembly of insulator plates resulting from the processing step(s) of FIG. 37 can be singulated to yield a plurality of individual flat GDTs 100. Such singulation can be achieved by, for example, cutting, sawing, etc., along the substantially aligned boundaries 505, 501, 505. In some embodiments, two or more flat GDTs 100 can be left in mechanical and optionally, in electrical connection, creating arrayed GDT devices.

When the individual flat GDTs 100 are singulated, the castellation features (508) between a pair of neighboring units become approximately halved features to thereby become castellations 191, 201 described in reference to FIGS. 31 and 33. Exposed surfaces of such castellations can be plated with, for example, copper, nickel and tin.

In some embodiments, each of the singulated flat GDTs 100 can optionally be conditioned and tested to meet a desired performance level. Such completed product can then be either packaged or implemented in another apparatus such as a circuit board.

In the examples described in reference to FIGS. 31 and 35-38, each of the second and third insulator substrates (104, 106) is depicted as having a conductive castellation on one side. Further, the conductive castellation of one insulator substrate is shown to be on the opposite edge from the edge where the conductive castellation of the other insulator substrate is implemented. It will be understood that other configurations can also be implemented. For example, conductive castellations can be implemented on the same side of a flat GDT for both of the second and third insulator substrates.

It is also noted that in the examples of FIGS. 31 and 35-38, the second and third insulator substrates 104, 106 are described as resulting from generally two of the same insulator plate assemblies 520 that are laterally offset relative to each other. However, it will be understood that the second and third insulator substrates 104, 106 may or may not be the same.

Figure 30A:
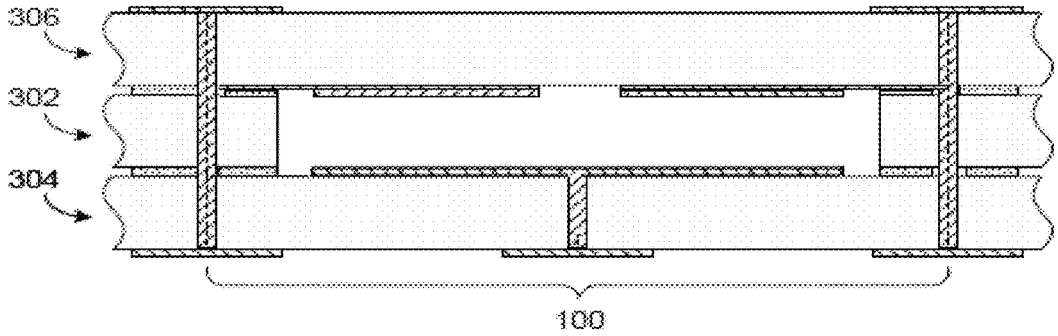
FIGS. 30A and 30B show an example where a flat GDT having one or more features as described herein can include more than two terminals.
Figure 30B:
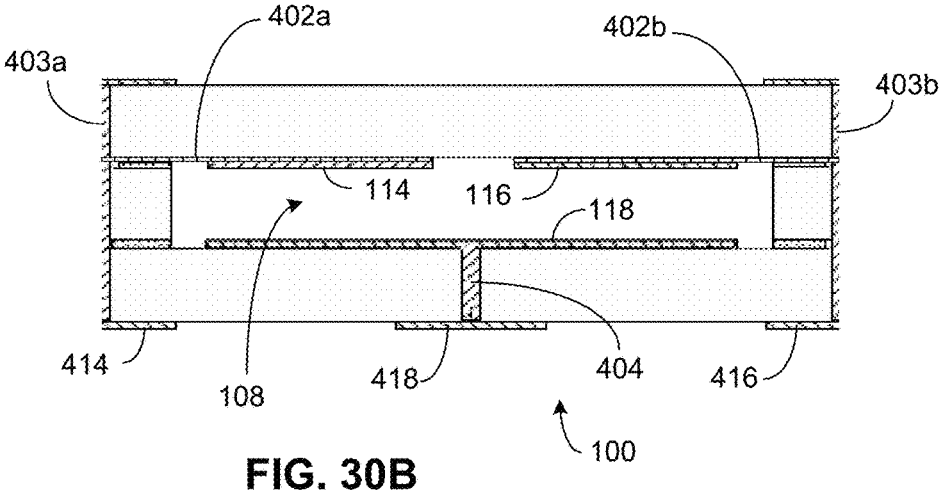

Examples of Flat GDTs Having Other Configurations:

Various examples are described in the context of two-terminal devices. In some embodiments, one or more features of the present disclosure can be implemented in flat GDTs having more than two terminals. For example, FIGS. 30A and 30B show an example where a flat GDT 100 having one or more features as described herein can include three terminals 414, 416, 418. FIG. 30A shows an assembly of three insulator layers 304, 302, 306 fabricated and stacked in manners similar to the various examples described herein. FIG. 30B shows an individual flat GDT 100 after being singulated from the stack of FIG. 30A.

Referring to FIGS. 30A and 30B, the flat GDT 100 can include a first terminal 414 electrically connected to a first electrode 114 through a conductive trace 402*a* and an external conductive feature 403*a* such as a castellation on the corresponding edge of the flat GDT 100. Similarly, a second terminal 416 can be electrically connected to a second electrode 116 through a conductive trace 402*b* and an external conductive feature 403*b* such as a castellation on the corresponding edge of the flat GDT 100. The flat GDT 100 can further include a third terminal 418 electrically connected to a third electrode 118 through a conductive via 404.

In some embodiments, the first electrode 118 can be a center electrode for providing the L1-ground and L2-ground paths (with L1 and L2 corresponding to the first and second electrodes 114, 116) during discharges in 3-terminal GDTs. Such discharge paths can be achieved through a common chamber 108, and can yield a well-balanced GDT for common-mode surges.

In the examples of FIGS. 30A and 30B, the electrode 118 is shown to be electrically connected to the terminal 418 implemented on one side (e.g., the lower side when oriented as shown in FIG. 30B) of the flat GDT 100. In some embodiments, such an electrode (118) can be connected to a terminal implemented on both sides of a flat GDT.

Figure 30C:
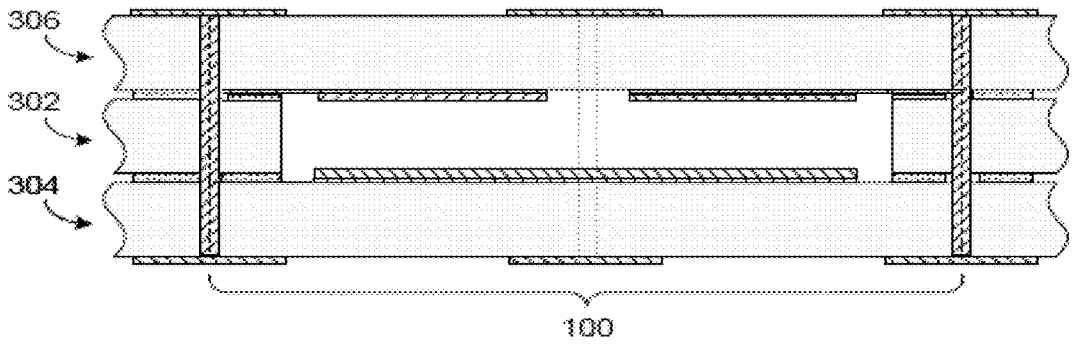
FIGS. 30C and 30D show an example flat GDT that can be similar to the example of FIGS. 30A and 30B, but with a center terminal implemented on both of upper and lower surfaces.
Figure 30D:
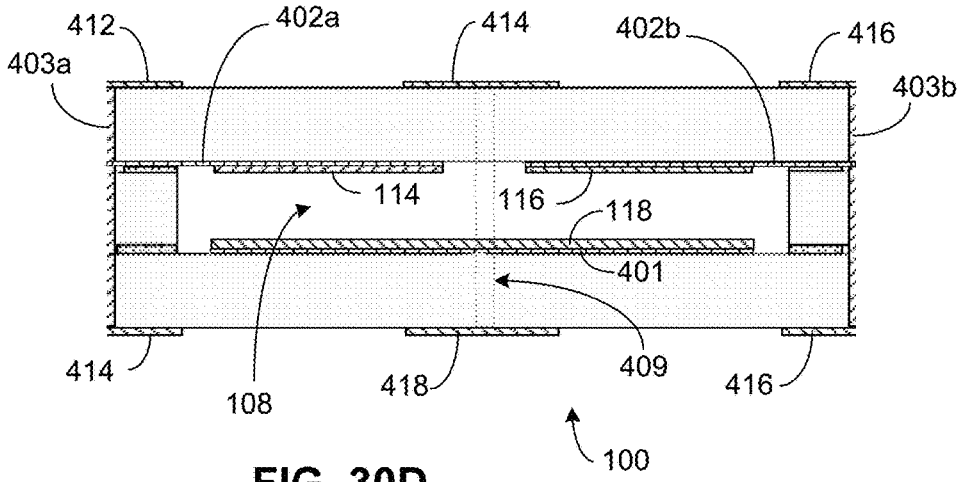

For example, FIGS. 30C and 30D show an example where a flat GDT 100 having one or more features as described herein can include three terminals 414, 416, 418. FIG. 30C shows an assembly of three insulator layers 304, 302, 306 fabricated and stacked in manners similar to the various examples described herein. FIG. 30D shows an individual flat GDT 100 after being singulated from the stack of FIG. 30C.

Referring to FIGS. 30C and 30D, the flat GDT 100 can include a third terminal 418 implemented on both of upper and lower sides of the flat GDT 100. Such a third terminal can be electrically connected to a third electrode 118 through, for example, an external conductive feature 409 such as a castellation on a side wall not being utilized for electrical connections for other electrodes. In the example shown in FIG. 30D, such a side wall can be a front side wall or a back side wall. The third electrode 118 can be electrically connected to the castellation 409 through a conductive trace 401.

In the examples of FIGS. 30C and 30D, a first terminal 414 can be electrically connected to a first electrode 114 through a conductive trace 402*a* and an external conductive feature 403*a* such as a castellation on the corresponding edge of the flat GDT 100. Similarly, a second terminal 416 can be electrically connected to a second electrode 116 through a conductive trace 402*b* and an external conductive feature 403*b* such as a castellation on the corresponding edge of the flat GDT 100.

In some embodiments, the third electrode 118 can be a center electrode for providing the L1-ground and L2-ground paths (with L1 and L2 corresponding to the first and second electrodes 114, 116) during discharges in 3-terminal GDTs. Such discharge paths can be achieved through a common chamber 108, and can yield a well-balanced GDT for common-mode surges.

Configured in the foregoing manner, the example flat GDT of FIG. 30D can be mounted in either upright or inverted orientation due to all three of the terminals being present on each of the upper and lower sides.

Figure 30E:
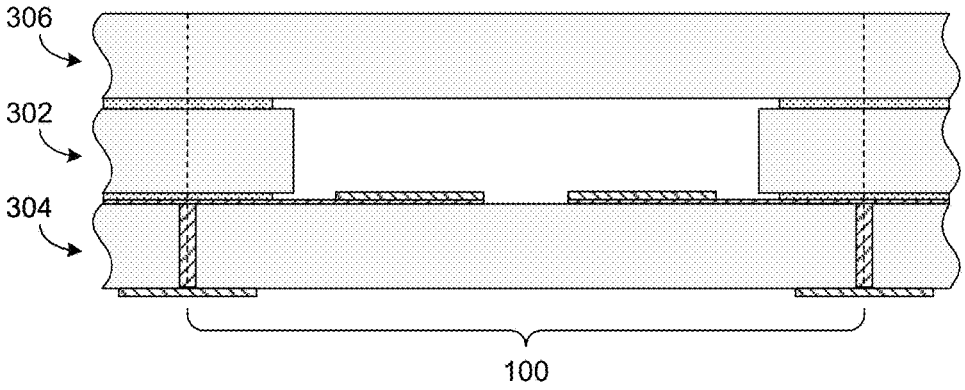
FIGS. 30E and 30F show an example where a flat GDT having one or more features as described herein can include all electrodes on one side of a sealed chamber.
Figure 30F:
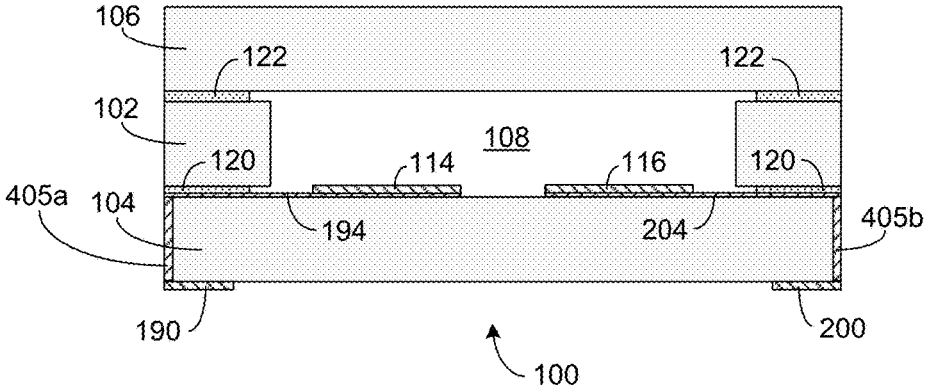

Various examples are described in the context of electrodes being implemented on opposing sides of a chamber. In some embodiments, one or more features of the present disclosure can be implemented in a flat GDT in which electrodes can be implemented on only one side of a chamber. For example, FIGS. 30E and 30F show an example where a flat GDT 100 includes a first insulator substrate 102 having an opening, a second insulator substrate 104, and a third insulator substrate 106 stacked together to define a chamber 108. A first seal 120 can be implemented between the first and second insulator substrates 102, 104, and a second seal 122 can be implemented between the first and third insulator substrates 102, 106. In some embodiments, the first and second seals can be conductive or non-conductive (e.g., glass) as described herein. In some embodiments, first and second electrodes 114, 116 can be implemented on a surface of the second insulator substrate 104, such that both electrodes face the same direction into the chamber 108.

FIG. 30E shows an assembly of three insulator layers 304, 302, 306 fabricated and stacked in manners similar to the various examples described herein. FIG. 30F shows an individual flat GDT 100 having the foregoing features, after being singulated from the stack of FIG. 30E.

In the example of FIGS. 30E and 30F, the first electrode 114 is shown to be electrically connected to a first terminal 190 through a conductive trace 194 and an external conductive feature 405*a* such as a castellation on the corresponding edge of the flat GDT 100. Similarly, the second electrode 114 is shown to be electrically connected to a second terminal 200 through a conductive trace 204 and an external conductive feature 405*b* such as a castellation on the corresponding edge of the flat GDT 100.

Figure 30G:
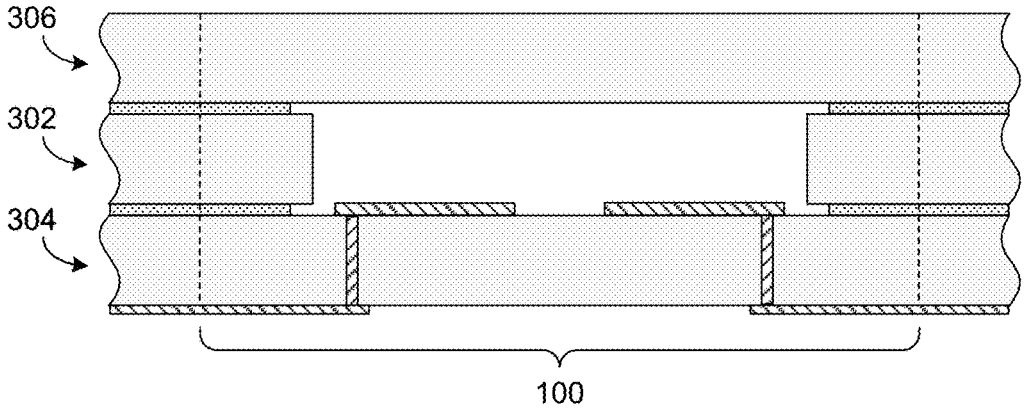
FIGS. 30G and 30H show another example of a flat GDT having all electrodes on one side of a sealed chamber.
Figure 30H:
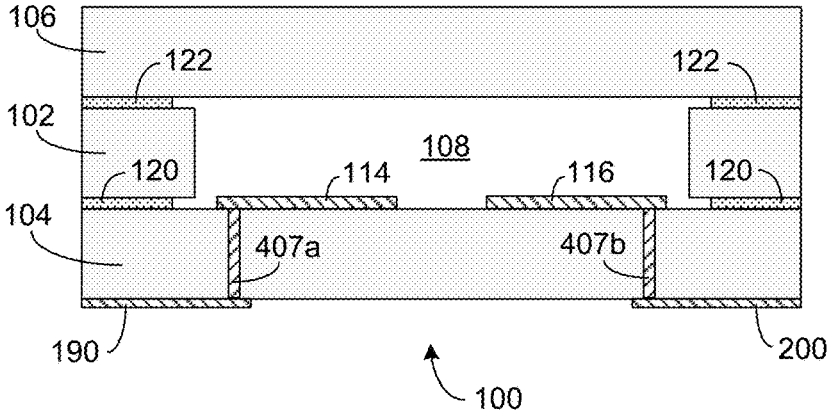

In the example of FIGS. 30E and 30F, the electrodes are electrically connected to their respective terminals through external conductive features such as castellations. It will be understood that electrical connections between the electrodes and the terminals can also be implemented in other manners. For example, FIGS. 30G and 30H show a flat GDT 100 that is similar to the example of FIGS. 30E and 30F in that both electrodes 114, 116 are implemented on the same insulator substrate (e.g., the second insulator substrate 104). In the example of FIGS. 30G and 30H, however, such electrodes are shown to be electrically connected to first and second terminals 190, 200 through internal conductive vias 407*a*, 407*b*.

FIG. 30G shows an assembly of three insulator layers 304, 302, 306 fabricated and stacked in manners similar to the various examples described herein. FIG. 30H shows an individual flat GDT 100 having the foregoing features, after being singulated from the stack of FIG. 30G.

In some implementations, the example flat GDTs of FIGS. 30E-30H can be implemented as a simple and low cost configuration that would be surface mountable. While both of the electrodes being on the same side may not provide similar level of performance as in configurations where electrodes face each other, there may be some applications where the flat GDTs of FIGS. 30E-30H can be utilized.

It will be understood that other numbers of electrodes and/or terminals can be implemented utilizing one or more features of the present disclosure.

Examples of Advantageous Features:

It is noted that in the various examples described herein, electrodes can be implemented on surfaces of substrate layers such as ceramic layers. In some embodiments, such electrodes can be formed utilizing same or similar techniques already being used to form other conductive layers. Accordingly, such electrode configurations can provide, among other advantageous features, cost effectiveness in fabrication of flat GDTs.

It is also noted that use of substrate layers such as ceramic layers can facilitate more consistency in how partially or fully fabricated assembly of layers can be singulated into individual units.

It is further noted that in some of all of the examples described herein, terminals for a given flat GDT can be implemented on one or more substrate layers that also support the corresponding electrode(s). Accordingly, such a flat GDT can be utilized on, for example, a circuit board, without further packaging thereby resulting in a smaller package and/or better electrical performance.

Examples of Variations:

U.S. Publication No. 2014/0239804 discloses, among others, pre-ionization lines (e.g., 242 in FIGS. 6C and 6D) that can be implemented. It will be understood that such pre-ionization lines can also be implemented in some or all of the flat GDTs of the present disclosure.

In the various examples described herein, the openings 108 in the first insulator substrates 102 are depicted as having a simple cylindrical shape. It will be understood that other opening profiles, including the examples disclosed in U.S. Publication No. 2014/0239804, can also be implemented.

In the various examples described herein, flat GDTs are described in the context of one sealed chamber having a pair of electrodes. It will be understood that in some embodiments, two or more sealed chambers can be combined into a flat GDT. Such configurations having two or more chambers per flat GDT can include examples disclosed in U.S. Publication No. 2014/0239804 (e.g., FIGS. 7-10).

It is noted that use of substrate layers to support their respective electrodes can also allow flat GDTs to have a plurality of sealed chambers arranged in a stack configuration. For example, generally flat nature of the assemblies of layers of flat GDTs as described herein can allow two or more flat GDTs to be stacked and have electrical connections implemented with internally and/or externally.

In another example, a given substrate layer can support electrodes on both sides. Such a configuration can allow one substrate layer to be omitted when two sealed chambers are in a stacked configuration.

FIGS. 39-44 show examples of GDT devices in which a plurality of chambers can be implemented in a stack configuration. In each GDT device 100 of FIGS. 39-44, a first chamber 108*a* can be implemented with a stack of insulator substrates 102*a* (with an opening), 104*a*, and 106. A second chamber 108*b* can be implemented over the first chamber 108*b* by a stack of insulator substrates 102*b* (with an opening), the upper insulator substrate 106 from the foregoing stack with the first chamber 108*a*, and an insulator substrate 104*b*.

In each GDT device 100 of FIGS. 39-44, a seal can be implemented between two neighboring insulator substrates. More particularly, a seal 120*a* is shown to be implemented between the insulator substrates 104*a* and 102*a*; a seal 122*a* is shown to be implemented between the insulator substrates 102*a* and 106; a seal 120*b* is shown to be implemented between the insulator substrates 106 and 102*b*; and a seal 122*b* is shown to be implemented between the insulator substrates 102*b* and 104*b*.

For the first chamber 108*a*, a first end electrode 114 is shown to be implemented on the upper surface of the insulator substrate 104*a*, and a first center electrode 118*a* is shown to be implemented on the lower surface of the insulator substrate 106. Similarly, for the second chamber 108*b*, a second center electrode 118*b* is shown to be implemented on the upper surface of the insulator substrate 106, and a second end electrode 116 is shown to be implemented on the lower surface of the insulator substrate 104*b*.

Figure 39:
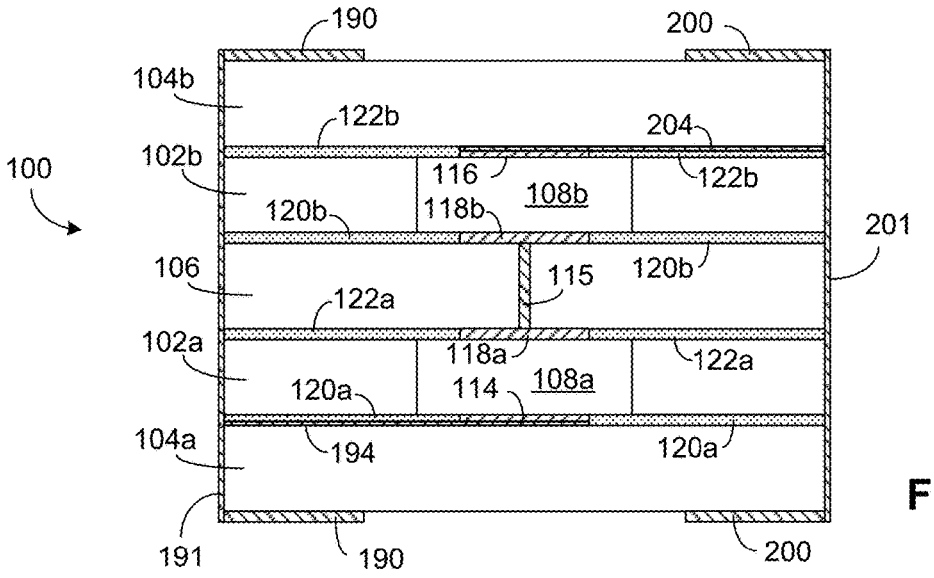
FIG. 39 shows an example of a GDT device having a plurality of sealed chambers implemented in a stack configuration.

In the example of FIG. 39, the two chambers 108*a*, 108*b* can be generally sealed from each other, and the two GDT units associated with the two chambers 108*a*, 108*b* can be electrically connected in series. More particularly, the first center electrode 118*a* of the first chamber 108*a* and the second center electrode 118*b* of the second chamber 108*b* can be electrically connected through, for example, a conductive via 115 to yield the foregoing series arrangement of the two GDT units.

In the example of FIG. 39, the first end electrode 114, which forms one end of the foregoing series arrangement of the two GDT units, is shown to be electrically connected to a first terminal 190. Similarly, the second end electrode 116, which forms the other end of the foregoing series arrangement of the two GDT units, is shown to be electrically connected to a second terminal 200. Such electrical connections between the electrodes and the corresponding terminals can be implemented in different ways as described herein. For example, the electrode 114 can be electrically connected to the first terminal 190 through a conductive trace 194, and an external conductive feature 191 such as castellation formed on the corresponding side of the GDT device 100. Similarly, the electrode 116 can be electrically connected to the second terminal 200 through a conductive trace 204, and an external conductive feature 201 such as castellation formed on the corresponding side of the GDT device 100.

Figure 40:
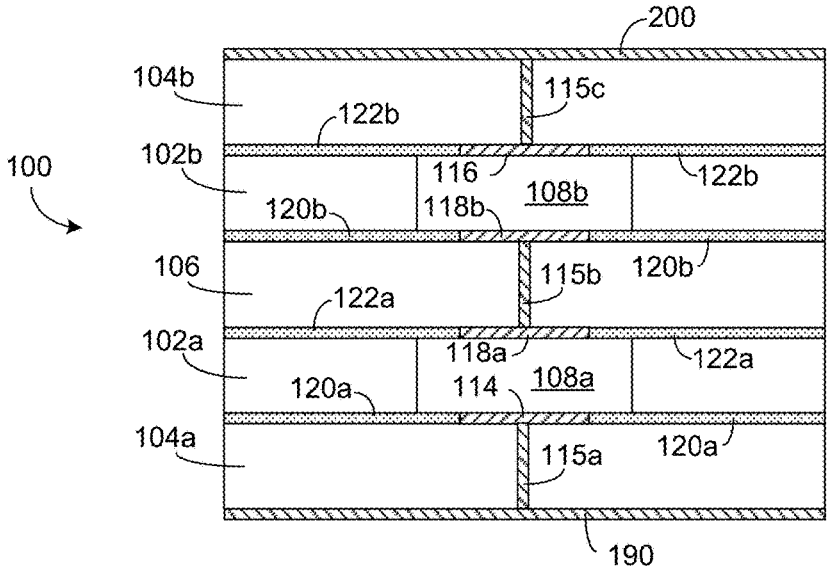
FIG. 40 shows another example of a GDT device having a plurality of sealed chambers implemented in a stack configuration.

In the example of FIG. 40, the two chambers 108*a*, 108*b* can be generally sealed from each other, and the two GDT units associated with the two chambers 108*a*, 108*b* can be electrically connected in series, similar to the example of FIG. 39. More particularly, the first center electrode 118*a* of the first chamber 108*a* and the second center electrode 118*b* of the second chamber 108*b* can be electrically connected through, for example, a conductive via 115*b* to yield the foregoing series arrangement of the two GDT units.

In the example of FIG. 40, the first end electrode 114, which forms one end of the foregoing series arrangement of the two GDT units, is shown to be electrically connected to a first terminal 190 through a conductive via 115*a*. Similarly, the second end electrode 116, which forms the other end of the foregoing series arrangement of the two GDT units, is shown to be electrically connected to a second terminal 200 through a conductive via 115*c*. Configured in the foregoing manner, the GDT device 100 can have the first terminal 190 on one side (e.g., lower side) and the second terminal 200 on an opposite side (e.g., upper side). Accordingly, the GDT device 100 of FIG. 40 can be utilized in, for example, applications described herein in reference to FIGS. 31-38.

Figure 41:
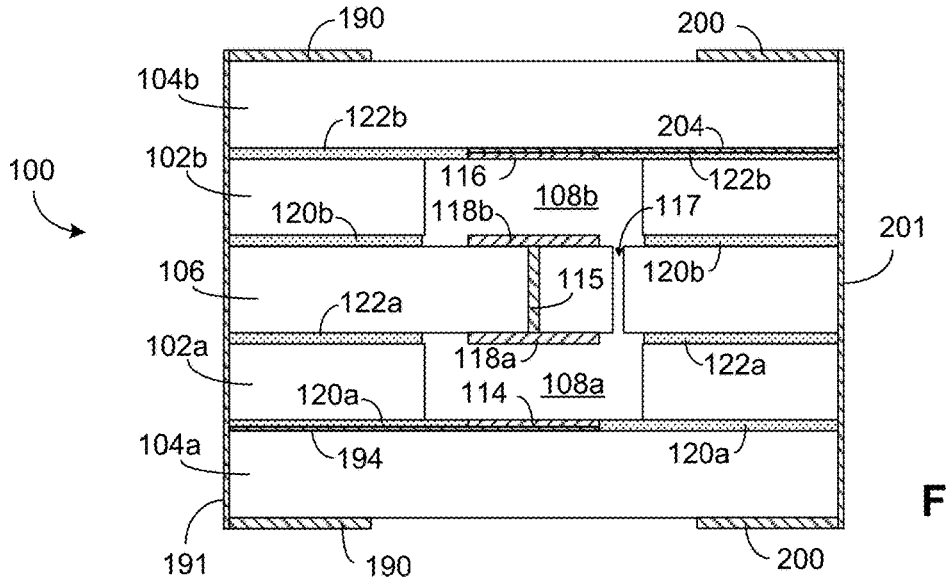
FIG. 41 shows an example of a GDT device having a stack configuration similar to the example of FIG. 39, but with a plurality of chamber in communication with each other.

FIG. 41 shows an example GDT device 100 that is similar to the example of FIG. 39. However, in the example of FIG. 41, first and second chambers 108*a*, 108*b* can be in communication with each other through one or more openings 117 formed through an insulator substrate 106 that generally separates the two chambers. Electrical connections among the various electrodes and terminals can be implemented similar to the example of FIG. 39.

Figure 42:
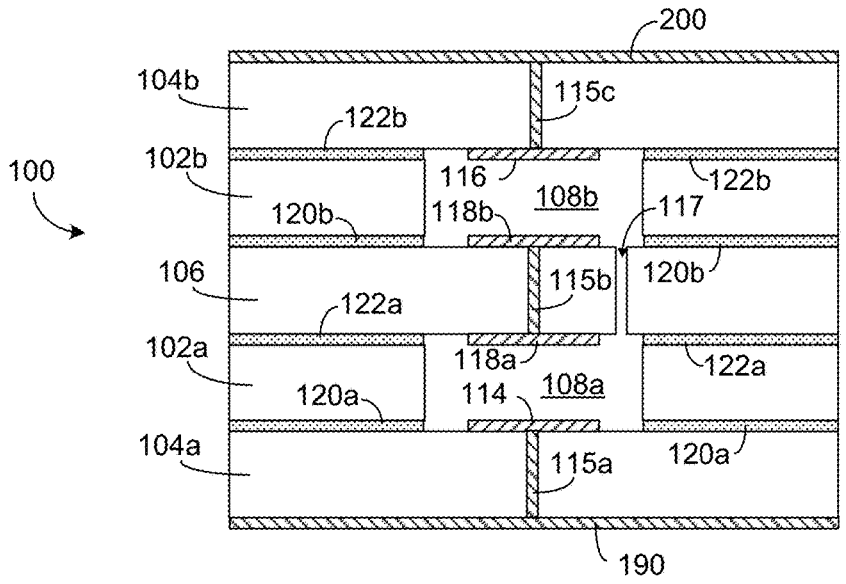
FIG. 42 shows an example of a GDT device having a stack configuration similar to the example of FIG. 40, but with a plurality of chambers in communication with each other.

FIG. 42 shows an example GDT device 100 that is similar to the example of FIG. 40. However, in the example of FIG. 42, first and second chambers 108*a*, 108*b* can be in communication with each other through one or more openings 117 formed through an insulator substrate 106 that generally separates the two chambers. Electrical connections among the various electrodes and terminals can be implemented similar to the example of FIG. 40.

Figure 43:
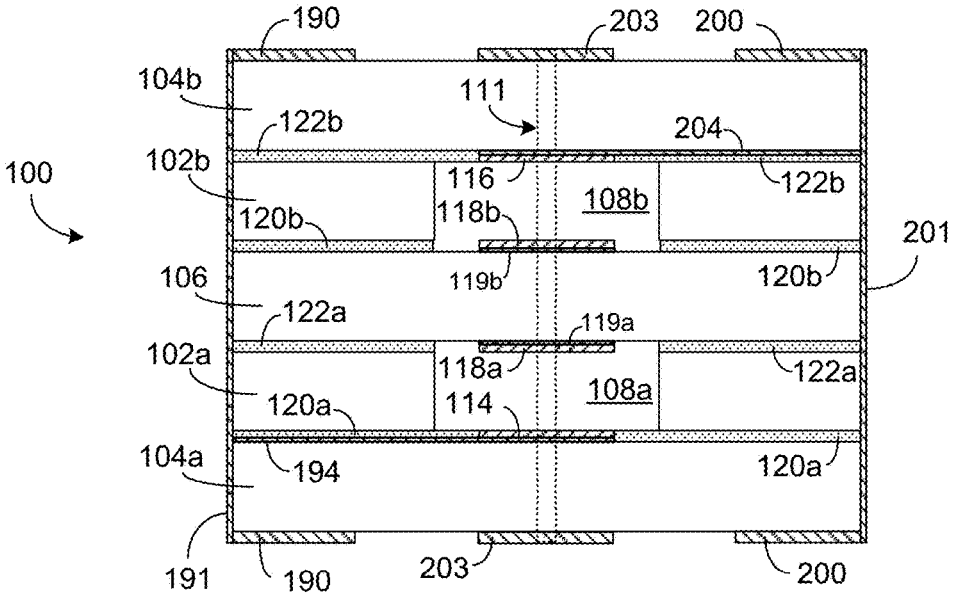
FIG. 43 shows an example of a GDT device having a stack configuration similar to the example of FIG. 39, but in which center electrodes can be electrically connected to a third terminal.

FIG. 43 shows an example GDT device 100 that is similar to the example of FIG. 39, but with center electrodes 118*a*, 118*b* being electrically connected to a third terminal 203. More particularly, in the example of FIG. 43, the two chambers 108*a*, 108*b* can be generally sealed from each other. The first center electrode 118*a* of the first chamber 108*a* and the second center electrode 118*b* of the second chamber 108*b* can be electrically connected through, for example, a conductive trace 119*a*, an external conductive feature 111 such as a castellation, and a conductive trace 119*b*. Such a castellation can be implemented on a side wall not being utilized for electrical connections for other electrodes. In the example shown in FIG. 43, such a side wall can be a front side wall or a back side wall.

In the example of FIG. 43, the castellation 111 can extend to the lower surface and be in electrical contact with the third electrode 203 formed on the lower surface of the GDT device 100. The castellation 111 can extend to the upper surface and be in electrical contact with the third electrode 203 formed on the upper surface of the GDT device 100. In the example of FIG. 43, electrical connections among other electrodes (e.g., 114, 116) and terminals (190, 200) can be implemented similar to the example of FIG. 39.

Figure 44:
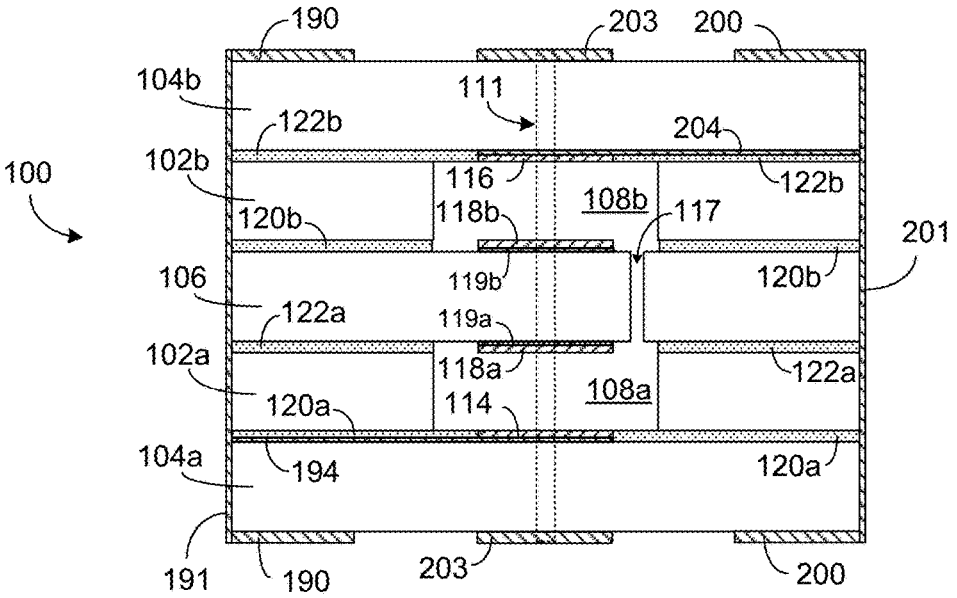
FIG. 44 shows an example of a GDT device similar to the example of FIG. 43, but in which a plurality of chambers can be in communication with each other.

FIG. 44 shows an example GDT device 100 that is similar to the example of FIG. 43. However, in the example of FIG. 44, first and second chambers 108*a*, 108*b* can be in communication with each other through one or more openings 117 formed through an insulator substrate 106 that generally separates the two chambers. Electrical connections among the various electrodes and terminals can be implemented similar to the example of FIG. 43.

It will be understood that in the various examples of stacked configurations in FIGS. 39-44, electrical connections among and/or between electrodes and terminals are described in the contexts of more specific examples of various electrical connection techniques. It will be understood that such stacked configurations can also be implemented utilizing any of the electrical connection concepts described herein, individually or in any combination.

In some embodiments, the foregoing stacked configurations with a third terminal (e.g., FIGS. 43, 44) can be desirable in some applications where features such as current handling capabilities and/or reduction in inductance and/or other parasitics are required or desired. In some embodiments, connecting the two gas chambers (e.g., FIGS. 41, 42, 44) can improve impulse spark over balance between the top and bottom halves of two-layered (e.g., in a 3-terminal configuration) GDT 100 devices, and thus can reduce the transverse voltage during common mode surges.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

While some embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A gas discharge tube (GDT) device comprising:

a first insulator substrate having first and second sides and defining an opening;

second and third insulator substrates mounted to the first and second sides of the first insulator substrate, respectively, such that inward facing surfaces of the second and third insulator substrates and the opening of the first insulator substrate define a chamber;

first and second electrodes implemented on the inward facing surfaces of the second and third insulator substrates, respectively;

first and second terminals implemented on at least one external surface of the GDT device; and a first electrical connection implemented between the first electrode and the first terminal, and a second electrical connection implemented between the second electrode and the second terminal.

2. The GDT device of claim 1, wherein the first insulator substrate includes a ceramic layer.

3. The GDT device of claim 2, wherein each of the second and third insulator substrates includes a ceramic layer.

4. The GDT device of claim 1, further comprising first and second seals configured to facilitate sealing of the chamber, the first seal implemented between the second insulator substrate and the first insulator substrate, the second seal implemented between the third insulator substrate and the first insulator substrate.

5. The GDT device of claim 4, wherein each of the first and second seals is an electrically conductive seal.

6. The GDT device of claim 4, wherein each of the first and second seals is an electrically non-conductive seal.

7. The GDT device of claim 4, wherein the first and second terminals are implemented at least on the second insulator substrate.

8. The GDT device of claim 7, wherein the first and second terminals are also implemented on the third insulator substrate and electrically connected to their respective first and second terminals on the second insulator substrate.

9. The GDT device of claim 7, wherein the first electrical connection includes a first internal via that extends through the second insulator substrate and configured to electrically connect the first electrode and the first terminal.

10. The GDT device of claim 9, wherein the second electrical connection includes a second internal via that extends through the third insulator substrate and configured to electrically connect the second electrode and a conductor feature on an outward facing surface of the third insulator substrate.

11. The GDT device of claim 10, wherein the second electrical connection further includes a third internal via that extends through the third insulator substrate, the first insulator substrate, and the second insulator substrate, the third internal via configured to electrically connect the conductor feature on the outward facing surface of the third insulator substrate and the second terminal on the second insulator substrate.

12. The GDT device of claim 10, wherein the second electrical connection further includes an external conductive feature implemented on a side edge of the GDT device and configured to electrically connect the conductor feature on the outward facing surface of the third insulator substrate and the second terminal on the second insulator substrate.

13. The GDT device of claim 12, wherein the external conductive feature includes a castellation feature that is at least partially filled and/or plated with electrically conductive material.

14. The GDT device of claim 7, wherein the first electrical connection includes a first metalized trace that extends laterally from the first electrode to a first side edge of the GDT device, and the second electrical connection includes a second metalized trace that extends laterally from the second electrode to a second side edge of the GDT device.

15. The GDT device of claim 14, wherein the first side edge and the second side edge are opposing edges.

16. The GDT device of claim 14, wherein the first electrical connection further includes a first external conductive feature implemented on the first side edge and configured to electrically connect the first metalized trace and the first terminal, the second electrical connection further includes and a second external conductive feature implemented on the second side edge and configured to electrically connect the second metalized trace and the second terminal.

17. The GDT device of claim 16, wherein each of the first and second external conductive features includes a castellation feature that is at least partially filled and/or plated with electrically conductive material.

18. A method for fabricating a gas discharge tube (GDT) device, the method comprising:

providing or forming a first insulator substrate having first and second sides and defining an opening;

mounting second and third insulator substrates to the first and second sides of the first insulator substrate, respectively, such that inward facing surfaces of the second and third insulator substrates and the opening of the first insulator substrate define a chamber, each of the second and third insulator substrates having an electrode implemented on the respective inward facing surface;

forming first and second terminals on at least one external surface of the second and third insulator substrates; and electrically connecting the first electrode and the first terminal, and electrically connecting the second electrode and the second terminal.

19. A method for fabricating gas discharge tube (GDT) devices, the method comprising:

providing or forming a first insulator plate having first and second sides and an array of openings;

providing or forming second and third insulator plates, each including an array of electrodes implemented on a surface, and a conductor feature electrically connected to each electrode; and mounting the second and third insulator plates to the first and second sides of the first insulator plate, respectively, such that the arrays of electrodes on the second and third insulator plates face each other through the array of openings of the first insulator plate to thereby define an array of chambers.

* * * * *